US006571532B1

(12) United States Patent
Wiernicki et al.

(10) Patent No.: US 6,571,532 B1
(45) Date of Patent: Jun. 3, 2003

(54) CONTINUOUS MOTION CASE PACKING APPARATUS AND METHOD

(75) Inventors: Richard M. Wiernicki, Roebuck, SC (US); David Nelson Cooley, Greenville, SC (US); Thomas Patterson Hartness, Greenville, SC (US)

(73) Assignee: Hartness International, Inc., Greenville, SC (US)

( * ) Notice: Subject to any disclaimer, the term of this patent is extended or adjusted under 35 U.S.C. 154(b) by 0 days.

(21) Appl. No.: 09/301,394

(22) Filed: Apr. 28, 1999

Related U.S. Application Data

(63) Continuation-in-part of application No. 09/137,327, filed on Aug. 20, 1998, now abandoned, which is a continuation of application No. 08/736,376, filed on Oct. 26, 1996, now Pat. No. 5,797,249, which is a continuation-in-part of application No. 08/338,026, filed on Nov. 10, 1994, now Pat. No. 5,588,282.

(51) Int. Cl.[7] ..... B65B 5/08; B65B 21/06; B65B 21/08

(52) U.S. Cl. ..... 53/247; 53/534; 53/539; 53/251; 53/475; 414/225.01

(58) Field of Search ..... 53/247, 534, 539, 53/473, 475, 251, 249, 248, 497, 496, 495; 414/225.01

(56) References Cited

U.S. PATENT DOCUMENTS

| | | | | |
|---|---|---|---|---|
| 1,481,259 | A | 1/1924 | Harrison | |
| 1,538,406 | A | 5/1925 | McCarty et al. | |
| 1,583,767 | A | 5/1926 | Akins et al. | |
| 2,277,688 | A | 3/1942 | Cattonar et al. | 53/248 |
| 2,350,692 | A | 6/1944 | Milek | 294/116 |
| 2,730,279 | A | 1/1956 | Enock | 226/14 |
| 2,760,316 | A | 8/1956 | Okulitch et al. | 53/61 |

(List continued on next page.)

*Primary Examiner*—S. Thomas Hughes
*Assistant Examiner*—Eric Compton
(74) *Attorney, Agent, or Firm*—McNair Law Firm, P.A.; Cort Flint

(57) ABSTRACT

A continuous motion apparatus for depacking and packing articles in cases which includes a carriage which carries a plurality of transfer arms; a plurality of article pick-up heads carried by the transfer arms for picking up a group of the articles at a pick-up station to transfer the articles to a release station. In a case packing configuration of the invention, a slug metering section includes a slug feeder continuously receiving articles from an infeed conveyor. A revolving pin bar mechanism is carried in the slug metering section having a plurality of revolving pin bar assemblies to assist in forming the articles into successive groups or slugs of articles. The pin bar assemblies include spaced upstanding pins which are received in crevices between rear articles in a first slug and front articles in a second slug of articles to separate the articles for processing. A slug metering member, which can also have upstanding posts, is carried across the slug metering section and pivots in and out of a conveyance path of the articles in synchronism with the revolving pin bar mechanism to meter the articles. In the depacking configuration, a plurality of article gripper tubes are carried by each article pick-up head arranged in a matrix corresponding to the slug of articles. The gripper tubes have a grip position in which said articles are retained by the pick-up head at the pick-up station for transfer, and a release position in which the articles are released from the pick-up head at the release station. Advantageously, the gripper tubes have a first effective axial length for gripping articles at the pick-up station when the articles are in an upright configuration, and the gripper tubes have a second effective axial length which is compressed and shortened relative to the first axial length when striking an obstacle such as an inverted article to allow sufficient travel for all other gripper tubes to grip articles.

33 Claims, 52 Drawing Sheets

U.S. PATENT DOCUMENTS

| | | | | | |
|---|---|---|---|---|---|
| 2,890,553 | A | * | 6/1959 | Day et al. | |
| 2,921,425 | A | * | 1/1960 | Seval | |
| 3,012,811 | A | | 12/1961 | Sandrock | 294/83 |
| 3,505,787 | A | | 4/1970 | Tiews | 53/166 |
| 3,553,927 | A | | 1/1971 | Anglade, Jr. | 53/26 |
| 3,553,932 | A | | 1/1971 | Rowekamp | 53/539 |
| 3,555,770 | A | | 1/1971 | Rowekamp | 53/61 |
| 3,555,773 | A | | 1/1971 | Rowekamp | 53/166 |
| 3,648,427 | A | | 3/1972 | Raudat et al. | 53/61 |
| 3,727,366 | A | | 4/1973 | Schlueter et al. | 53/61 |
| 3,805,476 | A | | 4/1974 | Kawamura et al. | 53/26 |
| 3,864,890 | A | * | 2/1975 | Ullman | |
| 3,938,847 | A | * | 2/1976 | Peyton | |
| 3,944,058 | A | * | 3/1976 | Struass | |
| 3,971,190 | A | | 7/1976 | McGill | 53/77 |
| 4,055,943 | A | | 11/1977 | Reichert | 53/247 |
| 4,169,621 | A | * | 10/1979 | McGill | |
| 4,215,521 | A | | 8/1980 | Hartness | 53/248 |
| 4,294,057 | A | | 10/1981 | Winiasz | 53/244 |
| 4,300,330 | A | | 11/1981 | Hartness | 53/539 |
| 4,446,672 | A | | 5/1984 | Raudat | 53/448 |
| 4,457,121 | A | | 7/1984 | Johnson et al. | 53/247 |
| 4,541,524 | A | | 9/1985 | McGill et al. | 198/470 |
| 4,587,792 | A | | 5/1986 | Hartness et al. | 53/382 |
| 4,723,649 | A | | 2/1988 | Hartness et al. | 198/442 |
| 5,174,430 | A | * | 12/1992 | Ebira | |
| 5,212,930 | A | | 5/1993 | Raudat | 53/539 |
| 5,257,888 | A | | 11/1993 | Kronseder | 414/416 |
| 5,313,764 | A | | 5/1994 | Kronseder | 53/247 |
| 5,487,257 | A | | 1/1996 | Domeier et al. | 53/539 |
| 5,588,282 | A | * | 12/1996 | Hartness | |
| 5,797,249 | A | * | 8/1998 | Hartness | |

* cited by examiner

Fig. 23
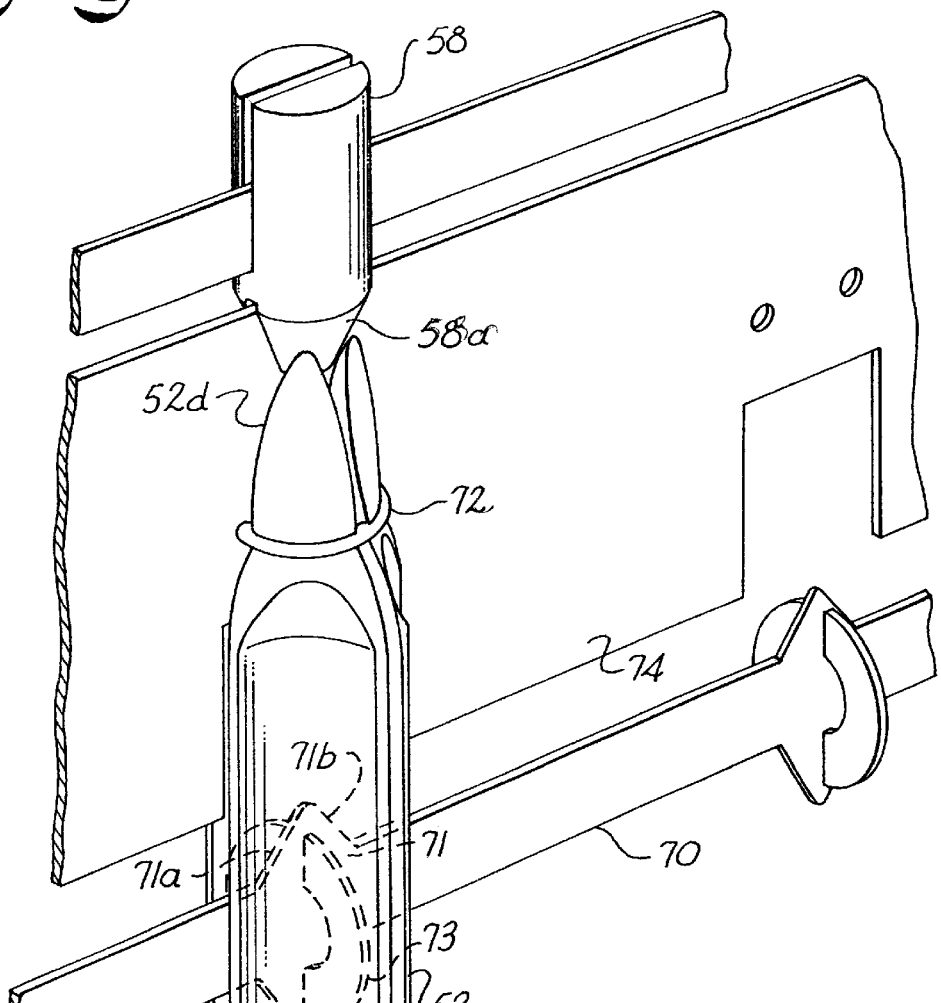
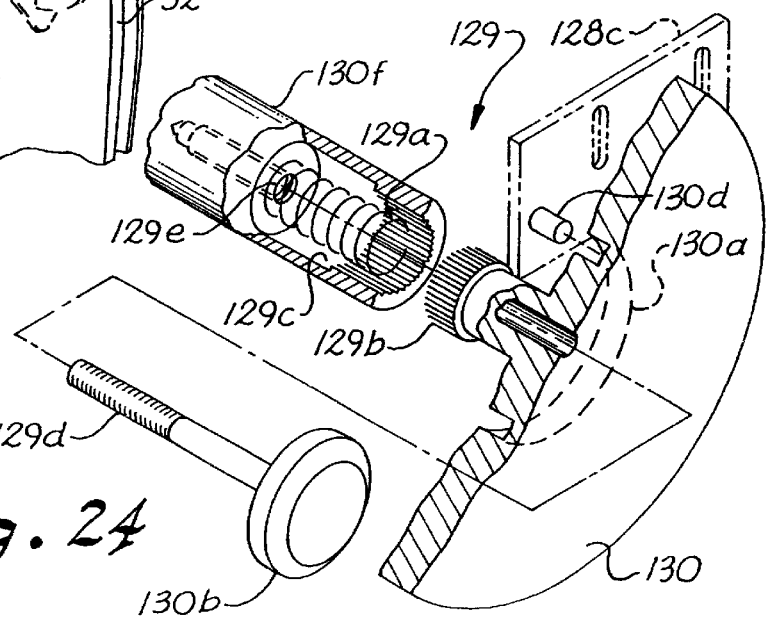
Fig. 24

CONTINUOUS MOTION CASE PACKING APPARATUS AND METHOD

This is a continuation-in-part of application Ser. No. 09/137,327, filed Aug. 20, 1998, now abandoned, entitled Continuous Motion Case Packing Apparatus; which is a continuation of application Ser. No. 08/736,376, filed on Oct. 26, 1996, entitled Continuous Motion Case Packing Apparatus, which is now U.S. Pat. No. 5,797,249 issued on Aug. 25, 1998; which is a continuation-in-part of application Ser. No. 08/338,026, filed on Nov. 10, 1994, entitled Continuous Motion Case Packing Apparatus, which is now U.S. Pat. No. 5,588,282 issued on Dec. 31, 1996.

BACKGROUND OF THE INVENTION

The invention relates to an apparatus and method for packing articles into cases using an apparatus and method having a continuous motion, and particularly, to improvements in article grippers for article depacking and packing, and improvements in a metering section for segregating successive slugs or groups of moving articles which are continuously picked up and transferred.

In the art of case packing, large numbers of articles must be grouped and packaged rapidly by an apparatus that will function dependably without damage to the articles processed. Case packing apparatus has been generally categorized as either intermittent case packing or continuous case packing. Most recently, attention has been directed to continuous case packing in order to increase production. However, the continuous case packing has brought increased problems with handling the processed articles without damage.

In the continuous case packing apparatus, articles conveyed in at least one row of articles are divided up into slugs or groups of articles which are fed to a pick-up position. The slugs of articles are picked up at the pick-up position by article grippers carried by an orbital handling conveyor. The slugs are transferred to a case loading position where the grippers release the slug of articles into a case. The articles can be released either simultaneously or sequentially as the case is conveyed beneath the slug of articles. Apparatus of this type may be either of the "drop packer" type or "placement packer type." In the drop packer type, the articles are allowed to drop at least a small distance into the case after release. In the placement packer type, the drop, if any, is minimal and the articles are essentially placed gently onto the bottom of the case.

Various case packers, generally of the continuous motion type, using a vertical orbital conveyor are shown in U.S. Pat. Nos. 5,212,930; 4,541,524; and 4,294,057. The first patent shows depositing the articles sequentially and individually, rather than as slugs, into partitioned cases without positively gripping the articles. The latter two patents use gripper devices to grip the articles.

U.S. Pat. No. 4,457,121 discloses a continuous motion bottle packer wherein a plurality of grids are mounted individually on spokes of a vertical wheel so that each grid moves through an article infeed position where groups of articles are fed into the grid without interrupting the forward speed. The wheel moves the grids and articles to a lower discharge position where the groups of articles are dropped into a case without interrupting the motion of the articles in the direction of a case conveyor which indexes the cases. While continuous, this bottle packer generally of the drop packer type wherein the bottles are dropped into the case through resilient fingers. Also, a control problem is created due to the necessity of varying the speed between the rotating grids and the linearly moving cases in order to coordinate reliable timing of the grid and the case at the case packing position for reliable insertion of the slug. Angular and horizontal accelerations of the articles and their contents are also encountered due to the rotary wheel motion during the transfer which may be detrimental to the article and/or contents.

Continuous motion case packers are also known having a vertical rotating wheel which carries a plurality of arms which include two articulating links. A set of article grippers is carried on the ends of the articulating arms. The relative angular positions of the articulating links are controlled to place the article grippers over a slug of articles at a pick-up position, positively grip the slug, and lower the slug to a case packing position where moving cases are indexed with the moving gripper sets. However, during the angular descent from the pick-up position to the case packing position, both horizontal and vertical accelerations are encountered by the articles which are gripped only at their tops or necks. U.S. Pat. No. 5,313,764 discloses a continuous motion case packer wherein the articles and cases are indexed and conveyed on parallel conveyors arranged one above the other. Steering bars which correspond to the bars of a parallelogram move a gripper set, in the same general direction as the article and case conveyance, between the pick-up and case packing positions. However, again, horizontal and vertical accelerations are produced on the pick-up head and the articles, and timing becomes a problem.

Continuous case packers are also known in which a horizontal rotary carousel is used to move vertically reciprocating gripper sets in a horizontal plane. The reciprocating gripper sets pick up a slug of articles at one position and transfer the slug of articles to a second position where the gripper set is lowered to deposit the articles into a case. However, the disposition of the rotary carousel in a horizontal plane requires an inconvenient floor lay-out which also occupies a large amount of floor space. Typically, parallel conveyor arrangements are needed for the articles and the cases adding to the floor space problem. The path of the gripper sets between the slug pick-up position and the case packing position is also typically curved producing angular accelerations and forces on the articles, and the curved article path intersects the path of the conveyed case only for a brief interval. In various of the rotary carousel types, it is known to deposit the articles by lowering the articles, already gripped by the gripper set, through resilient fingers that guide the articles into partitioned cases.

Case packers, generally of the intermittent type, are shown in U.S. Pat. Nos. 3,553,932 and 3,505,787 which also disclose using combinations of a lifting head having suction cups and bottle grids having pockets for picking up containers and depositing them into cases. The containers and the cases are conveyed on parallel conveyors rather than in-line conveyors, and the transfer from the pick-up position to the case loading position is lateral, or transverse, to the flow of containers and cases. U.S. Pat. No. 2,277,688 discloses another case packer using an arrangement of a gripper set and a bottle guide set to package the containers into a case. These type of case packers are generally non-continuous as compared to the continuous motion in-line transfer case packers described above where neither the flow of articles nor the flow of the cases is stopped during operation of the packer.

Accordingly, an object of the invention is to provide an improved continuous motion case packing apparatus and method which can be used for case packing or depacking.

Another object of the invention is to provide a continuous motion apparatus and method in which slugs of articles are picked up, transferred, and deposited in a reliable, continuous manner without damage to the articles or their contents.

Another object of the invention is to provide a continuous motion case packing apparatus and method having a slug feeder which can be adjusted to change over the size of the slug in a quick and easy manner without the need of extensive machine down time and substitution and reassembling of mechanical parts.

Another object of the invention is to provide a continuous motion case packing apparatus and method in which slugs of articles are picked up and transferred to a case packing station over a horizontal linear transfer path in which the horizontal speed of the slug is constant, and depositing into a case is done in a gentle vertical motion.

Still another object of the invention is to provide a continuous motion case packing apparatus and method having a grid head which includes a matrix of gripper tubes which picks up articles from overhead, yet yields when an inverted article is engaged so that the remaining upright articles may be gripped and retained for transfer and deposit i a reliable and continuous manner.

Yet another object of the invention is to provide a continuous motion case packing apparatus and method in which a revolving carriage moves a plurality of transfer arms having reciprocating article pick-up heads in a vertical plane, closed curve path in a manner that the slugs of articles conveyed in the same plane are picked up, transferred, and deposited onto a conveyor in a reliable, continuous manner.

SUMMARY OF THE INVENTION

The above objectives are accomplished according to the present invention by providing a continuous motion apparatus for case packing or case depacking of articles. A carriage carries a plurality of transfer arms; and a plurality of article pick-up heads are carried by the transfer arms for picking up a slug of articles at a pick-up or release station for transferring the slug of articles for future processing.

In an advantageous form of the invention, the slug feeder comprises a slug metering section for continuously receiving articles from the infeed conveyor. A revolving pin bar mechanism is carried in the slug metering section having a plurality of revolving pin bar assemblies to assist in forming the articles into successive slugs of articles. The pin bar assemblies include spaced upstanding pins which are received in crevices between rear articles in a first slug and front articles in a second slug of articles to separate the articles into slugs for processing. A slug metering member is carried across the slug metering section which moves in and out of a path of conveyance of the articles in a cyclic manner in synchronism with said revolving pin bar mechanism. A metering distance is defined between the metering member and the revolving pin bar assemblies which determines the number of articles in a row and the size of the slug. A drive mechanism drives the metering member in the cyclic movements in and out of the article conveyance path. Preferably, the revolving pin bar mechanism includes a revolving mechanism; and each pin bar assembly includes a pin bar carrier pivotally carried by the revolving mechanism, a pin bar carried by the pin bar carrier, and the upstanding pins are affixed to said pin bar. Advantageously, a detachable mount detachably affixes the pin bar to the pin bar carrier so that the pin bar may be removed and a new pin bar may be affixed to the pin bar carrier having differently spaced pins for accommodating articles with different dimensions.

The detachable mount includes a first attachment element carried by the pin bar carrier and a second attachment element carried by the pin bar cooperating with the first attachment element for removably affixing the pin bar and pin bar carrier together. The upstanding pins are arranged in pairs on the pin bar and a distance between the pins in each pair corresponds to a dimension of the articles for effectively engaging and separating the articles into slugs.

In a further advantageous embodiment of the invention, the pin bar assemblies include at least one cam yoke carried by the pin bar carrier. An infeed cam plate is carried at an infeed end of the metering section having a first cam surface for engaging the cam yoke along a radial cam path. The cam plate has a second cam surface engaged by the cam yoke to move the pins from a first, non-contacting position to a second, contacting position wherein the pins are received in said crevices to contact the articles. A second cam plate cooperates with the first cam plate to define the radial path, and the second cam plate includes a third cam surface for urging the cam yoke toward the second cam surface of the first cam plate. A pair of vertically spaced top cam bars define a linear path along the metering section for guiding the cam yoke whereby the pins are positioned in a second position along the linear path. A bottom cam bar defines a bottom linear guide for guiding the cam yoke along a generally linear bottom path of the metering section. Preferably, the top cam bars comprise an upper cam bar and a lower cam bar, the upper cam bar prevents the pin bar assembly from rotating clockwise as the pin bar assembly contacts the article in the second position, and the lower cam bar prevents the pin bar from falling downwardly under the force of gravity. The cam yoke may be carried by a carrier arm of the pin bar carrier which secures the pin bar carrier to the flight bars, wherein opposing ends of the flight bars are secured to a drive chain of the revolving mechanism. The pin bar carrier is pivotally carried on the flight bar by means of the carrier arm to define a pivot, and the cam yoke is affixed to the carrier arm at a position which is displaced above and forward of the pivot relative to the direction of travel of the pin bar assembly so that proper pivotal movements are imparted to the pin bar assembly during slug separation.

In another aspect of the invention, when used as a packing machine, the metering member is carried by an adjustable carrier by which the metering distance between the metering member and the revolving pin bar assemblies may be adjusted to determine the number of articles in a row and the slug size. The drive mechanism includes a timing cam carried by the adjustable carrier for guiding the metering member in the cyclic motions which include reciprocating horizontal and pivotal motions. A first linkage is connected between the timing cam and the metering member for actuating the metering member in pivotal motions, and a second linkage connected to the timing cam and to the metering member for moving the metering member in linear movements. Preferably, the first linkage carries a cam follower which is received in a first cam slot of the timing cam, and the second linkage carries a cam follower received in a second cam slot of the timing cam. The first linkage comprises an actuator link connected by means of a pivot to the metering member for rocking the metering member up and down in cyclic motions; and the second linkage includes a reciprocating bar for reciprocating the metering member. The metering member advantageously comprises a metering bar extending across the metering section, and a plurality of upstanding posts arranged in spaced pairs carried across the metering bar, and the posts are rocked in and out of the path of the articles in cyclic movements for metering the number of articles in the slug.

In an advantageous embodiment of the invention for unpacking articles, a constant motion apparatus is provided for continuously transferring a slug of articles from a pick-up station to a release station. The apparatus includes a revolving carriage which carries a plurality of article transfer arms; and a plurality of article pick-up heads carried by the transfer arms which reciprocate in a linear motion relative to the transfer arms for picking up the articles at the pick-up station in the form of a group or slug of articles. A plurality of article gripper tubes is carried by each article pick-up head, and arranged in a matrix corresponding to the slug of articles. The gripper tubes having a grip position in which the articles are retained by the pick-up head at the pick-up station for transfer, and the actuator has a release position in which the articles are released from the pick-up head at the release station. The gripper tubes having a first effective axial length for picking up articles at the pick-up station when the articles are in an upright configuration, and the gripper tubes having a second effective axial length which is shortened relative to the first axial length for engaging an article at the pick-up station in an inverted configuration. An actuator is associated with the pick-up heads for actuating the gripper tubes between the grip and release positions. Preferably, the gripper tubes include a first part and a second part being axially movable relative to each other; and a gripper carried near an end of the second part. The first part of the gripper tubes may include a slip collar, and the second part includes an inner tube slidably received in the slip collar. Advantageously, a reciprocating mechanism is carried within the slip collar which acts as a solid member until an inverted article is engaged and the retracting mechanism is compressed. The retracting mechanism may include a spring assembly for biasing and maintaining the inner tube in the first axial configuration. For that purpose, the reciprocating mechanism may include a first spring which is in a compressed state when the gripper tube is in the second axial configuration. An article gripper is carried by the remote end of the gripper tubes which may include a second spring connected between the reciprocating mechanism and the grippers wherein the first spring rate is greater than the second spring rate so that the first spring mechanism acts as a solid elongated member until a sufficient load is placed on it which occurs as the gripper tube encounters the inverted article.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2H is a schematic elevation illustrating a continuous motion case packing apparatus and method according to the invention illustrating the relative positions of an article transfer arm having gripper and grid heads, a slug of articles, and indexed case after depositing the slug of articles in a case;

FIG. 2I is a schematic view of a vertical plane, curved path of the article transfer arm of FIGS. 2C–2H traveled during a complete cycle of the arm according to the invention;

FIG. 10 is an enlarged, partial view of a grid head having a plurality of corner grid fingers defining grid chutes according to the invention for picking up articles and transferring articles in a continuous motion apparatus and method according to the invention for being deposited in a partitioned case and the like;

FIG. 23 is a perspective view of corner grid fingers and orthogonal chute forming members which form four common corners of adjacent grid chutes according to the invention;

DESCRIPTION OF A PREFERRED EMBODIMENT

Figure 1:
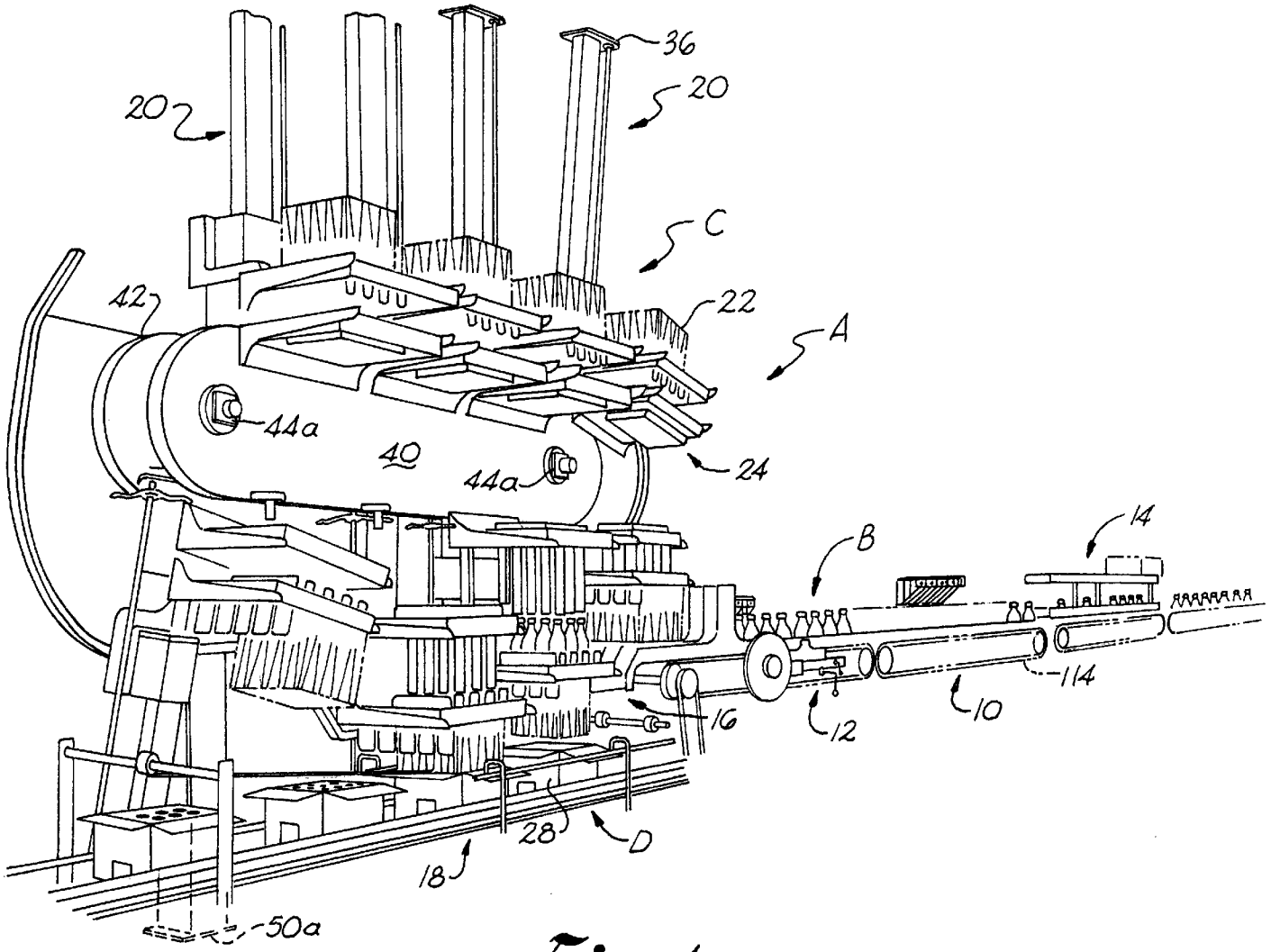
FIG. 1 is a perspective view illustrating a continuous motion case packing apparatus and method according to the invention.

Referring now in more detail to the drawings, as can best be seen in FIG. 1, an apparatus and method for packing articles into cases in a continuous motion is illustrated, designated generally as A. The apparatus includes a slug feeder, designated generally as B which includes a slug feed conveyor 10 and a slug metering section 12. Slug feeder B receives a continuous flow of articles which are conveyed in at least one longitudinal row from a laner section, designated generally as 14. Slug feeder B continuously forms slugs containing a predetermined number of articles, as metered by slug metering sections 12, and continuously feeds the slugs to a slug pick-up station, designated generally as 16. The slugs of articles are picked up at the pick-up station and transferred to a case packing station, designated generally as 18. A revolving carriage, designated generally as C, carries a plurality of article transfer arms 20. A plurality of article pick-up heads in the form of stacked grid heads and gripper heads, designated generally as 22, 24, respectively, are slidably carried on the transfer arms and reciprocate in a linear motion for picking up the slug of articles at pick-up station 16.

Figure 2A:
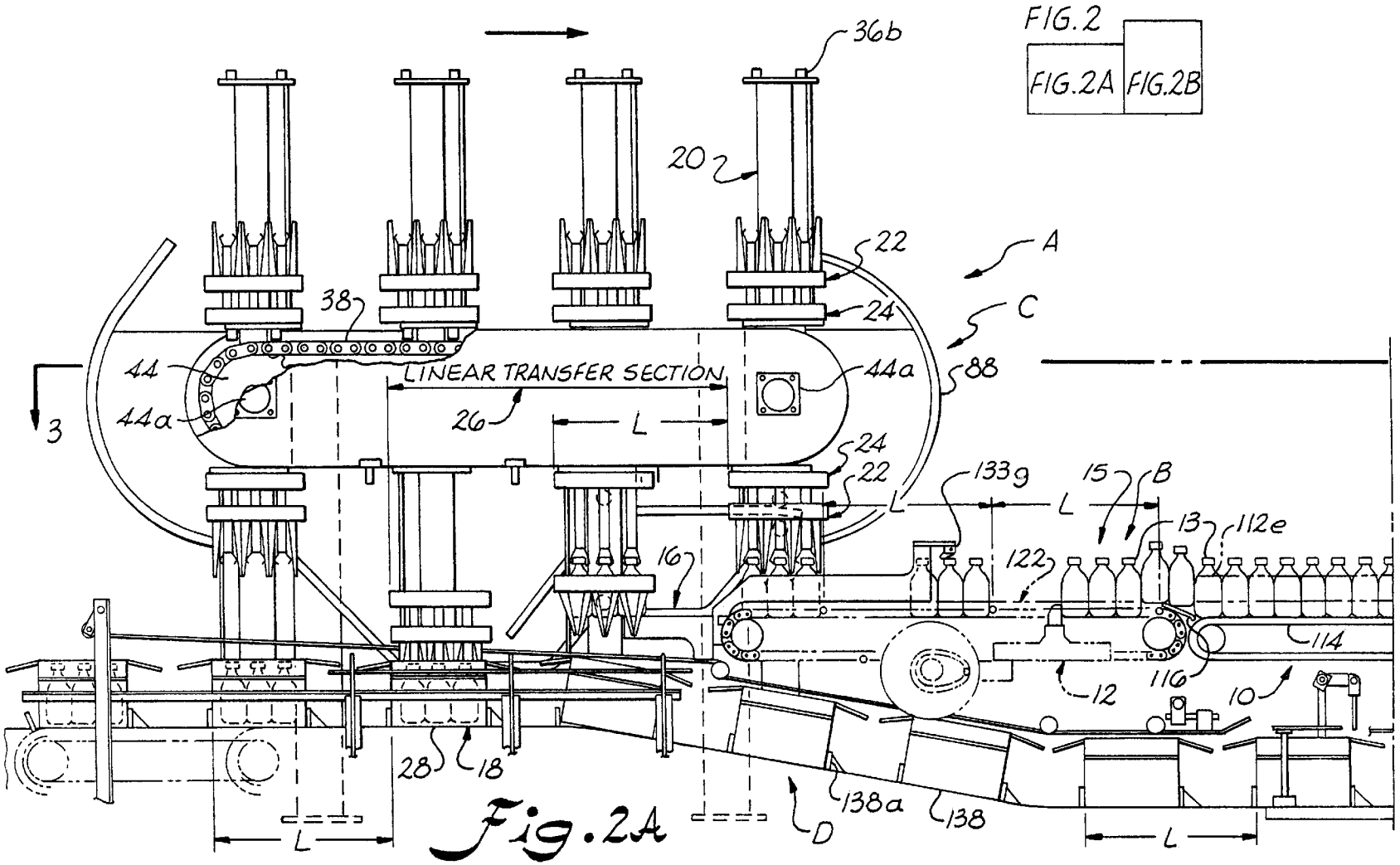
FIG. 2A is a front elevation of a continuous motion case packing apparatus and method according to the invention.

As can best be seen in FIG. 2A, revolving carriage C carries transfer arms 20 and the article pick-up heads in a curved path which includes a linear transfer section 26 which includes the illustrated horizontal distance between pick-up station 16 and case packing station 18 over which the pick-up heads are lowered vertically to gently deposit the articles into a case. For this purpose, a case indexing conveyor, designated generally as D, is disposed below the slug feeder and revolving transfer arms to provide a continuous flow of indexed cases 28 to the case packing station 18 where the articles are gently deposited into the case. For this purpose, as can best be seen in FIG. 2A, an interval "L" is provided which spaces the continuous, successive slugs 15, transfer arms 20 and indexed cases 28 so that the case packing process occurs in a synchronized and continuous manner. It is also pointed out, and will be explained fully later, that the rate of delivery, or horizontal speed, of the slugs, transfer arms, and indexed cases is the same. The center-line in the direction of conveyance for article pick-up heads 22, 24, slugs 15, and indexed cases 28 lie in a common vertical plane within linear transfer section 26. The horizontal speed of transfer arms 20 and article pick-up heads over the linear transfer section is constant. This enables the pick-up heads and cases to track one another accurately for article transfer and case packing. This also provides reliable insertion of the pick-up heads and release of the articles into the case since only a vertical motion is necessary due to the pick-up heads and cases being parallel and vertically aligned for a linear distance within the linear transfer section.

Figure 3B:
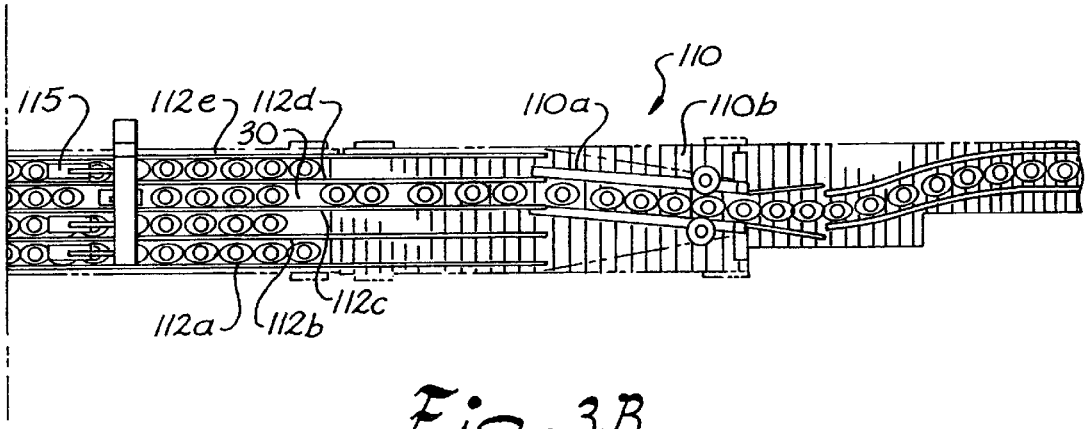
FIG. 3B is a top plan view taken along line 3 of FIG. 2B.
Figure 3A:
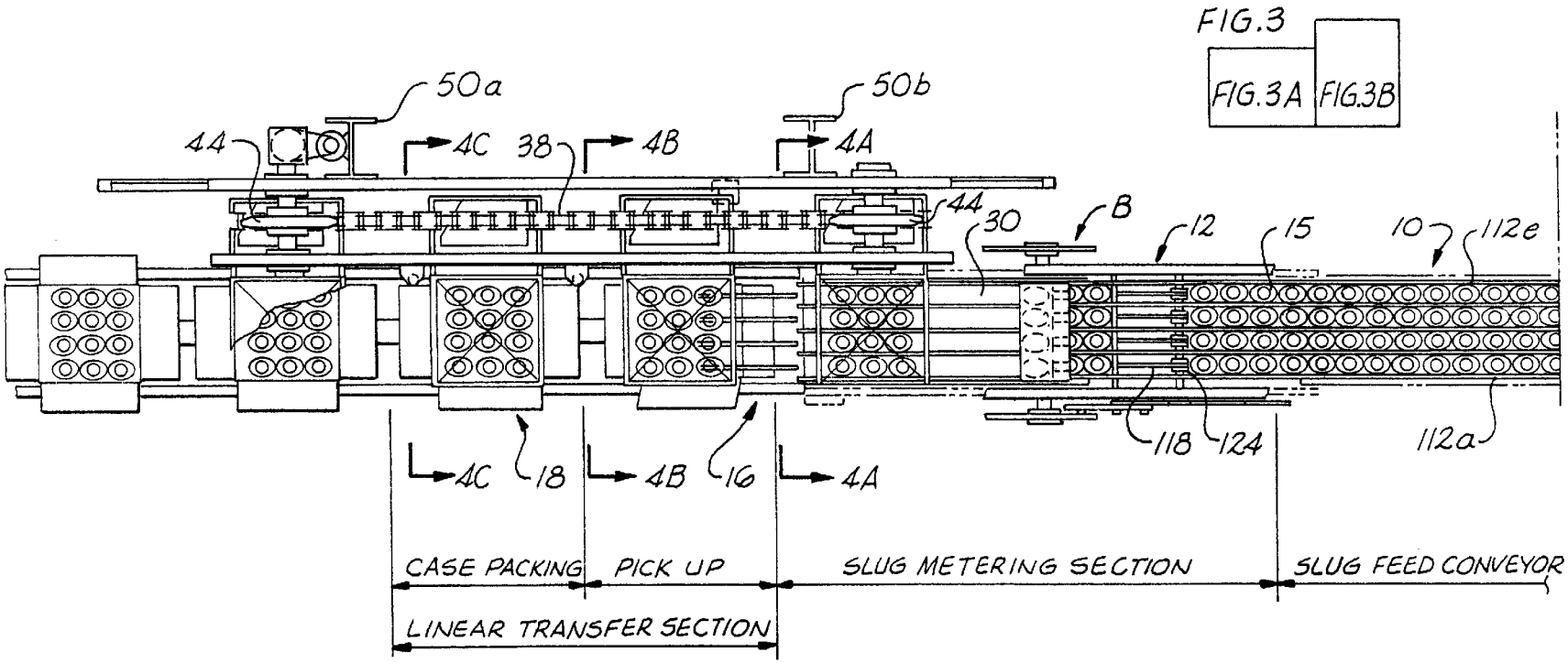
FIG. 3A is a top plan view illustrating a continuous motion case packing apparatus and method according to the invention wherein a slug feeder, slug pick-up station, case packing station, and linear transfer section are illustrated.

The size of slug 15 is determined by the number of longitudinal rows 30 (FIG. 3B) and the number of articles in the longitudinal row. In the example illustrated in the drawings, a slug the size of twelve articles is illustrated. This includes four longitudinal rows 30 containing three articles in a row. As determined by the slug metering section 12 (FIG. 3A). The size of the interval "L" in the illustrated embodiment may be 30 inches, for example. This provides sufficient space between successive slugs and indexed cases such that most standard slug and case sizes used in case packers may be accommodated. In particular, large cases with flaps folded to a horizontal position can be accommodated.

Revolving Carriage and Article Transfer Arms

Figure 4A:
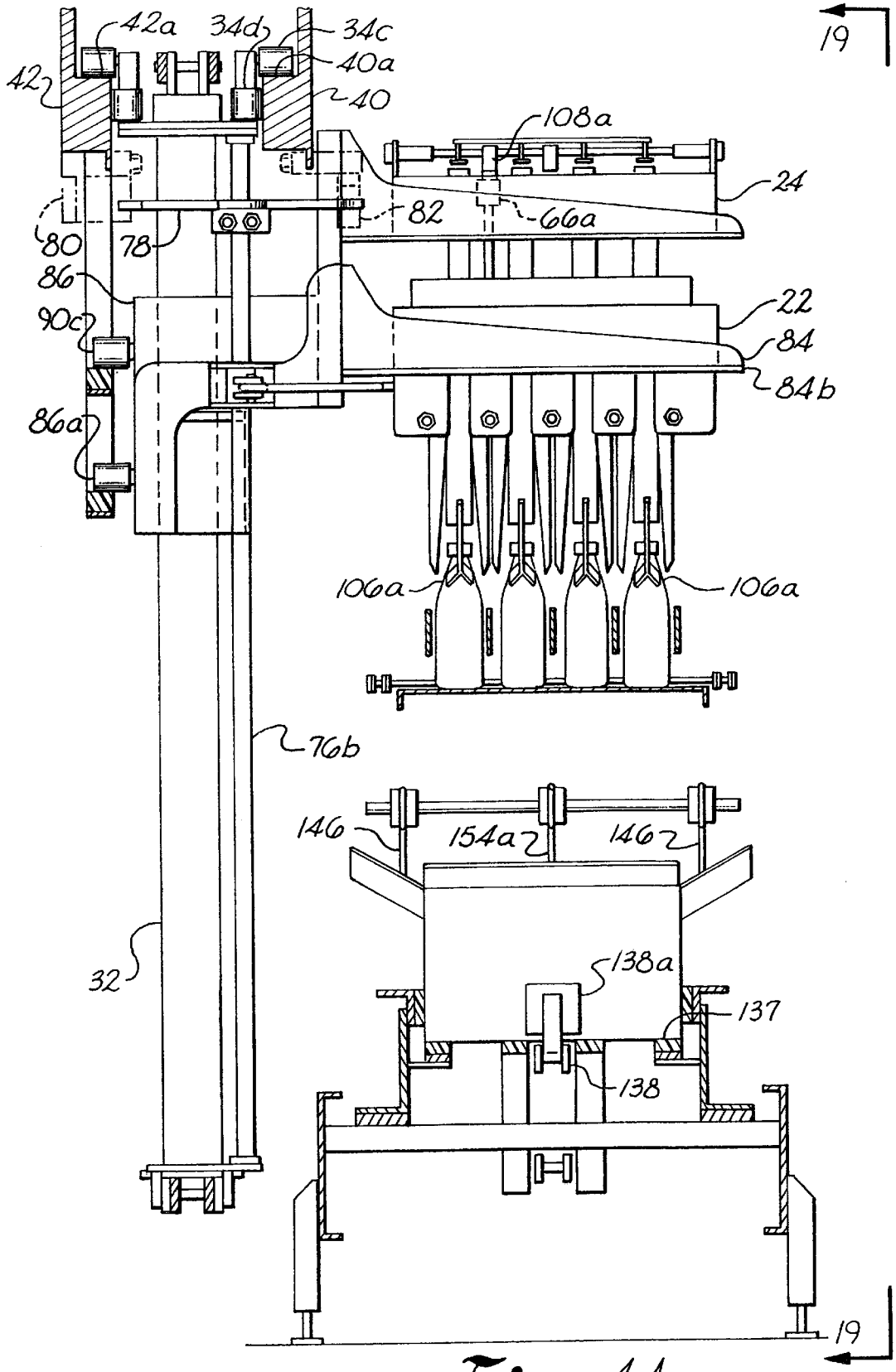
FIG. 4A is a sectional view taken along line 4A—4A of FIG. 3A of the position of a metered slug of articles prior to reaching a slug pick-up station.
Figure 5:
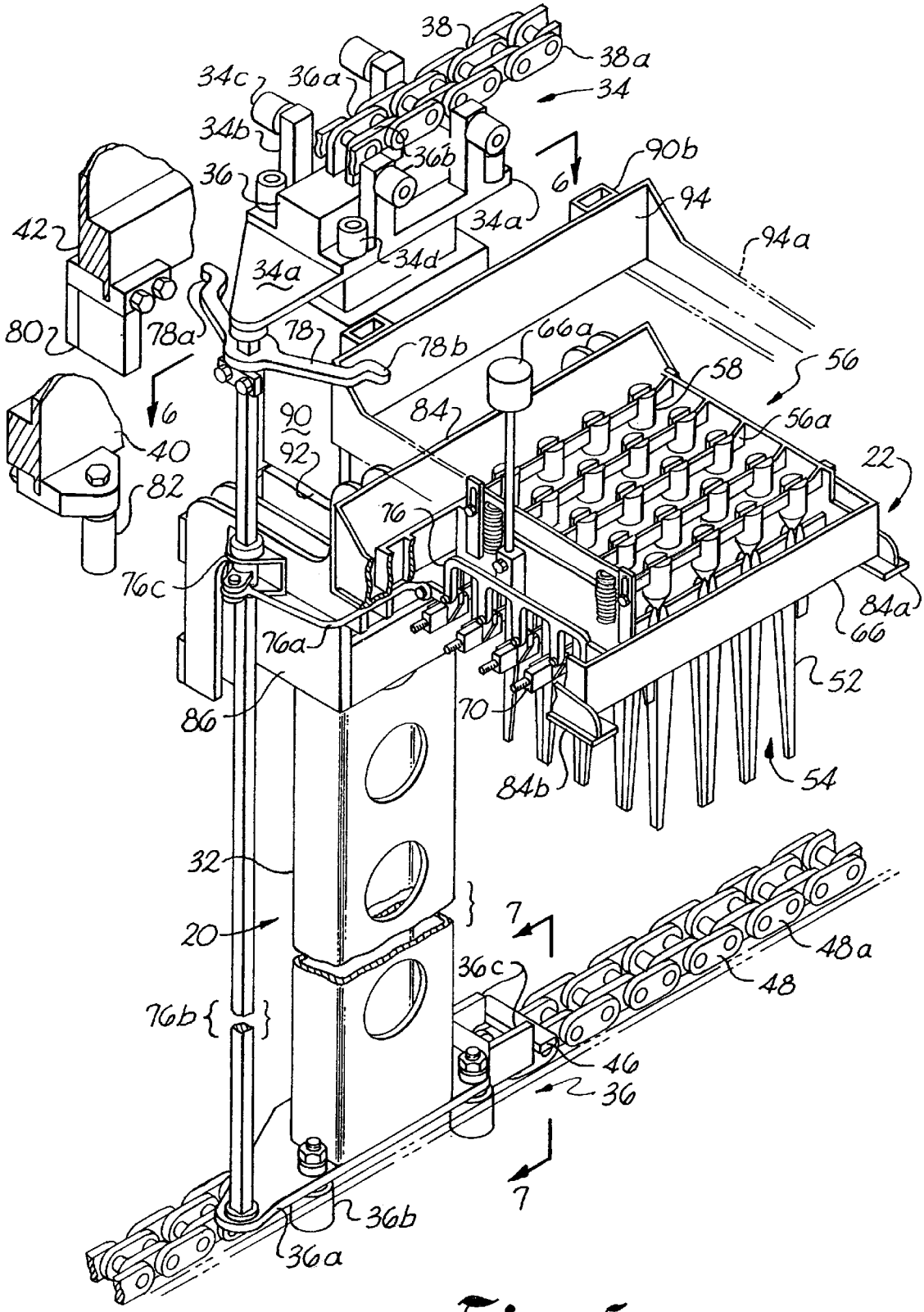
FIG. 5 is a perspective view of an article transfer arm and a reciprocating grid head having a matrix of grid chutes which fit over a slug of articles to capture and retaining the articles for transfer and case packing in a continuous motion apparatus and method according to the invention.

Referring now in more detail to the revolving carriage and transfer arms, as can best be seen in FIG. 5, each transfer arm 20 includes a steel beam 32 having chain connectors connected to the top and bottom of the beam designated generally as 34, 36. Top chain connector 34 includes a plate 34*a* affixed to beam 32 by any suitable means such as welding, and four legs 34*b* extending up from plate 34. Each leg 34*b* includes a roller 34*c*. Also affixed to plate 34*a* is a block 36 having a pair of link plates 36*a*, 36*b* attached to a carriage chain 38 as the two inside links. As can best be seen in FIG. 4A, carriage C includes a front carriage plate 40 and a rear carriage plate 42, spaced apart from each other. Rollers 34*c* of transfer arm connector 34 ride on tracks 40*a* and 42*a* of the respective carriage plates. At the same time, carriage chain 38 moves the transfer arms along a curved path which will be described in conjunction with FIG. 21. In addition, side rollers 34*d* carried by plate 34*a* roll against the interior sides of carriage plates 40, 42. There are eight transfer arms 20 and each arm includes an upper connector 34 attached to carriage chain 38.

Figure 15:
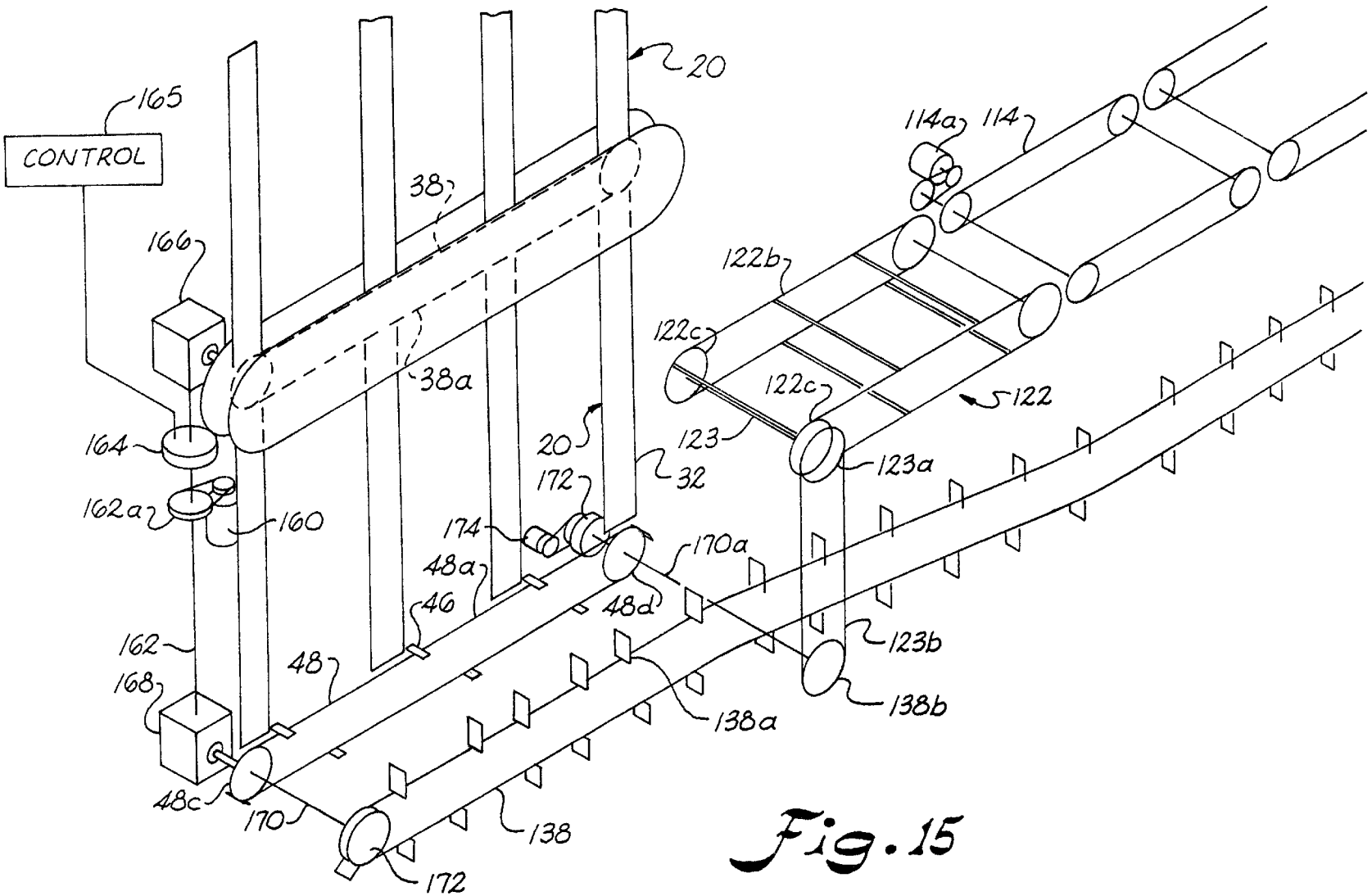
FIG. 15 is a perspective view illustrating a synchronized drive arrangement for a continuous motion case packing apparatus and method according to the invention for synchronizing the drives of a revolving carriage and article transfer arms/pick-up heads, a slug feeder, and a case indexing conveyor so that article pick-up heads, indexed slugs of articles, and indexed cases are delivered in a synchronized manner at the same delivery rate for case packing.

As can best be seen in FIGS. 2A and 3A, carriage chain 38 travels on two sprockets 44 which rotate on journals 44*a* carried on opposite ends of the front and rear carriage plates 40, 42. The drive for sprockets 44 will be explained in conjunction with FIG. 15. Lower transfer arm connector 36 includes a plate 36*a* having a pair of bottom rollers 36*b* (FIG. 5). A pair of horizontal connector plates 36*c* are affixed to plate 36 and are engaged by a bar 46 affixed to a lower transfer arm drive chain 48. Upper and lower chains 38, 48 are driven in the same direction and hold the opposing connector ends of transfer arms 20 in a fixed, vertical position as the chains run parallel and horizontal across the transfer section of the carriage (FIG. 15). In this position, transfer arms 20 will be connected between a lower run 38*a* of carriage chain 38 and an upper run 48*a* of bottom drive chain 48. Both ends of the transfer arm are thus positively conveyed during the pick-up, transfer, and depositing operations. This provides stability and reliability to these operations as the article pick-up heads reciprocate on the transfer arms. Carriage plates 40, 42 may be supported on any suitable frame which includes a pair of vertical standards 50*a*, 50*b* affixed to the carriage plates and bolted to a base or floor surface.

Figure 4B:
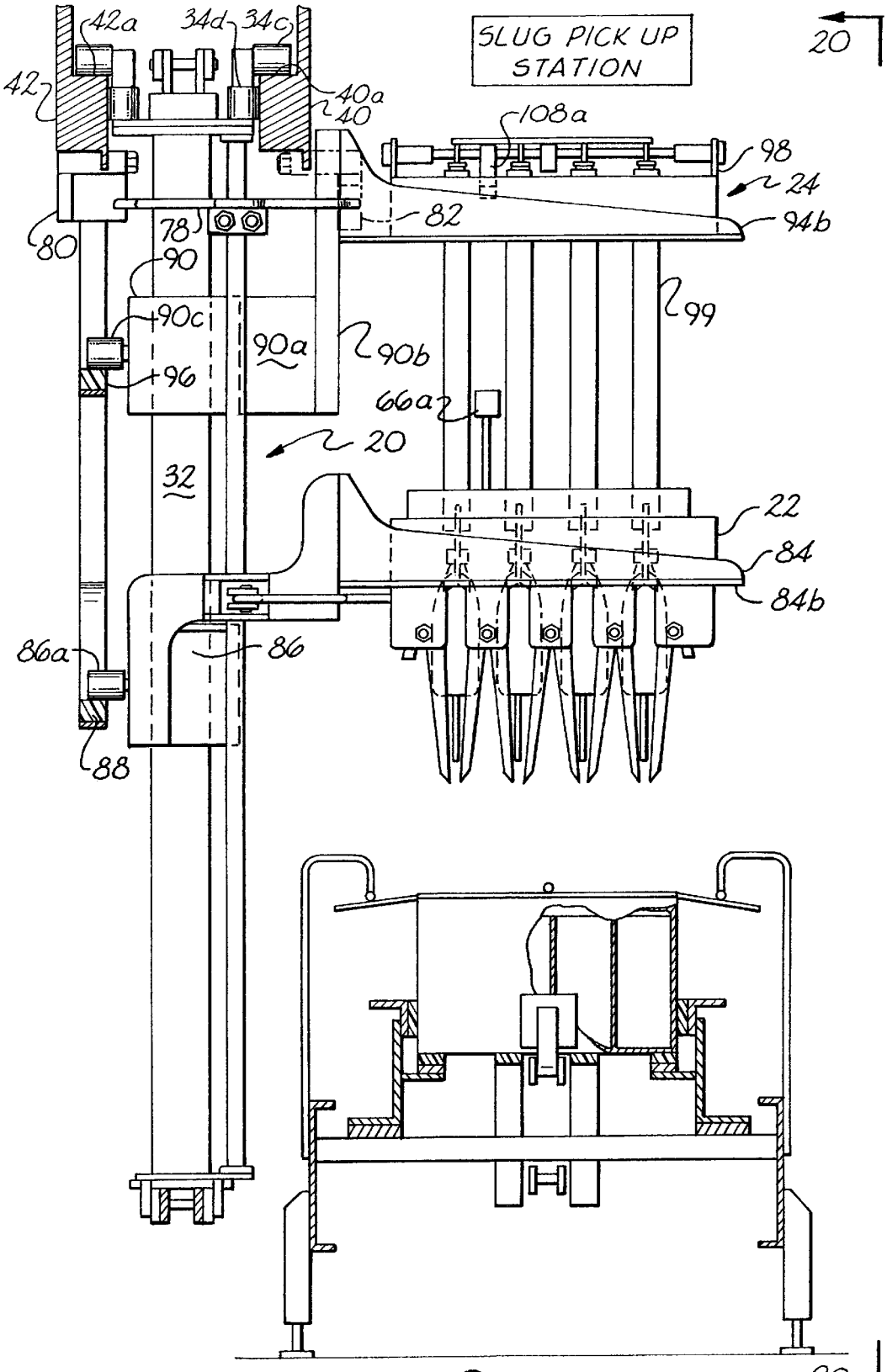
FIG. 4B is a sectional view taken along line 4B—4B of FIG. 3A of a slug pick-up station according to the invention.

Referring now to article pick-up heads 22, 24, it can be seen in FIG. 4B that pick-up head 22 includes a grid head and pick-up head 24 includes a gripper head. While in the preferred embodiment, both heads 22,24 are slidably carried on the transfer arms, it is to be understood that the heads may also be used alone in certain applications.

Figure 10:
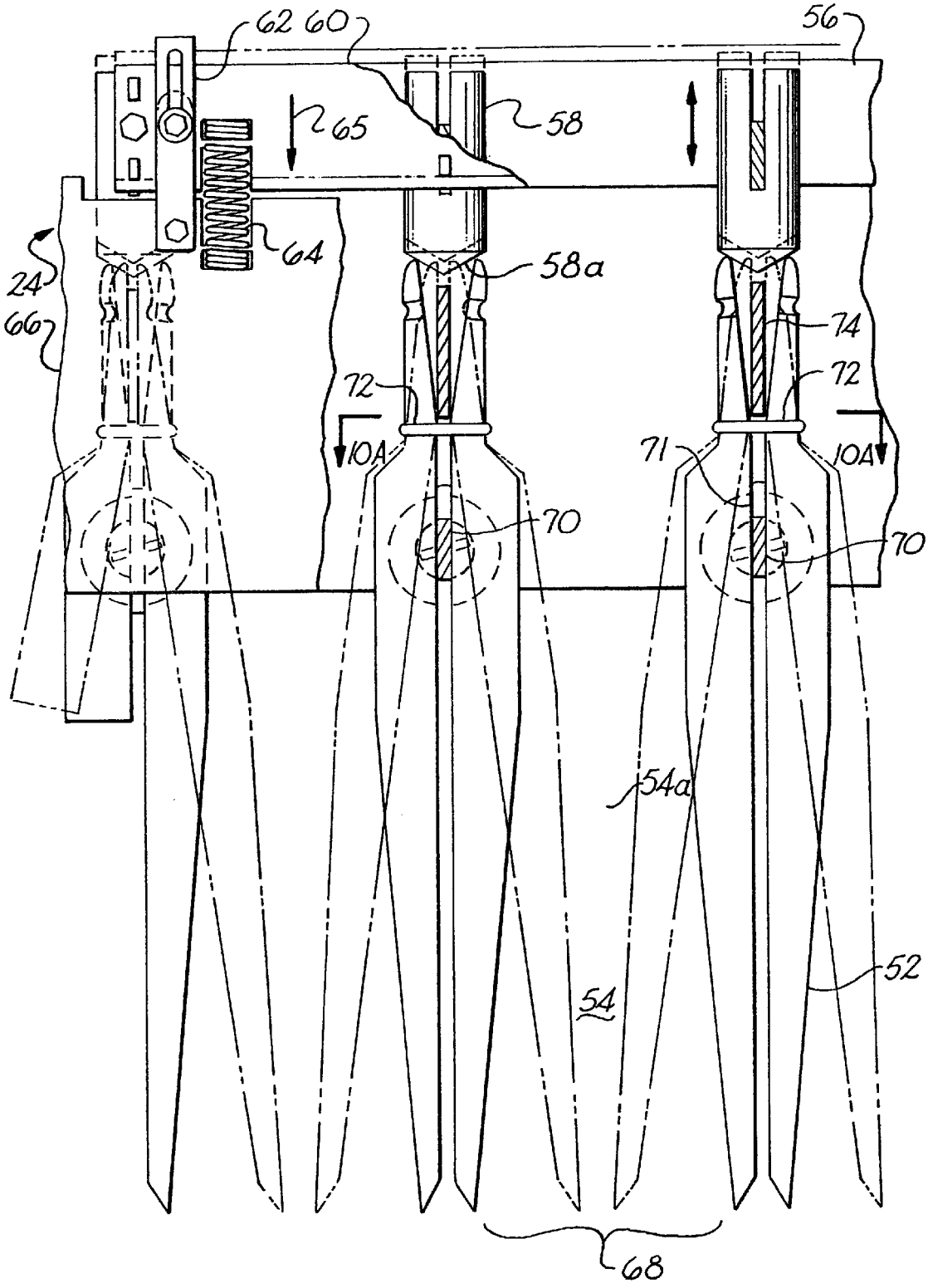
Figure 22:
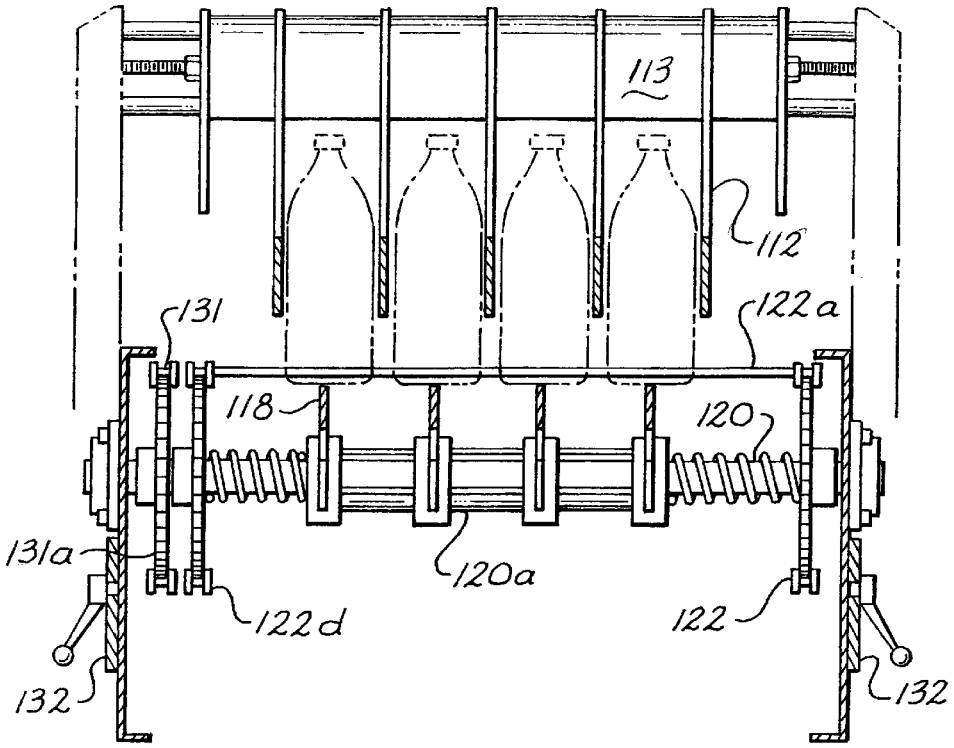
FIG. 22 is a sectional view illustrating an adjustable slug metering section according to the invention.

As can best be seen in FIGS. 5, 8A, 10, and 10A, grid head 22 includes a plurality of grid closing elements in the form of grid fingers 52 which form an array of grid chutes in a matrix corresponding to the three-by-four matrix of articles 13 in slug 15. The grid chutes, formed by four of the grid fingers, are designated generally as 54. It is preferred that there is a corner grid finger in each corner of the chute so that the finger surfaces 52*c* define a generally rectangular chute (FIG. 23). Basically, grid head 22 may be a suitable grid head such as that shown in U.S. Pat. No. 4,215,521, incorporated here by reference, with the below described modifications. It is also to be understood that grid fingers mounted on the sides of the chutes with suitable actuators, as are known in the art, may be used instead of the corner mounted fingers as illustrated. Typically, articles are lowered into such grid sets or heads from the tops of the grid fingers. In accordance with the present invention, the grid head is designed so that grid chutes 54 are open, and held open in a positive manner, so that the open grid chutes may be received over the articles, i.e. the articles enter the grid head from the bottom of the grid. For this purpose, a locking head, designated generally as 56 is provided which includes a plurality of spaced support bars 56*a* having locking elements 58 carried on the bars (FIG. 10). Locking grid 56 includes a rectangular frame 60 by which support bars 56*a* are carried. Frame 60 is affixed to grid head 24 by means of adjustable brackets 62. A compression spring 64 is affixed between frame 60 and a frame 66 of grid head 64. This causes a downward force on frame 60 as shown by arrow 65. This urges an apex portion 58*a* of locking elements 58 into a recess formed by the four upper ends 52*d* of a set of fingers 52 which form adjacent corners of adjacent chutes. This urges each finger inwardly into the corner of the adjacent chutes whereby the four fingers defining each chute are held in a chute open position for fitting over the individual articles in the slug for pick-up (FIG. 23).

In the typical grid set referred to above, a caming arm 70 is provided which opens and closes the fingers, which have perpendicular backsides 52*a*, 52*b*. Caming arms 70 engage a first backside of the fingers and include a cam 71 having converging surfaces 71*a* and 71*b*, which intersect at ninety degrees, to wedge behind a second, intersecting backside of the fingers as described in detail in the above referenced grid set patent. When the caming arm is vertical, the fingers are closed and the chute is open. When the caming arm is rotated ninety degrees or more (past center), the fingers open from their corner positions into and towards a center line 54*a* of chutes 54 to close the chutes. The past center actuation of the finger mechanism provides a positive locking of the fingers in the chute closed position for retaining the articles. Grid fingers 52 pivot about a pivot defined by a retainer ring 72 which also affixes four of the fingers 52 to lateral spacer bars 74 which are spaced across the grid head (FIG. 23), all of which may be more fully seen in the above referenced patent.

Figure 10A:
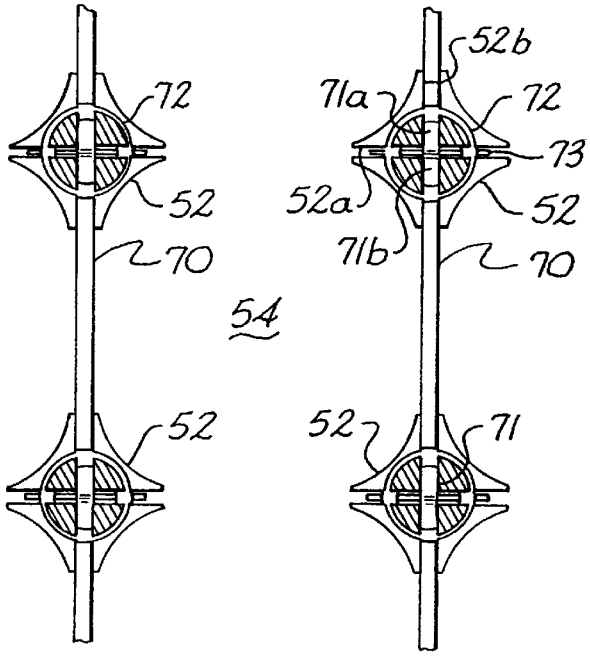
FIG. 10A is a sectional view taken along line 10A—10A of FIG. 10 illustrating a grid chute having four corners formed by fixed corner fingers according to the invention whereby the chute may be maintained open for a reliable fit over a slug.

Each chute corner is formed by two perpendicular, chute forming surfaces so that the corner fingers are maintained truly vertical and correctly positioned for fitting over articles, as can best be seen in FIG. 10A. First, camming bar 70 forms one surface for each finger. Second, there are bracing rings 73, surrounding and perpendicular to the caming bars 70, which form the second surface against which each finger is biased by locking elements 58 in the open chute position. In this position, as can best be seen in FIGS. 8A, 10, and 10A, a lower chute end 68 is provided which is open for receiving articles and which is closed for retaining articles.

Figure 6:
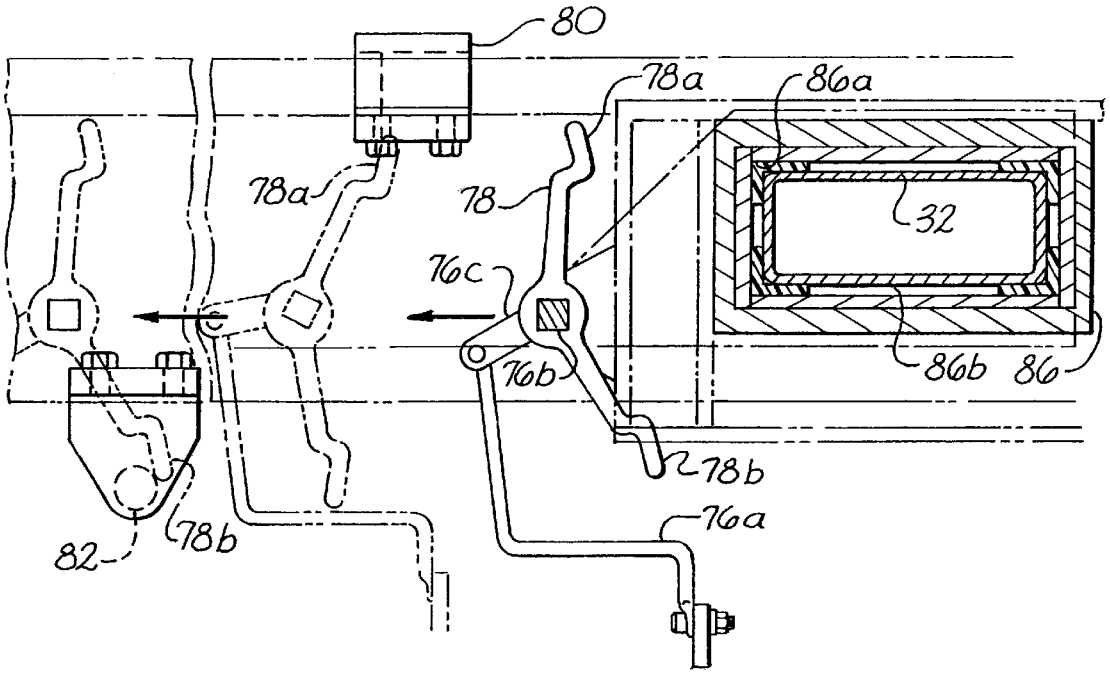
FIG. 6 is a sectional view taken along lines 6—6 of FIG. 5.
Figure 7:
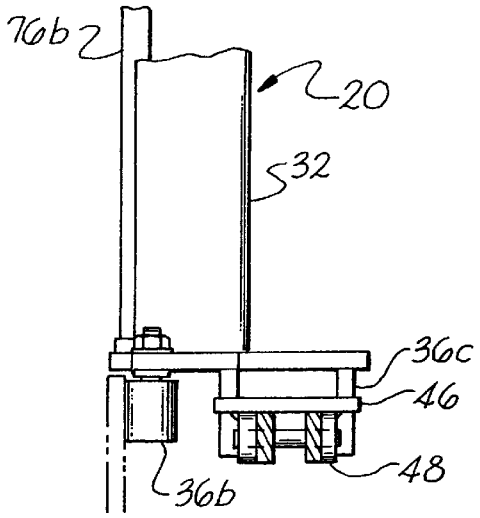
FIG. 7 is a sectional view taken along line 7—7 of FIG. 5.
Figure 9:
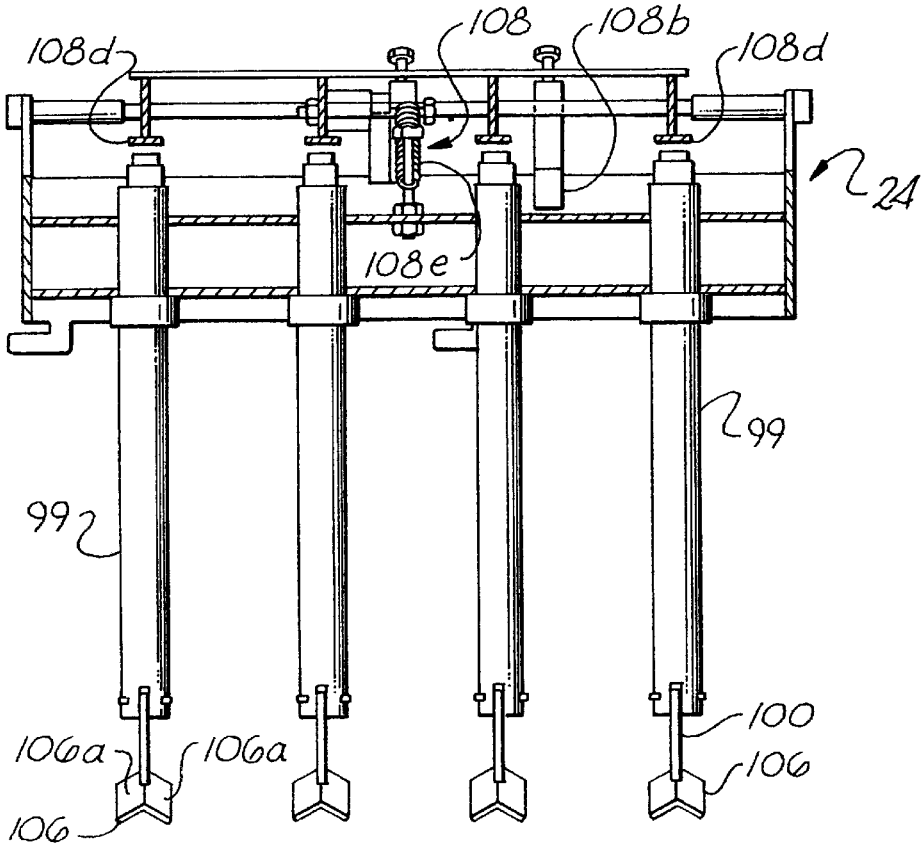
FIG. 9 is a sectional view of gripper tubes having grippers for engaging necks of articles in a continuous motion case packing apparatus and method wherein the articles may be placement packed.

In accordance with the present application, as can best be seen in FIGS. 5 and 6, a grid head actuator is provided for opening and closing the grid elements or fingers 52, which includes caming arms 70 and cams 71, and a linkage bar 76 connected to the caming arms. Linkage bar 76 is connected to an actuator rod 76*a* which in turn is connected to an actuator post 76*b* by a slidable connector 76*c*. Actuator post 76*b* is rotatably jornaled in connector plate 36*a* at a lower end and to connector plate 34*a* at an upper end so that it may swivel and actuate caming arms 70 to open and close grid chutes 54. This actuation takes place in response to a forked actuator 78 being engaged by certain programmed abutments. Forked arm 78 includes a first arm 78*a* and a second arm 78*b*. There is a first chute closing abutment 80 carried in the path of travel of transfer arm 20 and hence actuator arm 78*a*, and a second chute opening abutment 82 spaced downstream in the travel direction for engagement with second arm 78*b*. Both abutments may be adjusted to ensure the correct timing of the actuator in closing and opening of the grid chutes. A backup abutment may be provided for each (FIG. 2C) for redundancy to assure operation. The first abutment 80 is shown adjustably mounted to rear carriage plate 42 and second abutment 82 is shown adjustably affixed to front carriage plate 40. The operation of the grid head and actuator will be described more fully hereinafter.

Referring again to FIG. 5, it can be seen that grid set 22 rests on a rack 84 having a pair of spaced arms 84*a*, 84*b* which are affixed to a bearing block 86, as can best be seen in FIG. 4B. Bearing block 86 includes a cam roller 86*a* which rides on a first cam track 88. Rack arm 84*a* is affixed to an opposite side of bearing block 86. By this means, grid head 22 slides and reciprocates linearly on transfer arm 20 in response to the shape of cam track 88. For this purpose, as can best be seen in FIG. 6, bearing block 86 includes four corner bearings 86*a* affixed within the corners of a hollow interior 86*b* of bearing blocks 86. Transfer arm beam 32 slidably engages the bearings for relative sliding movement there between.

Referring now to gripper head 24, it too is slidably carried on transfer arm beams 32. As can best be seen in FIG. 4B, there is a second bearing block 90 disposed above bearing block 86 which slidably receives beam 32 in a similar construction described above with reference to bearing block 86. A rubber pad 92 is carried by a top perimeter of lower bearing block 86 to cushion the nesting of bearing block 90 on top of bearing block 86. So that the heads may be nested or stacked upon one another along their return path, and at various other stages of operation, rack arms 84*a*,84*b* are offset wide on bearing block 86 to accommodate bearing block 90 nesting within the arms. A horizontal arm 90*a* which is wider than bearing block 90 extends across the front of the bearing block and carries a pair of vertical bars 90*b* which support a back frame 94 which supports rack arms 94*a*, 94*b*. Gripper head 24 sits in rack 94 in direct alignment with grid head 22, as can best be seen in FIGS. 4A–4C. The weights of the gripper head and grid head maintain them in their respective racks. Bearing block 90 includes a cam roller 90*c* which rides on a second cam track 96. Cam tracks 88 and 96 include plastic bushings affixed to the main frame of carriage C by means of aluminum contoured strips having the desired contour of the cam track. The plastic bushings extend part the aluminum retaining strip to engage the cam rollers of the bearing blocks.

Figures 11, 11A:
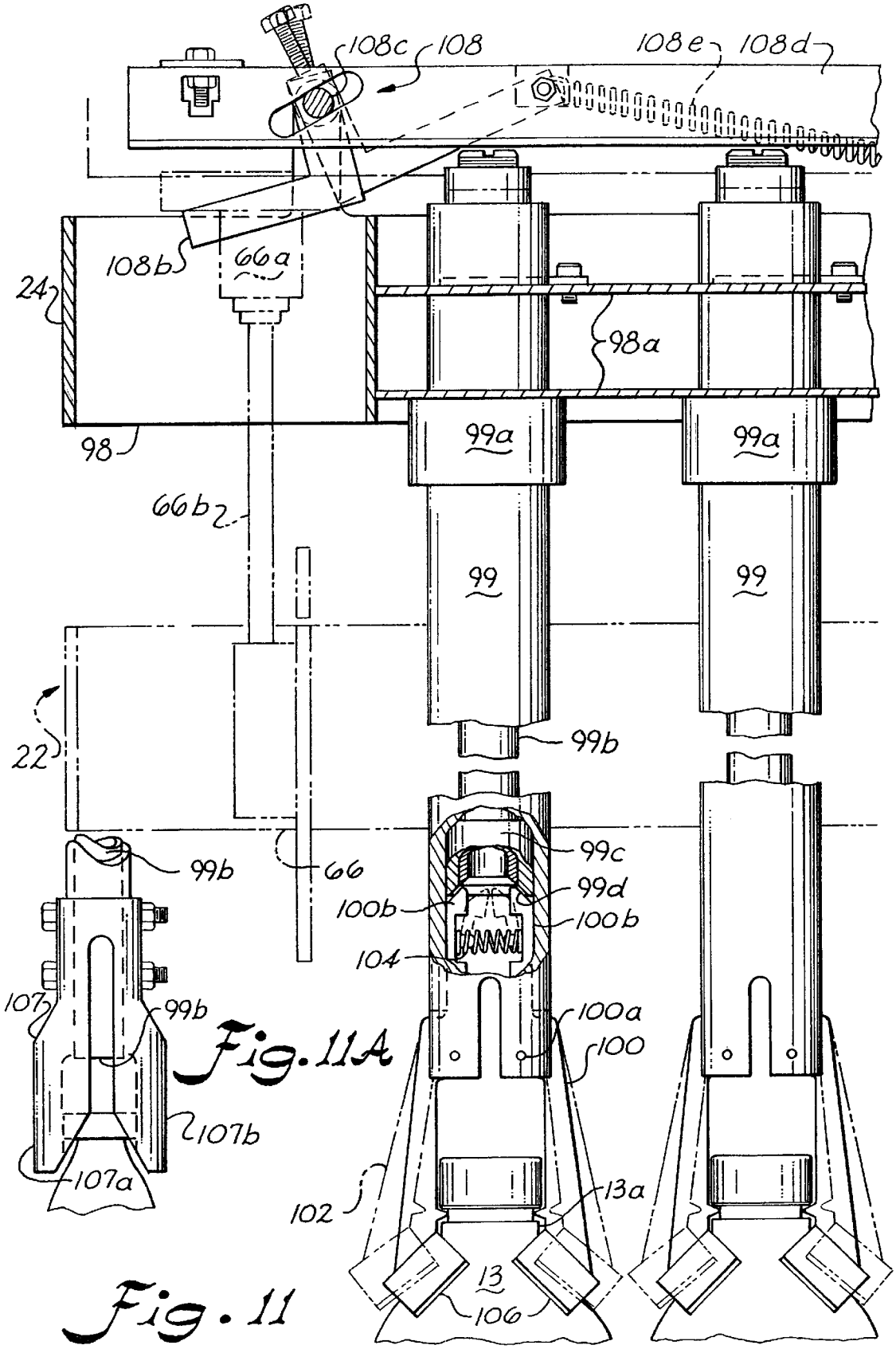
FIG. 11 is an enlarged partial section view illustrating the opening and closing of gripper elements on a gripper tube according to the invention for gripping the necks of articles conveyed on a continuous motion apparatus according to the invention.
FIG. 11A is an elevation illustrating an alternate embodiment for a gripper according to the invention.

Referring now in more detail to gripper head 24, it can be seen that the gripper head includes a frame 98 which holds an array of gripper tubes 99 affixed thereto in a manner that can best be seen in FIG. 11. Basically, gripper tubes 99 include attachment ends 99*a* affixed to frame plates 98*a* as shown. A gripper head actuator includes a reciprocating rod 99*b* carried within gripper tubes 99 is affixed to a beveled follower 99*c* having a downwardly and outwardly beveled edge 99*d*. Gripper elements 100 pivoted at 100*a* include upper arms 100*b* received within gripper tube 99. When actuator rod 99*b* is forced downwardly, beveled camming surface 99*d* forces ends 100*b* of the gripper elements inwardly to spread them apart to an open position shown in dotted lines at 102. When rods 99*b* are not actuated by downward force, a spring 104 urges gripper ends 100*b* away from each other with a sufficient force to lock opposing gripper jaws 106 about a neck 13*a* of article 13. Winged jaws 106 also provide a centering device for centering the articles in grid chutes 54 as will become apparent. It is noted that winged jaws 106 include a pair of downwardly and outwardly diverging wings 106*a* (FIG. 4A). A gripper actuator mechanism, designated generally as 108 includes a pivotal arm 108*b* which pivots about a pivot 108*c*. A fixed abutment 66*a* is shown attached to the frame 66 of grid head 22. Abutment 66*a* is affixed to a post 66*b* whose lower portion is attached to frame 66. When grid head 22 and gripper head 24 are in a nested, proximity position shown in dotted lines in FIG. 11, abutment 66*a* urges actuator arm 108*a* to the horizontal dotted line position shown. This forces an actuator bar 108*d* downwardly to engage the upper ends of actuator rods 99*d* there to move actuator head 99*c* downwardly to pinch ends 100, 100*b* inwardly to open the grippers. Thus, the gripper jaws are open when the grid head and gripper head are in the proximity position shown in FIG. 11. However, when the grid head and gripper head move apart so that abutment 66*a* comes off actuator arm 108*b*, arm 108*b* pivots to the full line position under the force of a spring 108*e* to return actuator bar 109*d* to the full line position whereupon spring 104 pushes ends 100*b* apart to close gripper jaws 106. The article pick-up and case packing operation of the gripper tube head will be described more fully below.

FIG. 11A illustrates another embodiment for a gripper element may be had which includes a resilient gripper element 107 constructed from a polymeric material, or synthetic or natural rubber. The gripper element includes resilient jaws 107*a* and 107*b* having interior ledges 107*c* which grip underneath the article head and around the neck as shown. It is not necessary to open the jaws to receive the article, and to release the article only requires downward actuation of actuator rod 99*b*. While the head 24 is referred to as a "gripper" head and the gripper elements have been illustrated as mechanical and resilient gripper jaws, it is to be understood, of course, that any element which attaches to the articles such as suction, or otherwise, may be used on the ends of tubes 99.

FIGS. 11B–11E illustrate another alternate embodiment for a gripper head 24' and grid finger head 22'. In this embodiment, it is not necessary to provide a separate positive actuator for opening and closing the grid fingers 52. Instead, the gripper element includes a profiled body which engages the fingers to move the fingers away from the center of the grid chute to the corners of the chutes, as done previously in the operation of grid head 22. Referring now in more detail to alternate embodiment, as can best be seen in FIGS. 11B–11E, gripper head frame 98 and actuator mechanism, designated generally as 108, are the same as disclosed previously. In the alternate embodiment, there is a gripper actuator tube 109*a* which moves through a gripper tube 109*b* when the actuator tube is engaged and moved downwardly by actuator bar 108*d*. When gripper tube 109*a* is moved downwardly, a roll pin 109*c* compresses a spring 109*d* which is seated on a seated 109*n* machined in the interior of gripper head tube 109*b*. As can best be seen in FIG. 11C, when actuator bar 108*d* is depressed pushing gripper tube 109*a* downwardly, a gripper finger actuator 109*e* is also pushed downward causing a surface 109*m* to engage finger abutments 109*l* and move a pair of gripper fingers 109*f* apart. In this position, the gripper fingers are spread apart so that a bottle can be accessed for gripping, or released. It is noted that spring 109*d* is compressed so that when actuator bar 108*d* is raised back up, actuator tube 109*a* also moves upwardly under the force of the compressed spring against roll pin 109*c*. As actuator tube 109*a* moves upward under the force of the spring, gripper finger actuator 109*e* is also raised upwardly causing gripper fingers 109*f* to close around the neck of the bottle due to engagement of finger abutments 109J with a tapering surface 109L formed on gripper actuator 109*e*. As the gripper ends 109*k* of the gripper fingers move inwardly, they engage underneath a ridge which protrudes outwardly from the neck of the bottle. The force of the spring urging gripper tube 109*a* upwardly cams gripper ends 109*k* tightly against the neck of the bottle underneath the ridge. The bottles or other articles are positively gripped until actuator tube 109*a* is again forced downwardly by actuator bar 108*d* at the case packing station where it is desired to release the bottles. The tapering of surface 109L facilitates the gripping of different diameter bottle necks which can vary during packing operations. For example, if the diameter of the bottle neck were smaller than that illustrated in FIG. 11B, actuator tube 109*a* would move further upwards causing gripper ends 109*k* to move continuously further inwardly to grip the smaller diameter bottle neck.

Figures 11B, 11C, 11D, 11E:
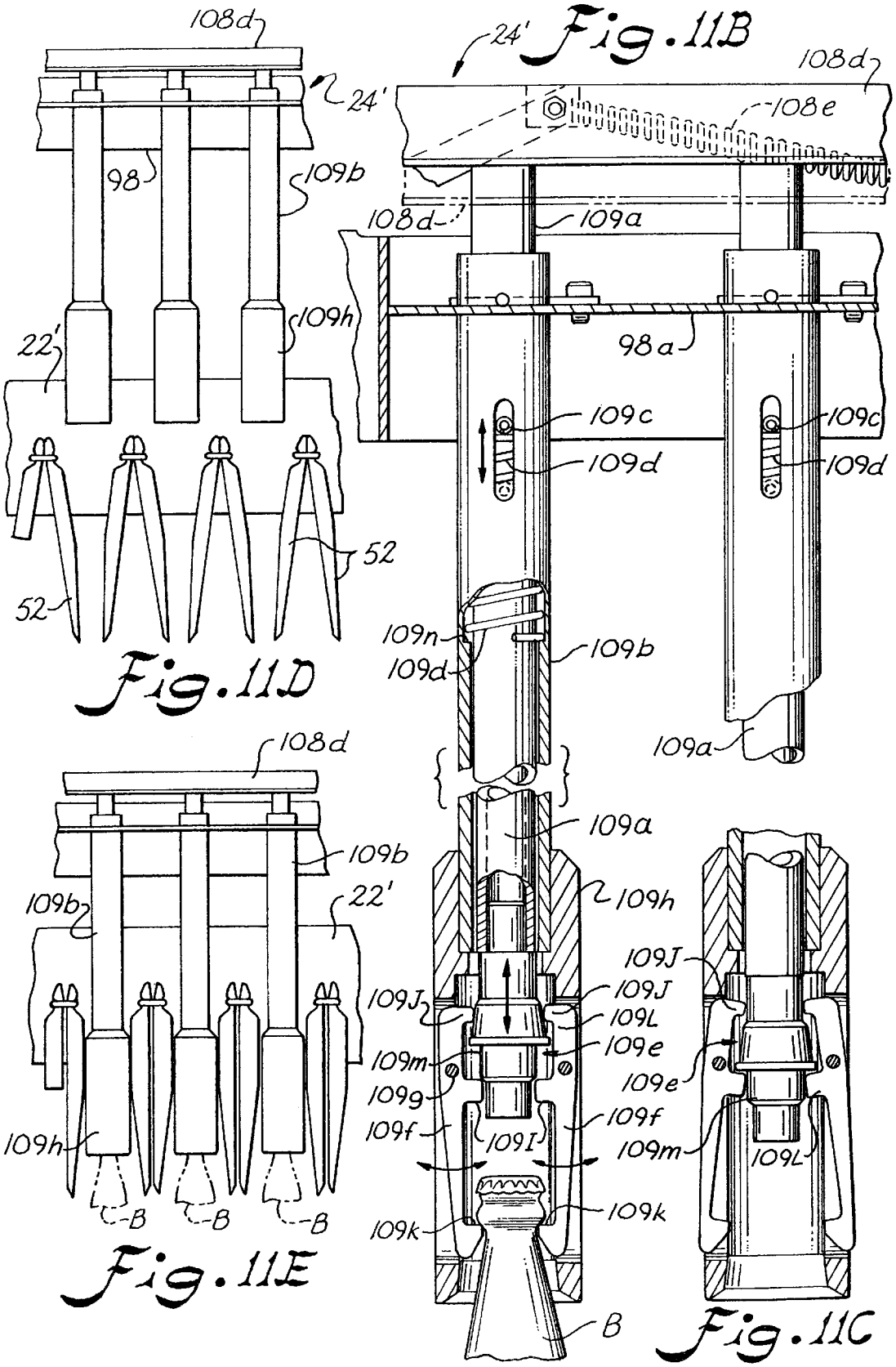
FIGS. 11B–11E illustrate another alternate embodiment for a gripper head according to the invention.

In the alternate embodiment of FIGS. 11B and 11C, it is noted that the gripper elements include a profiled body 109*h*. This profiled body engages the grid fingers 52 of modified grid head 22', as can best be seen in FIGS. 11D and 11E. In this instance, it is no longer necessary to provide an actuator mechanism for moving the grid fingers to an open position for receiving the bottles and a closed position after receiving the bottles, as described in the previous embodiments. Instead, profiled body 109*h* engages the fingers on the downward decent of the gripper head through the grid head. The profiled bodies 109*h* move the fingers into their corner positions to allow gripping of the bottle necks, described in the previous paragraph. Upon gripping of the bottle necks, and raising of the gripper head, the articles are pulled through the grid fingers whereupon the grid fingers are allowed to close beneath the bottles under a spring force, as is typically used. For this purpose, the spring return grid head shown in U.S. Pat. No. 4,215,521 may be utilized without the need of forked actuator 78 (FIG. 5). For this purpose, it will be noted that the profiled body of the gripper element has a diameter generally equal to the diameter of the base of the bottle which is being gripped and passed through the grid fingers. To accommodate different bottle diameters, the profiled body of the gripper elements may be replaced likewise. In this manner, as the gripper elements extend down into the grid fingers, and as the gripper fingers approach the ends of the grid fingers, the grid fingers, and grid chutes defined thereby, are fully opened to the equivalent diameter of the bottles. Accordingly, after the bottles are gripped and pulled upwards through the grid fingers, the profiled bodies hold the grid fingers open until the bottles have passed well up into the fingers. The bottles are held above the pivot point of the grid fingers in the grid head. The same opening of the grid chutes occurs as the gripper tubes descend at the case packing station for slug release. The bottles and then the profiled bodies push the fingers into the corners of the grid chutes and box partitions at the case packing station.

Figure 8A:
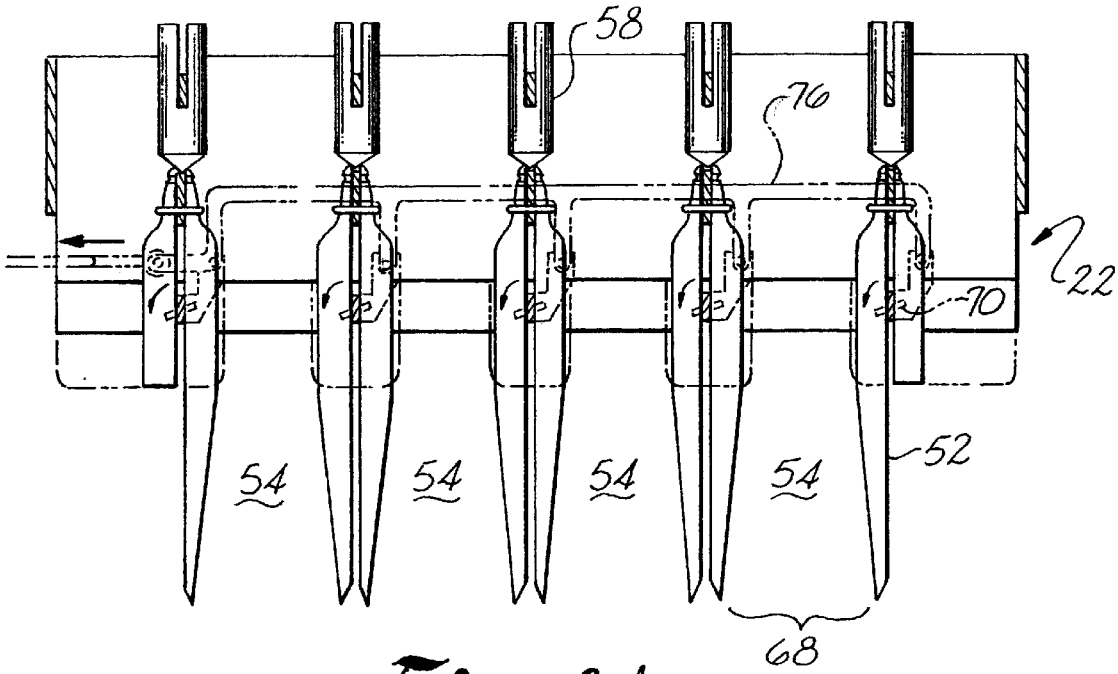
FIG. 8A is a sectional view of the grid head of FIG. 5 illustrating open grid chutes according to the invention for being place over the tops of articles contained in a slug.
Figure 8B:
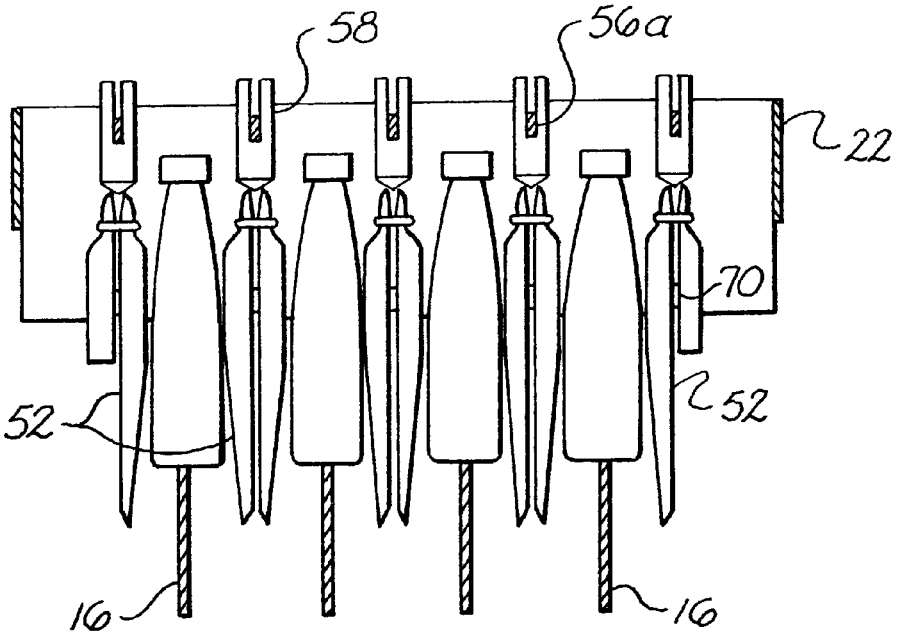
FIG. 8B is a sectional view taken across a slug pick-up station according to the invention wherein open grid chutes are received over the articles contained in the slug.
Figure 8C:
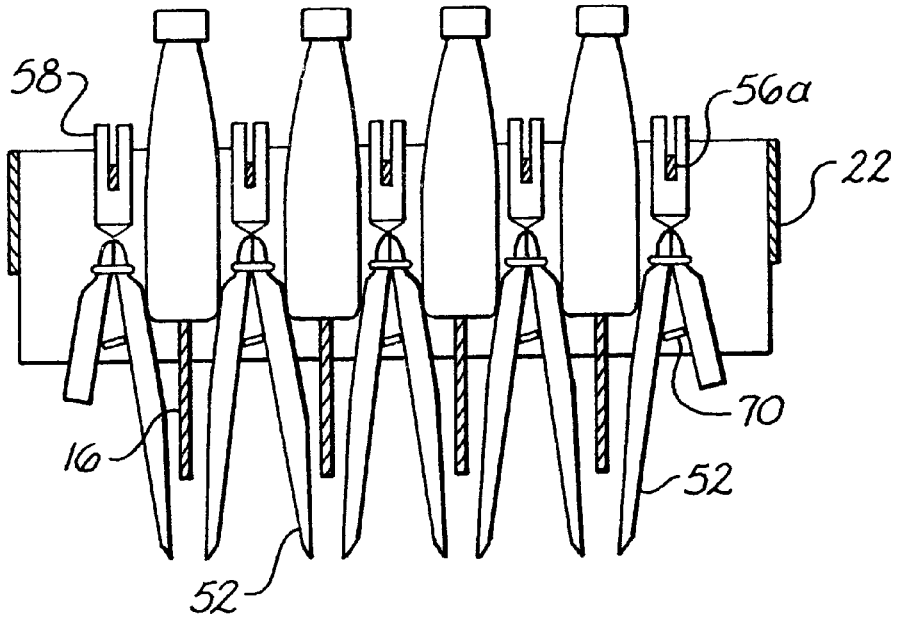
FIG. 8C is a sectional view taken across the slug pick-up station of FIG. 8B wherein the grid chutes of the grid head are closed to retain the articles in the grid chutes for transfer to a case packing station.

In the embodiment of FIGS. 11B–11E, the need to support the bottles on cantilevered knife blades 133 at pick-up station 16 is eliminated because it is no longer necessary for the grid fingers to descend so far past the bottom of the bottles during slug pick up. The ends of the grid fingers do not need to pass between the blades in order to descend past the lower ends of the bottles during pick-up as in FIGS. 4B and 8C. In the embodiment of FIGS. 11B–11E the profiled body urges the grid fingers to the corner position wherein the chutes are open. The necks or tops of the bottles are gripper elements and pulled through the lower open ends of the open grid chutes as the gripper head ascends, with or without relative vertical movement of the grid head. In the relative movements, it is preferred that the gripper head pull the articles through the open grid chutes and that lowering of the grid head is minimized. This reduces the amount of vertical movement of the grid and gripper heads during the pick up operation, which can be controlled by modifying the cam tracks 88 and/or 96.

Slug Feeder

Figure 2B:
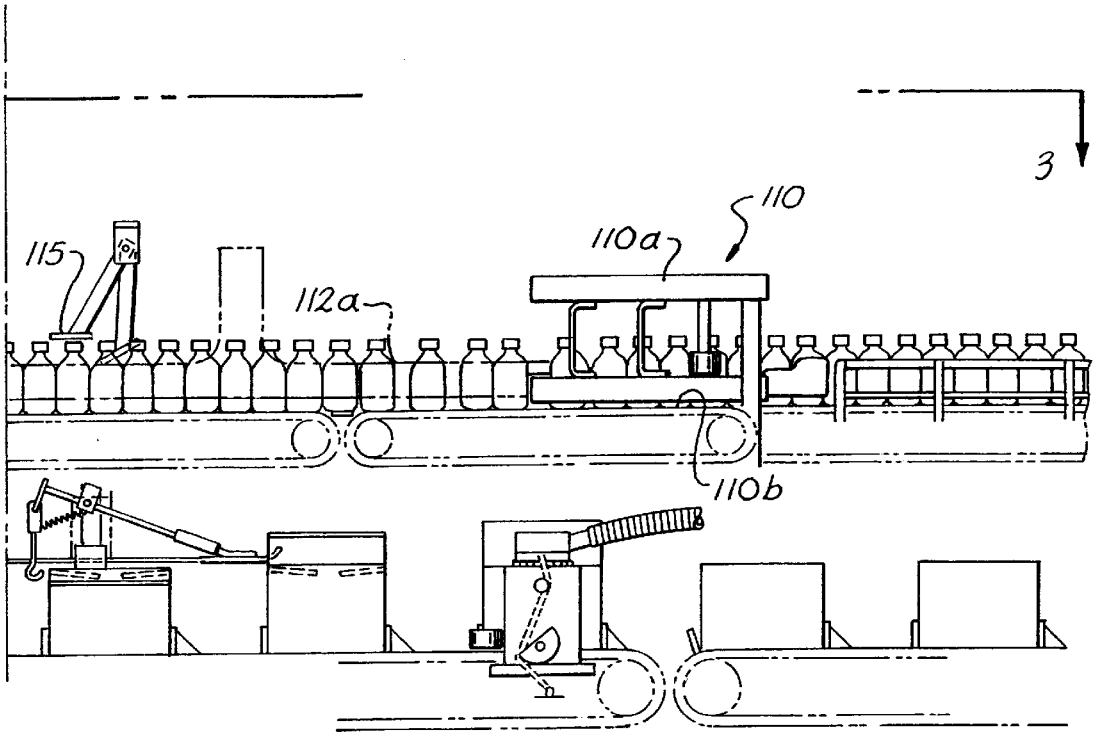
FIG. 2B is a side elevation of an infeed end of a continuous motion case packing apparatus and method according to the invention illustrating a laner for feeding articles into longitudinal lanes formed by side rails wherein the laner is disposed above a lower case indexing conveyor and flap opening station.
Figure 2C:
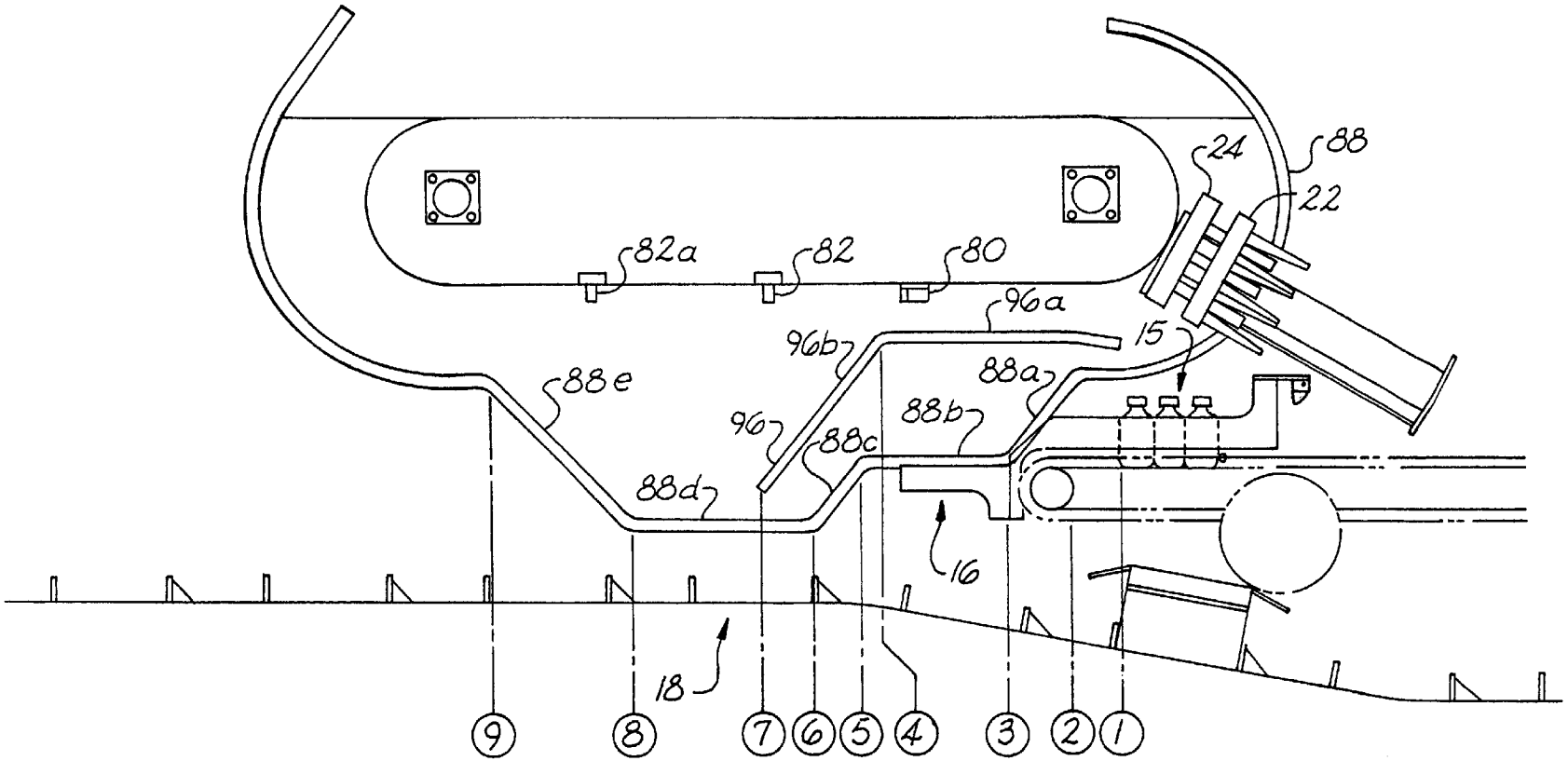
FIG. 2C is a schematic elevation illustrating a continuous motion case packing apparatus and method according to the invention illustrating the relative positions of an article transfer arm having gripper and grid heads, a slug of articles, and indexed case prior to article pick-up.
Figure 2D:
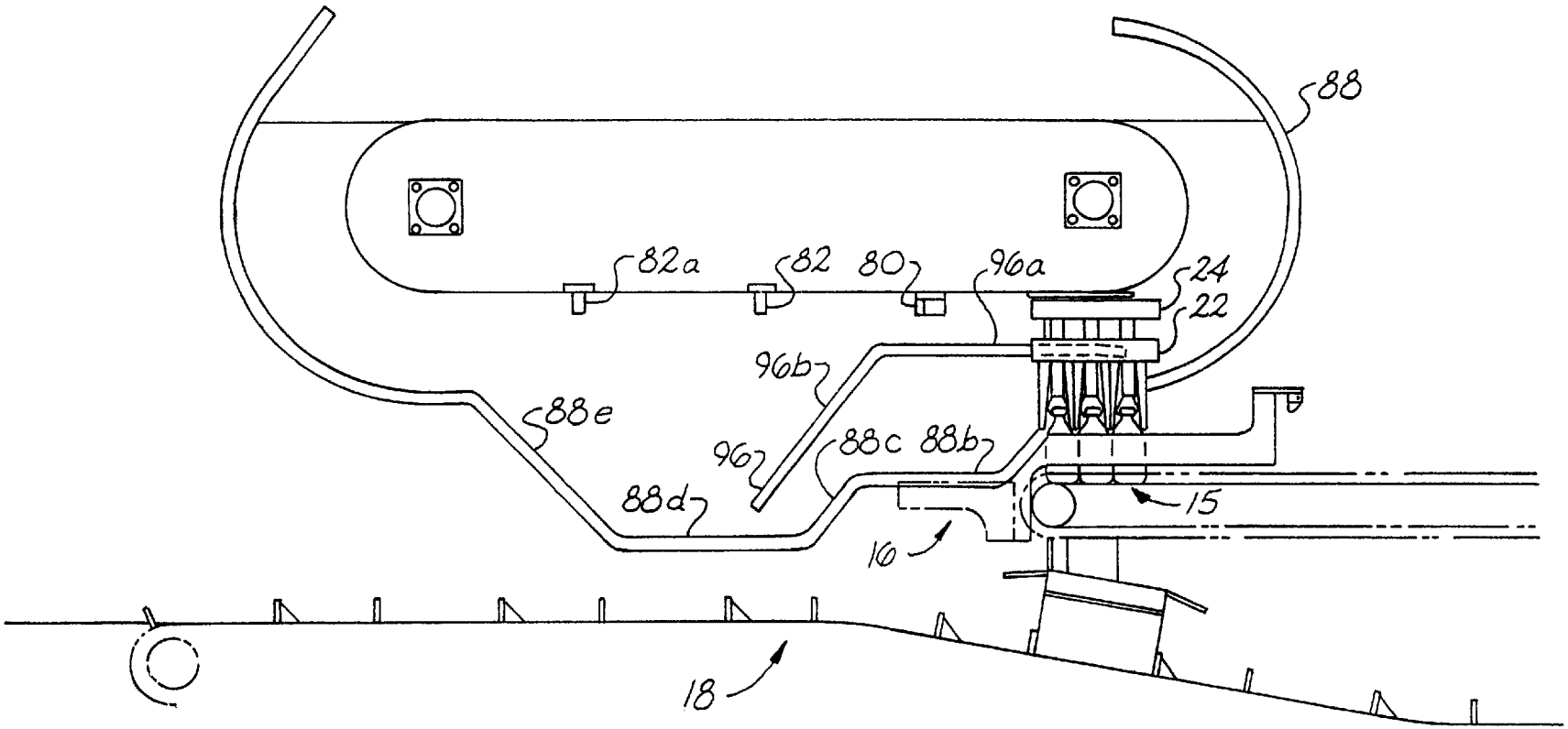
FIG. 2D is a schematic elevation illustrating a continuous motion case packing apparatus and method according to the invention illustrating the relative positions of an article transfer arm having gripper and grid heads, a slug of articles, and indexed case prior to article pick-up.
Figure 12:
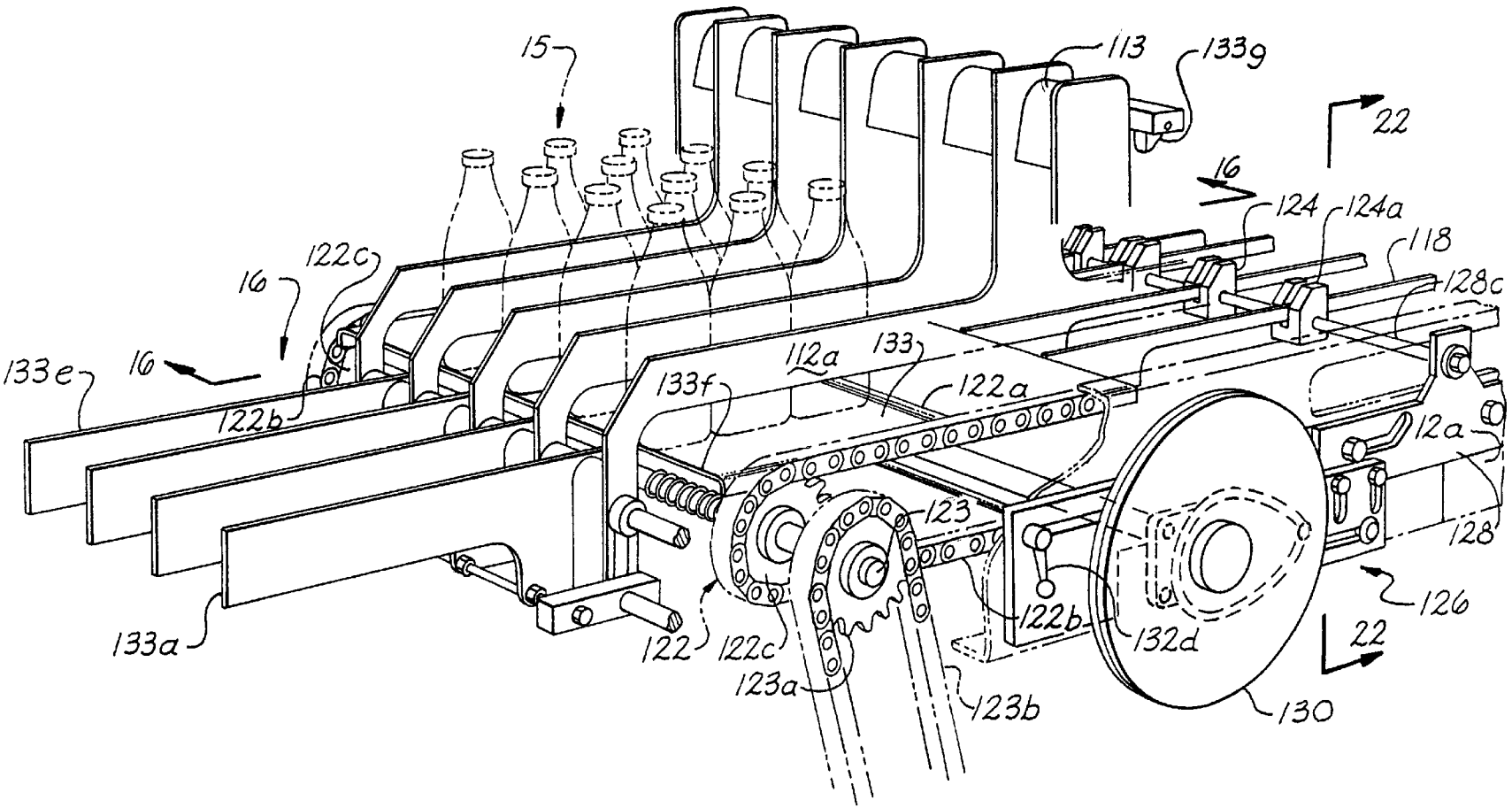
FIG. 12 is a perspective view of a slug feeder and a slug pick-up station according to the invention for use with a continuous motion case packing apparatus and method in accordance with the invention.

Slug feeder B will now be described referring to FIGS. 12, 13A–13D, 14A–14D, and 16–18. First, it will be noted that a laner assembly 110 counts the articles and directs them to a longitudinal rows 30 in order to keep the rows filled (FIGS. 2B and 3B). Any suitable laner assembly may be utilized such as that disclosed in U.S. Pat. No. 4,723,649, incorporated by reference herein. Typically, a laner includes a pivoting guide chute 110*a* which swings back and forth across a conveyor to discharge a predetermined number of articles into parallel lanes in which the longitudinal rows or articles are formed. Articles may be fed to the pivoting chute either in single file, or scrambled. As pivoting chute 110*a* moves back and forth, the articles are conveyed through the chute into the lanes by an infeed conveyor 110*b*. The lanes are defined by spaced side rails 112*a*–112*e*. In the illustrated embodiment, there are five such side rails to define four lanes since the exemplary slug is three-by-four. However, it is to be understood that any number of lanes may be utilized in conventional packers depending on the application being made. At least one lane is needed such as in the packing of large, round containers of beverages and food. The spaced side rails extend through the slug feed conveyor 10 and the slug metering section 12, as can best be seen in FIG. 3A. The lateral spacing between the side rails may be adjusted so that the number and width of the lanes may be adjusted. This may be done in a conventional manner by suspending the side rails from above on transverse bars spaced above the conveyors wherein removable spacers 113 are fitted over the bars to space the side rails to provide the desired spacing (FIG. 12).

In accordance with the invention, a variable speed conveyor 114 is utilized in slug conveyor section 10. Any conventional conveyor belting may be utilized driven in an endless manner. A counter finger 115 may be provided for each lane to count the number of articles in the lane. In the event that an article is not counted, the laner may be directed to direct an additional article to that lane where the article is missing.

Referring now to slug metering section 12, slug conveyor 114 terminates at the slug metering section (FIG. 3A) and feeds articles to the slug metering section over a transition plate 116 (FIG. 2A). The articles then move over a support floor defined by a plurality of adjustable bottom skids 118 which are centered in the lanes. As can best be seen in FIGS. 17 and 18, the bottom skids are adjustable so that they may be made to correspond to the side rail spacing when adjusted. For this purpose, an adjustable skid mechanism includes transverse rods 120 (a drive shaft to be described later) which are provided removable spacer blocks 120*a* are fitted between adjacent bottom skids 118. The skids may be spring loaded to force them inwardly against the spacer blocks.

Slug metering section B includes a revolving flight bar mechanism 122 which provides a revolving abutment in the form of flight bars 122*a* for separating the continuous stream of articles into discrete slugs. It will be noted that flight bars 122*a* are spaced at an interval "L" apart. The flight bars revolve upwards to divide the articles, and engage the last article 13*c* in a slug for conveying the slug of articles forward through the metering section (FIG. 14D). The flight bars are carried on an endless chain 122*b* driven by a drive sprocket 122*c* and various other idler sprockets 122*d*. Drive sprocket 122*c* is driven by a shaft 123 which in turn is driven by a drive sprocket 123*a*. Drive sprocket 123*a* is driven by a drive chain 123*b* in synchronism with the transfer arms 20 and index case conveyor chain 138, to be described in conjunction with FIG. 15.

Figure 16:
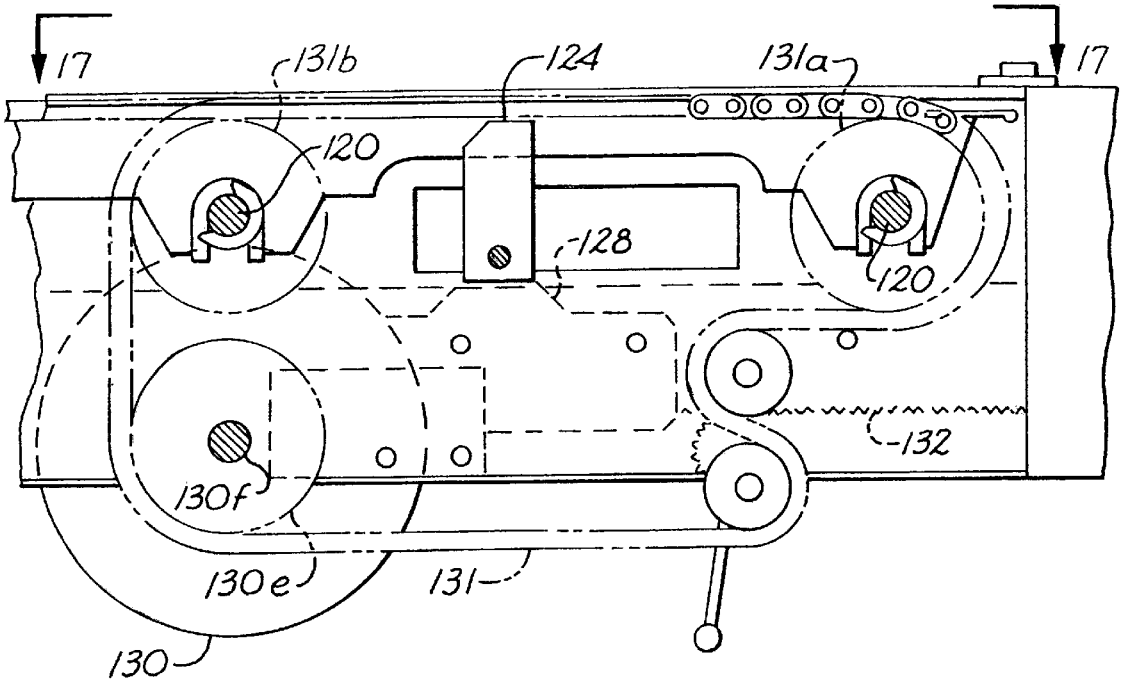
FIG. 16 is a sectional view taken along line 16—16 of FIG. 12.
Figure 17:
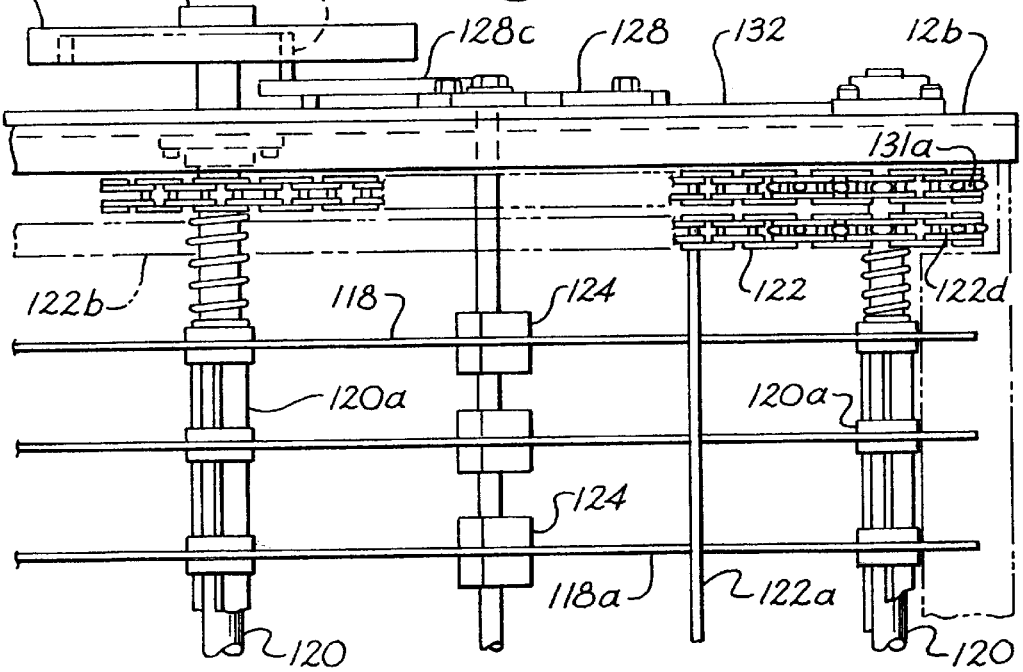
FIG. 17 is a sectional view taken along line 17—17 of FIG. 16.
Figure 18:
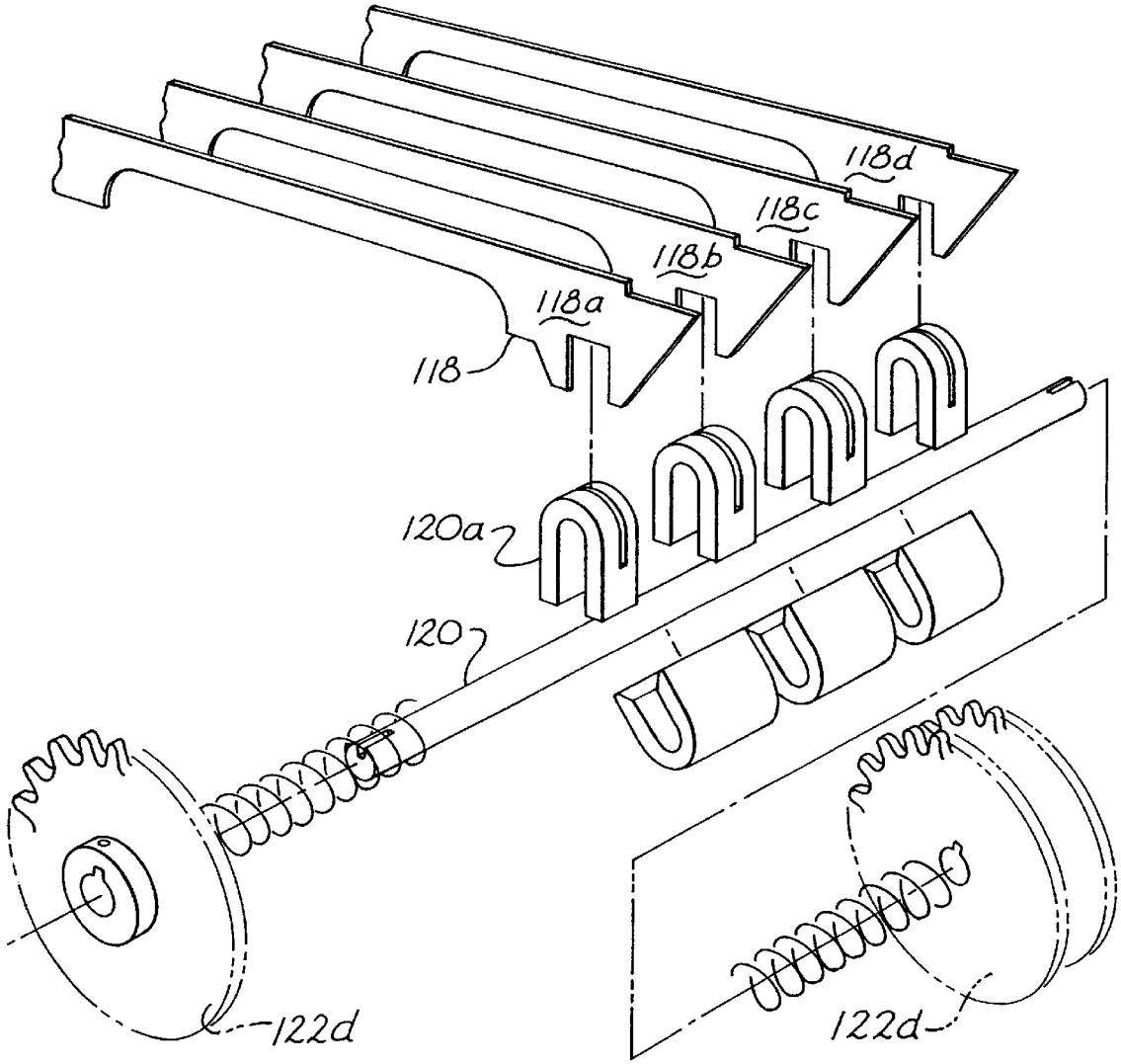
FIG. 18 is a perspective view illustrating adjustable lanes and bottom support skids for a slug metering section according to the invention in order to adjust the widths and number of lanes in a slug feeder.
Figure 19:
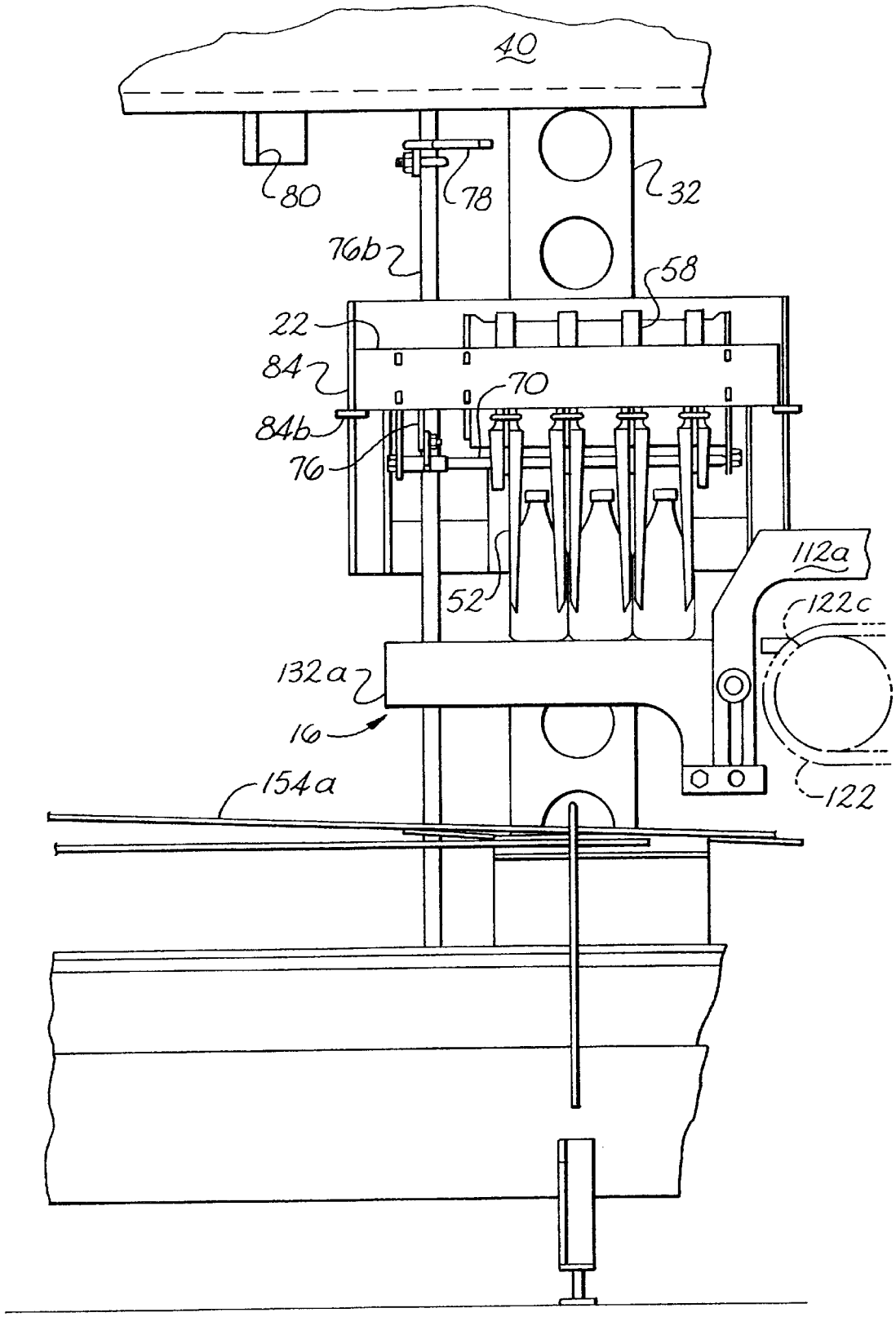
FIG. 19 is a view taken along line 19—19 of FIG. 4A illustrating a continuous motion case packing apparatus and method according to the invention wherein only a reciprocating grid set, shown in a chute open position, is used on an article transfer arm as a drop packer according to the invention.
Figure 20:
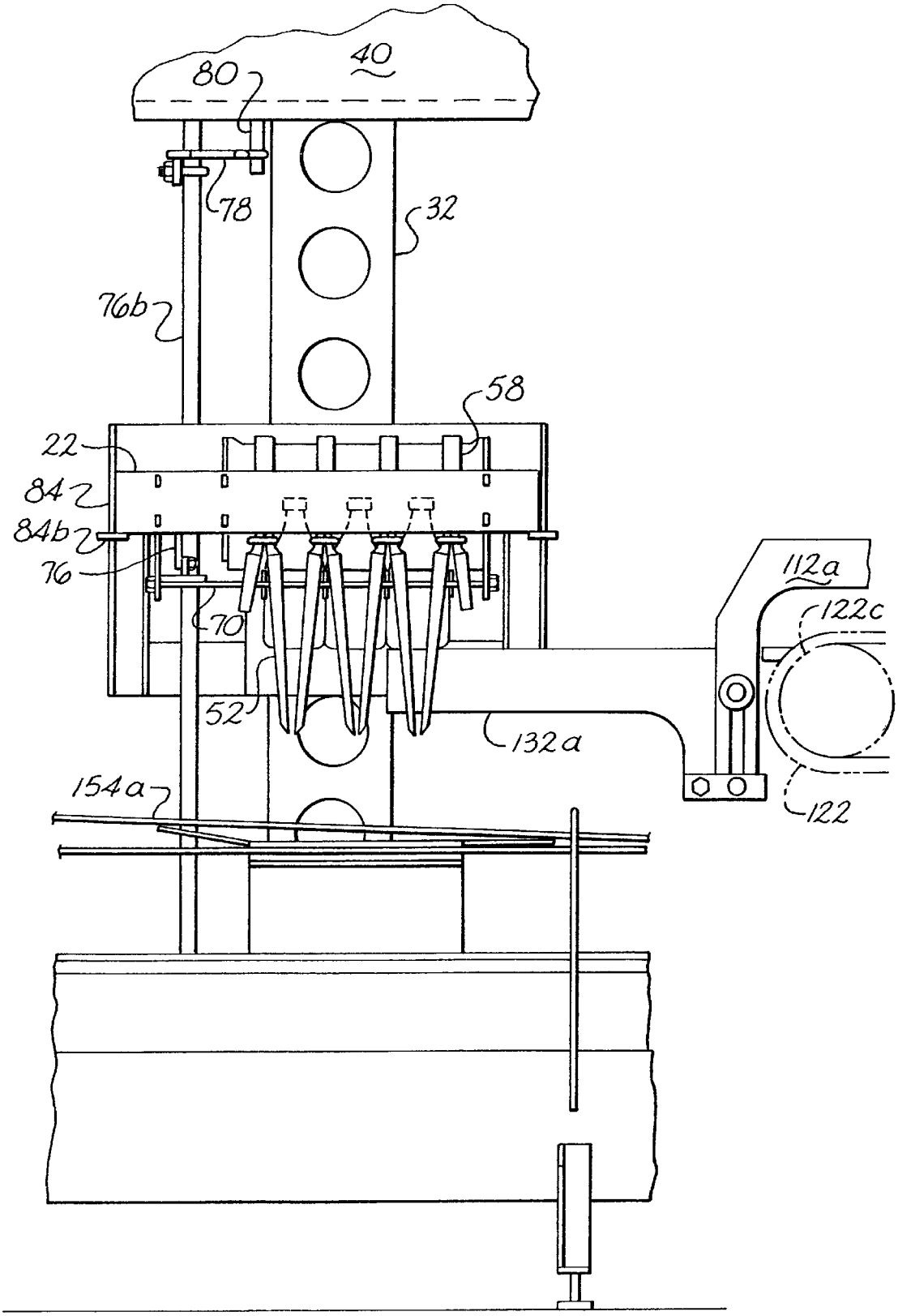
FIG. 20 is a view taken along line 20—20 of FIG. 4B illustrating a continuous motion case packing apparatus and method according to the invention wherein only a reciprocating grid set, shown in a chute closed position for article pick-up, is used on an article transfer arm as a drop packer according to the invention.
Figure 21:
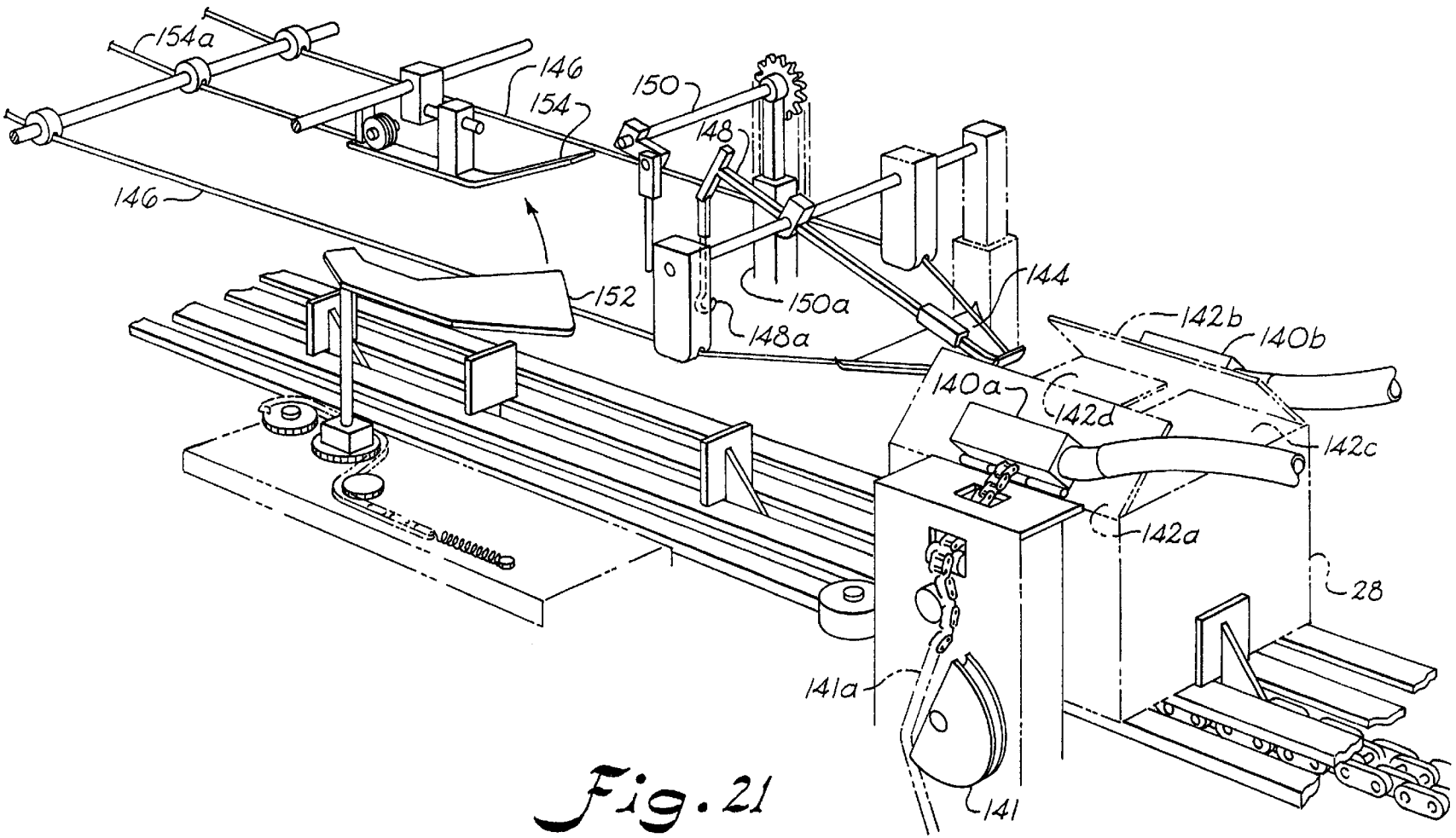

As can best be seen in FIGS. 13A–13D, slug metering section B further includes an adjustable slug metering mechanism which includes a metering block 124 disposed in centrally in each lane which moves in and out of the conveyance path of the articles in a cyclic manner to meter the number of articles in the slug. A metering distance d1, defined between metering block 124 and flight bar 122*a*, determines the number of articles in the row and the size of the slug (FIG. 14D). There is a drive mechanism 126 for driving slug metering block 124 in cyclic movements in and out of the conveyance path independent of the revolving flight bar mechanism. Drive mechanism 126 includes a cam plate 128 having a pair of drive cam slots 128*a* and cam pins 128*b*. There is a drive rod 128*c* (FIG. 12) carried by cam plate 128 on which metering blocks 124 are carried. The metering blocks include a slot 124*a* which receives bottom skids 118 so that the metering blocks reciprocate in and out of the conveyance paths of articles supported on the skids centered in the lane (FIG. 12). Cam plate 128 is affixed to a drive plate 128*c* by means of two bolts 128*d*. Drive plate 128*c* includes a drive slot 128*e* which slides on at least one drive pin 128*f*. Finally, the drive mechanism gets its reciprocating drive from a timing cam wheel 130 having a timing cam slot 130*a* formed in the wheel. Referring to FIG. 16, it can be seen that timing cam 130 is driven off of the same drive which drives flight bar chain 122*b* by means of a drive chain 131 connected to a drive sprocket 131*a*, idler sprocket 131*b*, and timing cam drive sprocket 130*e* affixed to drive shaft 120 which is also affixed to timing cam shaft 130*f*. Drive sprocket 131*a* is driven off of shaft 120 to which driven sprocket 122*d* of the revolving flight bar mechanism is attached.

In an advantageous embodiment of the invention, the drive mechanism just described for metering blocks 124 is mounted on a movable carrier plate 132 which includes a gear rack 132*a* which meshes with a gear 132*b* that is rotatable by a handle 132*c*. Carrier plate 132 may be affixed to each side frame 12*a* and 12*b* of the slug metering section by spaced lock bolts with handles 132*d* extending through adjustment slots 132*e*. By loosening lock bolts 132*d*, the carrier plate may be shifted left and right to vary the distance d1 between the metering block and the flight bars. In this manner, the size of the slug may be advantageously varied, or the metering section may be adjusted to handle different sized articles regardless of the slug size. This is a highly important advantage of the adjustable metering mechanism and slug metering section of the present invention. Previously, the changeover of slug size or container size required much time and effort in changing out the drive chain and other parts of the metering section to which divider fingers were fixed. When the distance d1 between the metering block and flight bar is changed, the timing cam 130 must also be adjusted in its relative position to timing cam drive shaft 130*f*. For this purpose, timing cam 130 is mounted on drive shaft 130*f* by an adjustable coupling, designated generally as 129, between the timing cam wheel and the shaft, as can best be seen in FIG. 24. The timing cam wheel may be manually turned so that the relative positions of the timing cam slot 130*a* and a follower pin 130*d* may be adjusted and the timing of the metering blocks and their cyclic motion is correct for the new distance d1. It is noted that follower pin 130*d* is affixed to drive plate 128*c* and received in camming slot 130*a*. As illustrated, adjustable coupling 129 includes a female spline 129*a* formed in an end of shaft 130*f*, and a male spline 129*b* formed on the end of a stub shaft affixed to timing cam 130. There is an enlarged bore 129*c* formed in shaft 123 behind female splines 129*a* that receives the male splines 129*b* as a threaded rod 129*d* is threaded into a threaded hole 129*e* by manual rotation of knob 130*b*. In this condition, the timing cam 130 may be rotated relative to shaft 130*f* to vary their relative positions. This sets the timing cam in the correct position for the new metering distance d1 and slug size. This can be done by visually setting the cam wheel at the same position relative to pin 130*d* or using indexing indicia when provided as illustrated. The threaded rod is then backed off bringing the male and female splines back into driving engagement with each other.

Thus, it can be seen that the metering block is reciprocated under the drive of the timing cam which is driven in synchronism with the flight bar chain and entire packer. The cam plates include a straight cam slot and a vertically inclined cam slot. The meter block moves longitudinally when the cam pins are in the straight portion of the cam slots. This moves the metering block longitudinally. When the cams are in the angled slots, the metered block slides up and down. The timing cam controls the timing of the meter block movement.

Figure 13A:
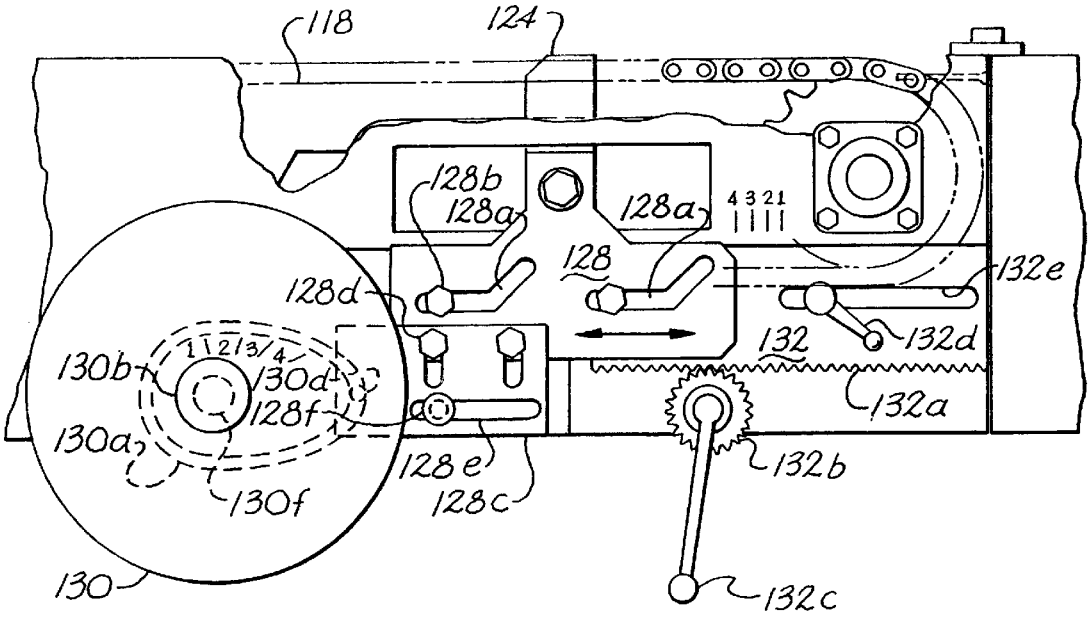
FIG. 13A is a front elevation of an adjustable metering and drive mechanism for varying the number of articles formed into a slug according to a slug feeder of the invention wherein a metering block is illustrated in a first reciprocating position.
Figure 13B:
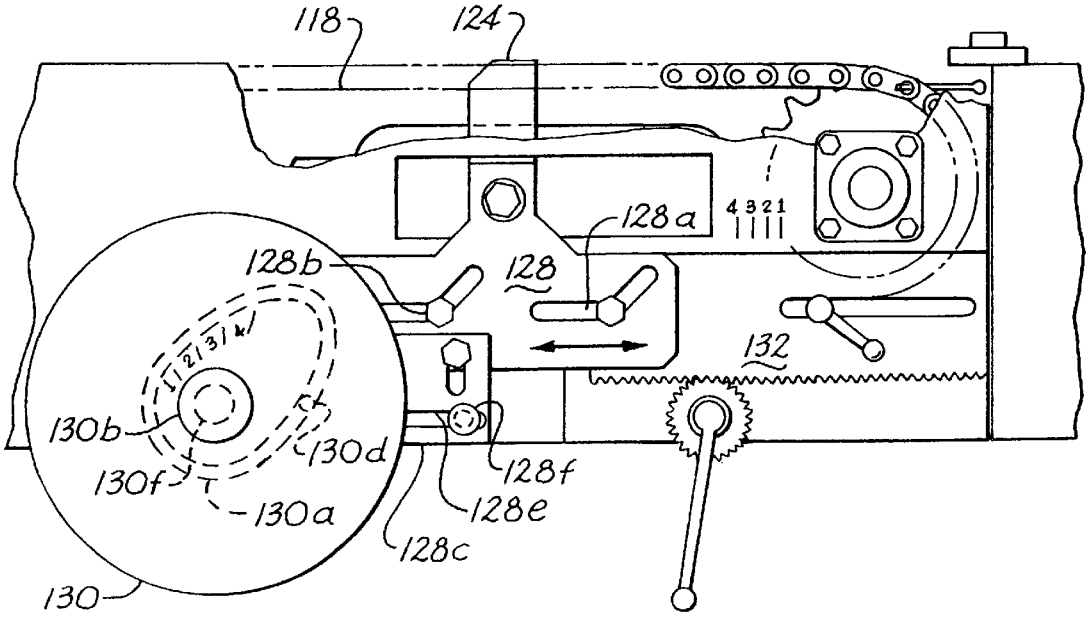
FIG. 13B is a front elevation of an adjustable metering and drive mechanism the metering block is in a second reciprocating position.
Figure 13C:
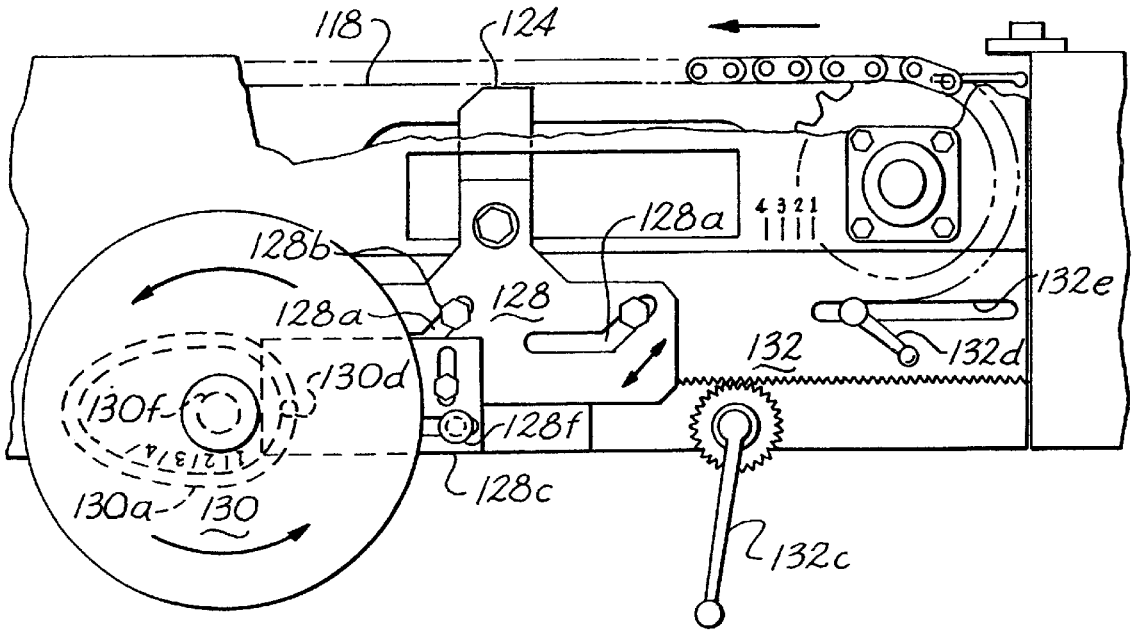
FIG. 13C is a front elevation illustrating an adjustable metering and drive mechanism carrier for an adjustable metering device according to the invention wherein the metering block is in a third reciprocating position below the level of support skids on which rows of articles are conveyed.
Figure 13D:
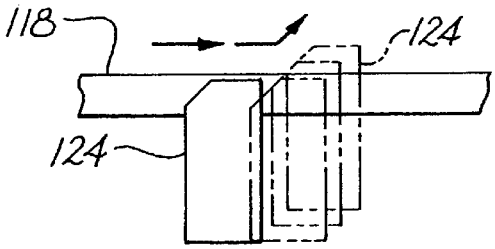
FIG. 13D is a schematic view of the cyclic, reciprocating path of the metering block of FIGS. 13A–13C.

The cyclic movement of metering block 124 will now be described by referring to FIGS. 13A–13C. In FIG. 13A, the metering block is to the right and up, extending above the surface of the bottom skids to abut a front a first article 13*a* in the row of articles contained in the slug. In FIG. 13B, metering block 124 is moved to the left and up. In FIG. 13C the metering block is to the left and down, i.e it has dropped below the bottom skid 118. In the position of FIG. 13B, the articles are conveyed past the metering block forward to the slug pick-up station 16 (FIG. 12). Prior to reaching the slug pick-up station, the articles are conveyed onto a support plate 133*f* making their entrance onto a plurality of pick-up blades 133*a*–133*e* smooth. An article counter mechanism 133*g* may be utilized to shut down the packer in the event that certain conditions exist in the counting of articles. For example, if three articles are not counted in the correct position in the slug, that is an indication that a bottle may be lying down in the lane, or missing, which could cause a significant malfunction condition at the slug pick-up station, requiring packer shut down to be described in conjunction with FIG. 15.

Figure 14A:
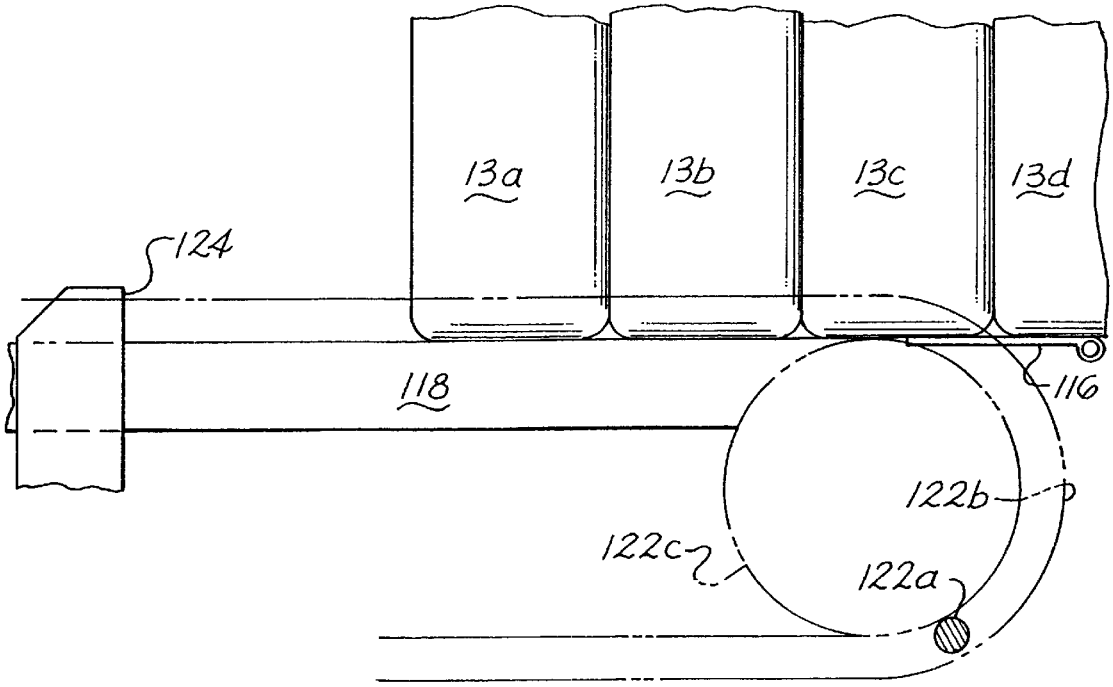
FIGS. 14A–14D are a series of elevational views illustrating the dividing of a continuous flow of articles into slugs of articles in the slug metering section according to the invention wherein the slug contains a prescribed number of articles.
Figure 14B:
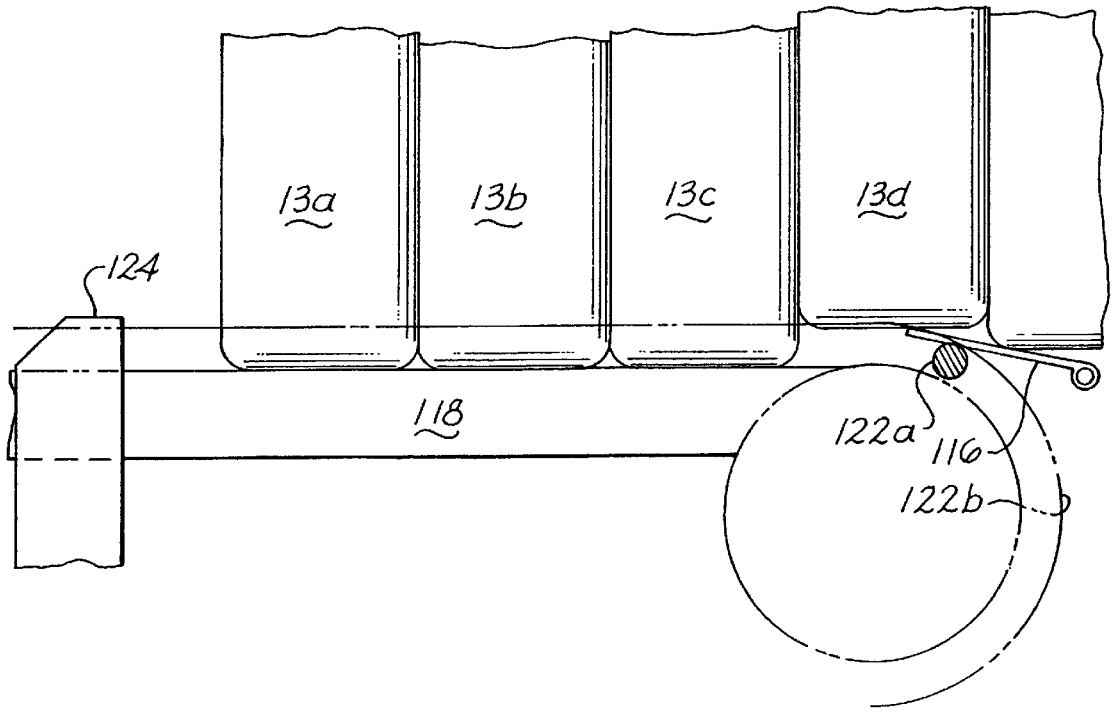
Figure 14C:
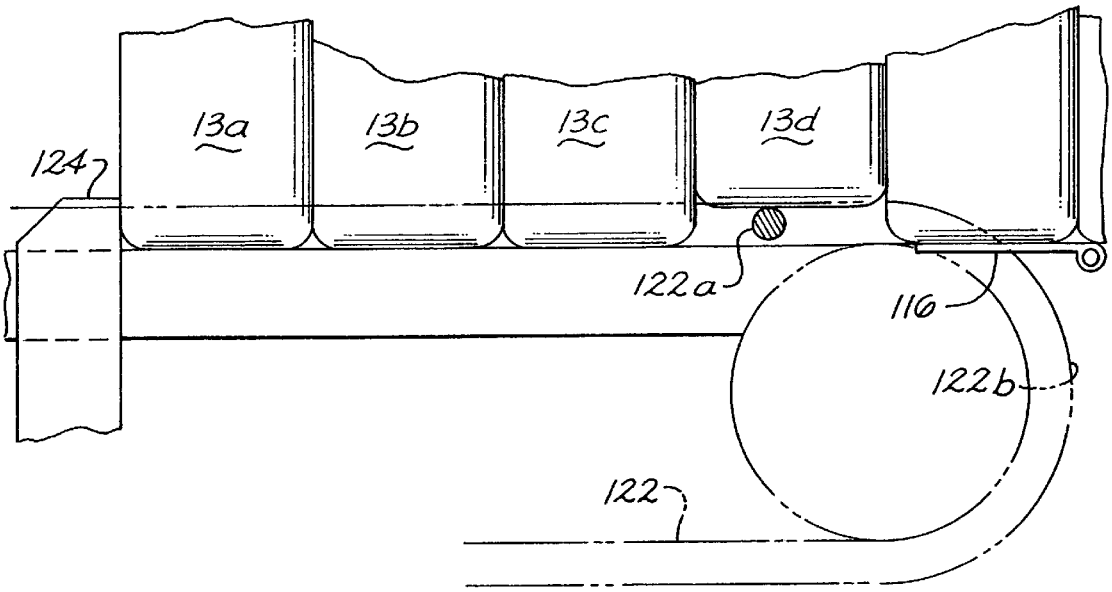
Figure 14D:
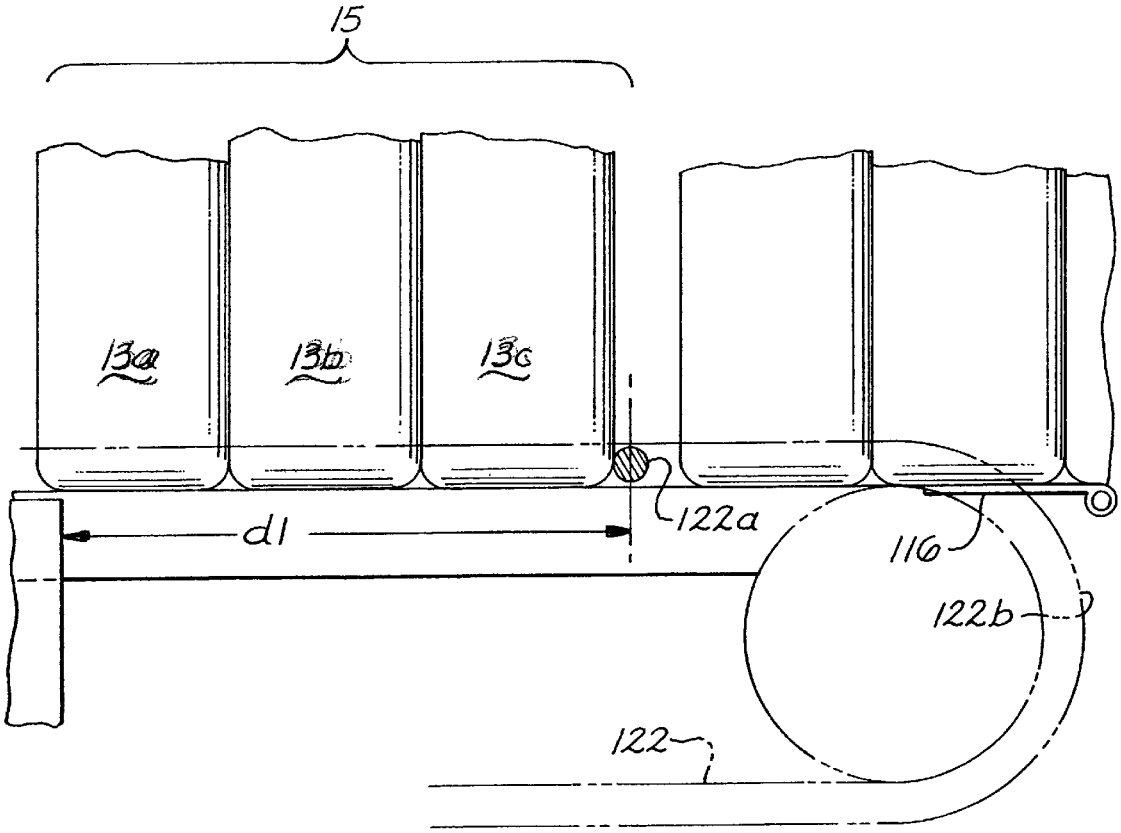

Referring to FIGS. 14A–14D, the operation of the slug metering section will now be described. In FIG. 14A, articles 13 are conveyed by the slug feed conveyor onto the bottom skids 118 of the slug metering section. Regardless of the number of lanes or rows, in each row, the first article in the slug is 13*a,* the second articles is 13*b,* and the last article is 13*c.* The first article in the next slug will be 13*d.* The articles continue to be fed at a desired speed by variable speed slug conveyor 114 onto the support skids. In FIG. 14B, the metering block is up and the flight bar begins to revolve up to divide the articles. The articles are still fed at speed which keeps the articles in contact and together as shown. In FIG. 14C, metering block 124 is up and first article 13*a* engages metering block 124. At this time, as determined by distance d1, flight bar 122*a* rises underneath article 13*d* to divide the continuous flow of articles. It will be pointed out that as long as metering block 124 is up, articles 13 will be conveyed at a sufficiently fast speed by conveyor 114 to maintain the articles in contact, as shown. As metering block 124 begins to drop, as can best be seen in FIG. 14D, slug feed conveyor 114 will momentarily slow down so that the slug 15 is quickly conveyed away by the revolving flight bar, leaving article 13*d* behind, and forming a separated slug of articles, with a gap between the next slug. It is important to note that a fast conveyor speed of conveyor 114 will keep articles 13 snugly against each other as long as metering block 124 is up. This enables flight bar 122*a,* which is above the bottom surface of the articles to lift up first article 13*d* in the second slug being formed and tilt it rearwardly to divide the articles into slugs. The relative speeds of the revolving flight bar, metering block, and slug conveyor may be controlled using any suitable arrangement, such as that shown in conjunction with FIG. 15. Transition plate 116 facilitates transfer from the slug feed conveyor to the bottom skids.

Case Indexing and Flap Opening

Figures 21, 24:
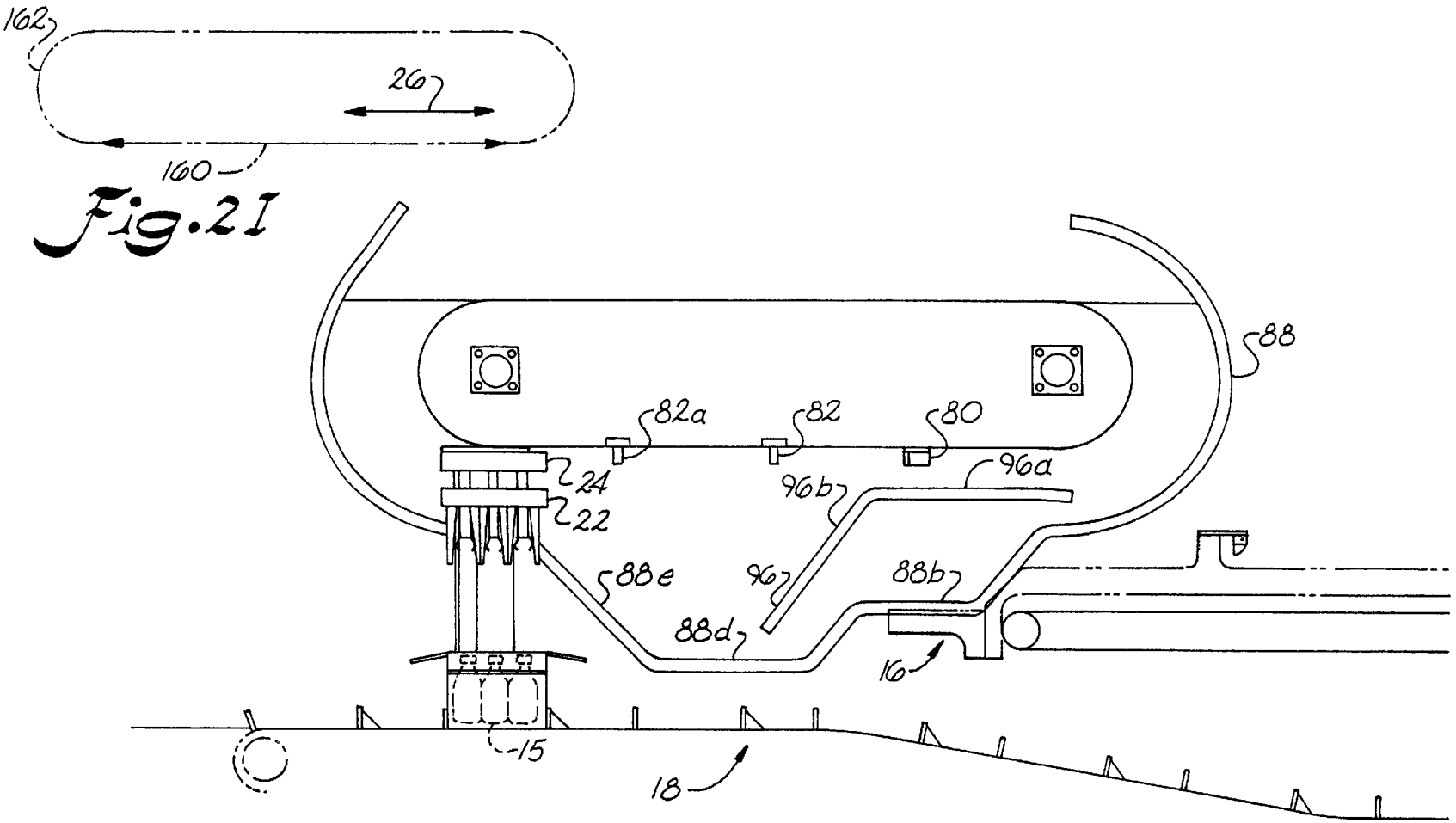
FIG. 21 is a perspective view illustrating a flap unfolding station for continuously unfolding the flaps of indexed cases being continuously conveyed on a continuous motion case packing apparatus according to the invention.
FIG. 24 is a perspective view with parts separated of an adjustable timing cam coupling for an adjustable metering block mechanism according to the invention.

As can best be seen in FIGS. 2A and 21, a case indexing station/conveyor D is disposed vertically below laner 14 and slug feeder B, and the conveyor continues through case packing station 18. Empty cases, with or without partitions are fed into and indexed at the station. The indexing conveyor includes a driven belt conveyor 136 having two spaced belt runs 136*a,* 136*b* with a center drive chain 138 which is separate and independent. Drive chain 138 carries a plurality of case engaging dogs 138*a* for conveying indexed cases to the case packing station. There is an indexing block 140 carried between the belt runs. The indexing block holds the cases until a first drive chain dog comes up in front of the case. The index block then releases the case. The case is conveyed up against the front dog and then a second, back dog comes up on the chain and engages the back of the case. The case is then held between the front and back dogs of the chain and conveyed through the case packing station. The cases are fed to belt conveyor 136 by a standard roller conveyor (not shown). For details of a suitable case indexing system, reference may be had to U.S. Pat. No. 3,986,321, incorporated herein by reference.

The indexed cases may be with or without flaps. If the indexed cases have flaps, a suitable flap opening station may be provided. For example, a flap opening station, designated generally as F, may be provided as shown in FIG. 21. Flap opening station F may include a pair of suction heads 140*a,* 140*b* which pivot from a vertical to a horizontal position under the control of a suitable reciprocating drive arrangement shown to include a cam 141 which rocks 180 degrees and drives the suction head through a chain 141*a.* In the horizontal position, suction is applied and major flaps 142*a,* 142*b* of a case 142 are opened to a vertical position. Next, the case with major flaps held vertical is conveyed underneath a horizontal plow 144 having diverging wings and diverging sides. The diverging plow sides fold the vertical flaps over from the vertical position to a horizontal position. The horizontal flaps are engaged by guide wires 146 on both sides of the plow which hold the major flaps horizontal. Next, the case is conveyed underneath a suspended pivot finger 148 with a hook end 148*a* which engages a rear flap 142*c,* and folds it open to a horizontal position. Next, a rocker arm 150 having a freely pivoting pivot finger 150*a* reciprocates and engages a front minor flap 142*d* and opens it horizontal. Pivot finger 150*a* pivots freely in a counter-clockwise direction so that on the return stroke of the rock arm, the pivot finger returns to a home position in which it is generally vertical. After front minor flap 142*d* is folded horizontal, a reciprocating, horizontal wiper arm 152 pivots forward to wipe over the rear and front minor flaps to ensure they are horizontal before they enter a center angle arm 154 which holds the flaps horizontal. A middle guide wire 154*a* continues to hold the flaps horizontal as indexed cases move continuously through the conveying process. Outside guide wires 146 and center wire 154*a* hold the flaps open for case is packing through the case packing station. A suitable drive and control arrangement may be provided for the above described flap opening elements as, for example, disclosed in U.S. Pat. No. 4,587,792.

As can best be seen in FIG. 15, a synchronized drive arrangement is provided for driving carriage C, slug feeder B, and case indexing conveyor D in synchronization and at the same speed so that the article pick-up heads, slugs, and cases are conveyed in intervals "L" for accurate timing of slug pick up and deposit. There is an electric drive motor 160 which drives a system drive shaft 162 through a pulley 162*a* and clutch 164, which may be any suitable electromagnetic clutch for starting and stopping the case packer operation. Clutch 164 may be actuated and deactuated manually, and in response to a controller 165. There is an upper gear box 166 and a lower gear box 168 driven by drive shaft 162. Upper gear box 166 drives top carriage chain 38, and lower gear box 168 drives the lower carriage chain 48 through a drive sprocket 48*a,* and drives indexing conveyor chain 138 through a common drive shaft 170 and drive sprocket 172.

Revolving flight bar mechanism 122 is driven through drive sprockets 123*a* and 122*c,* which are driven off of drive chain 123 and shaft 123 (FIG. 12). Drive chain 123 is driven off of a indexing conveyor chain and shaft 138, 170*a* in unison therewith, through a drive sprocket 138*b.* The drive for metering block mechanism 126 has been explained previously in conjunction with the slug feeder. Variable speed slug feed conveyor 114 is driven by a variable speed motor and controller 114*a* as described in the operation section below. A conventional safety clutch 172 is provided through which the slug feed conveyor and revolving flight bar are driven. If there is a bottle jam, safety clutch will sense this condition and kick out to stop the slug feeder instantly. A signal is also sent to controller 165 to stop the packer. All of the sprockets shown are affixed to the shafts in a conventional manner such as a spline or the like.

It is also noted that a programmable limit switch (PLS) 174 may be provided for use with one example of a controller for the apparatus, and is driven off of shaft 170*a* and clutch 172. PLS 172 provides sequencing of several events over the cycle interval "L" in order that several control functions may be had as described above. The PLS is divided into 300 increments so that the interval "L" is divided into increments of 0.1 inches for the example where "L" is thirty inches. At prescribed increments, or ranges of increments, certain control functions may be looked at. For example, signals from photo cells (not shown) positioned to detect the correct position of an indexed case on conveyor 138 may be processed by controller 165 over a desired increment range to assure that the case will be in a correct position a the case packing station. Photo cells may also be positioned over the cases to look into the cells and detect whether all cells are empty, a flap is closed, or a case is missing. There should be a case every 30 inches or cycle of the PLS. In addition, the PLS is used to vary the speed of slug feed conveyor 114. That is, over a desired increment range, the conveyor is speeded up to keep articles in tight contact in the slug metering section while the metering block is up during slug formation, as described above. Afterwards, the conveyor is reduced in speed to that of the flight bar mechanism or slightly slower. Signals from the article count of sensor 117 in lanes 30 may be looked at over an increment range prior to the slug reaching the slug pick-up station. If three bottles are not counted in their correct position, known by the PLS, a signal is generated and sent to the controller. In the case of any of the above events, signals may be transmitted to controller 165 to deactuate clutch 164 and stop the packer. Controller may be any programmable controller or computer, the provision of a which would be well within the purview of a skilled artisan in the control art, having been taught the principles of the invention.

Operation

Figure 2E:
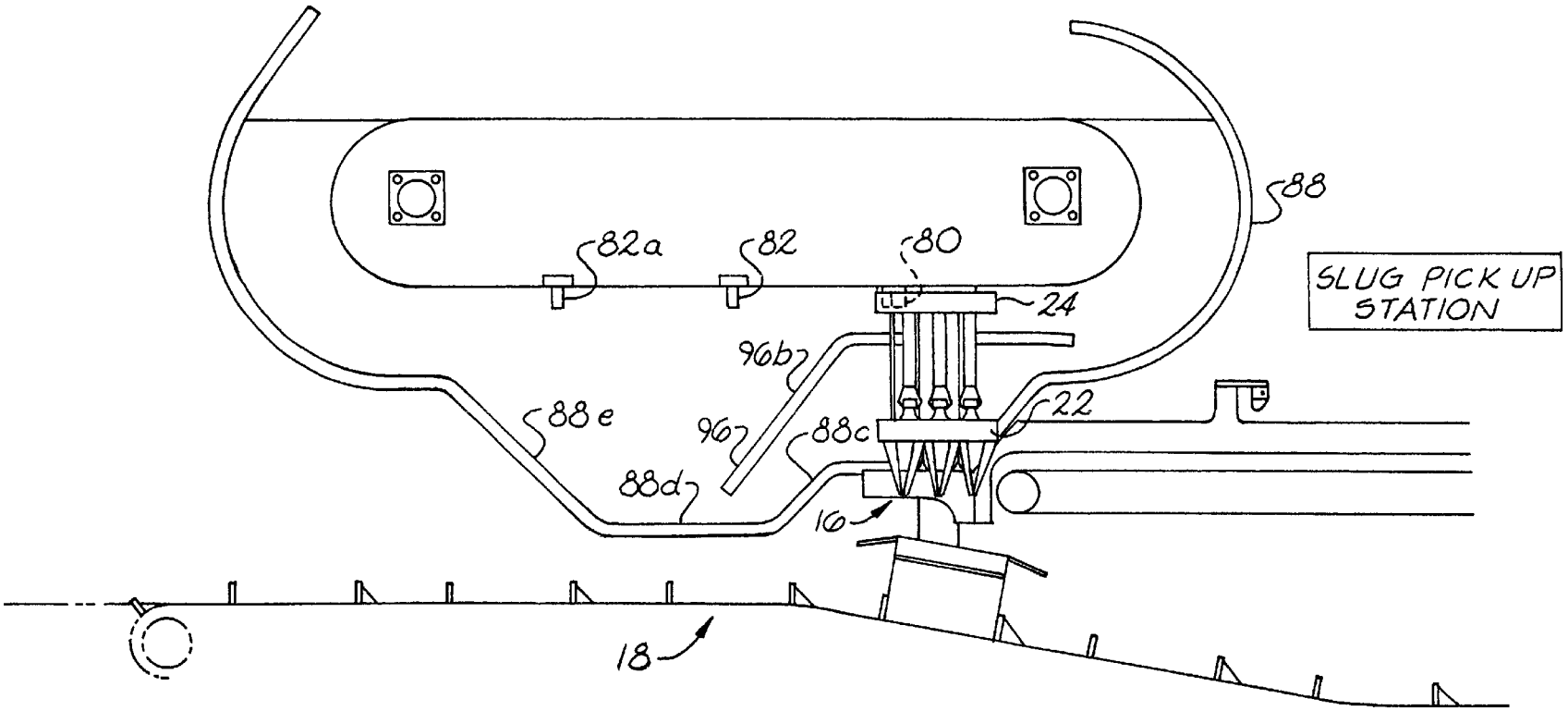
FIG. 2E is a schematic elevation illustrating a continuous motion case packing apparatus and method according to the invention illustrating the relative positions of an article transfer arm having gripper and grid heads, a slug of articles, and indexed case at a slug pick-up station.
Figure 2F:
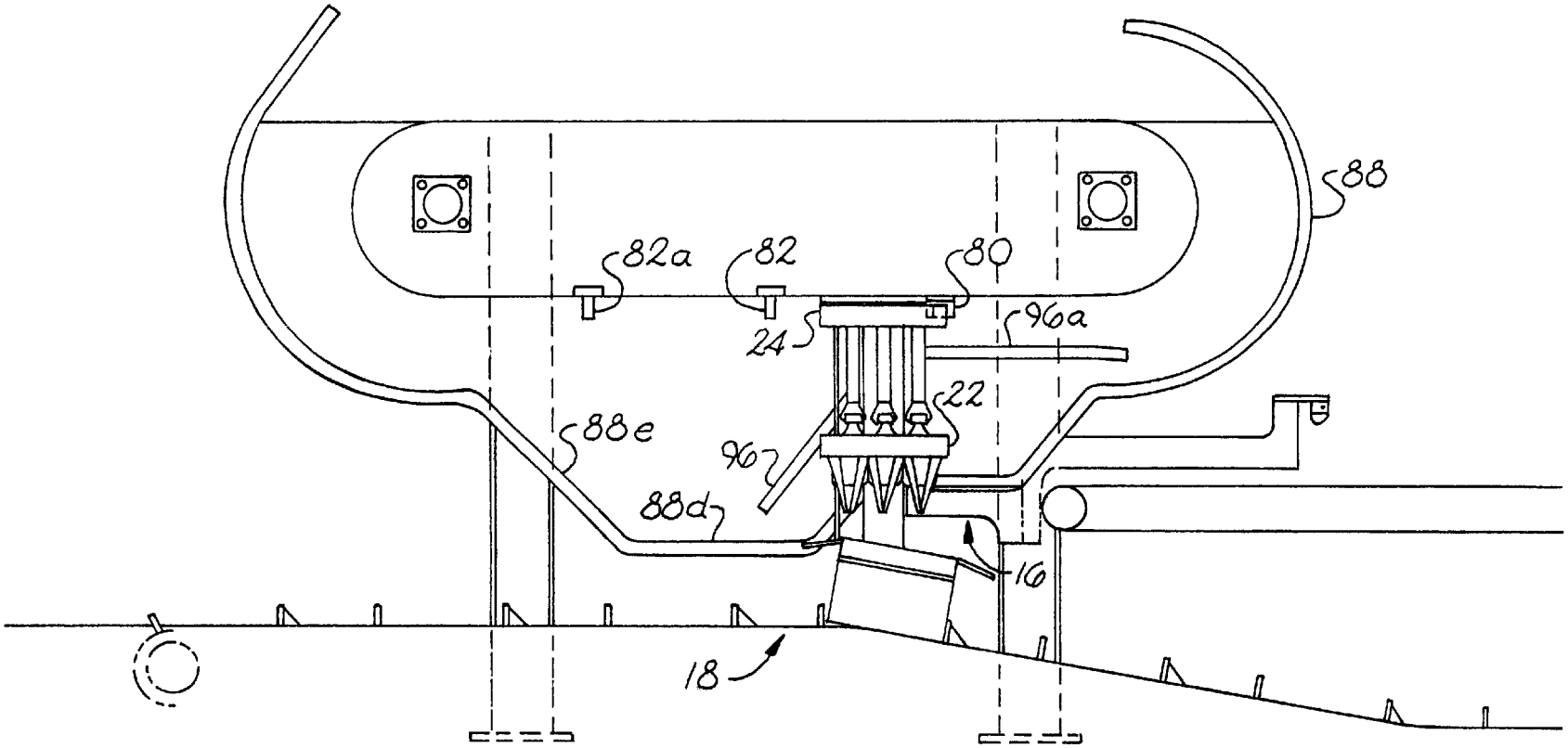
FIG. 2F is a schematic elevation illustrating a continuous motion case packing apparatus and method according to the invention illustrating the relative positions of an article transfer arm having gripper and grid heads, a slug of articles, and indexed case leaving the slug pick-up station.
Figure 2G:
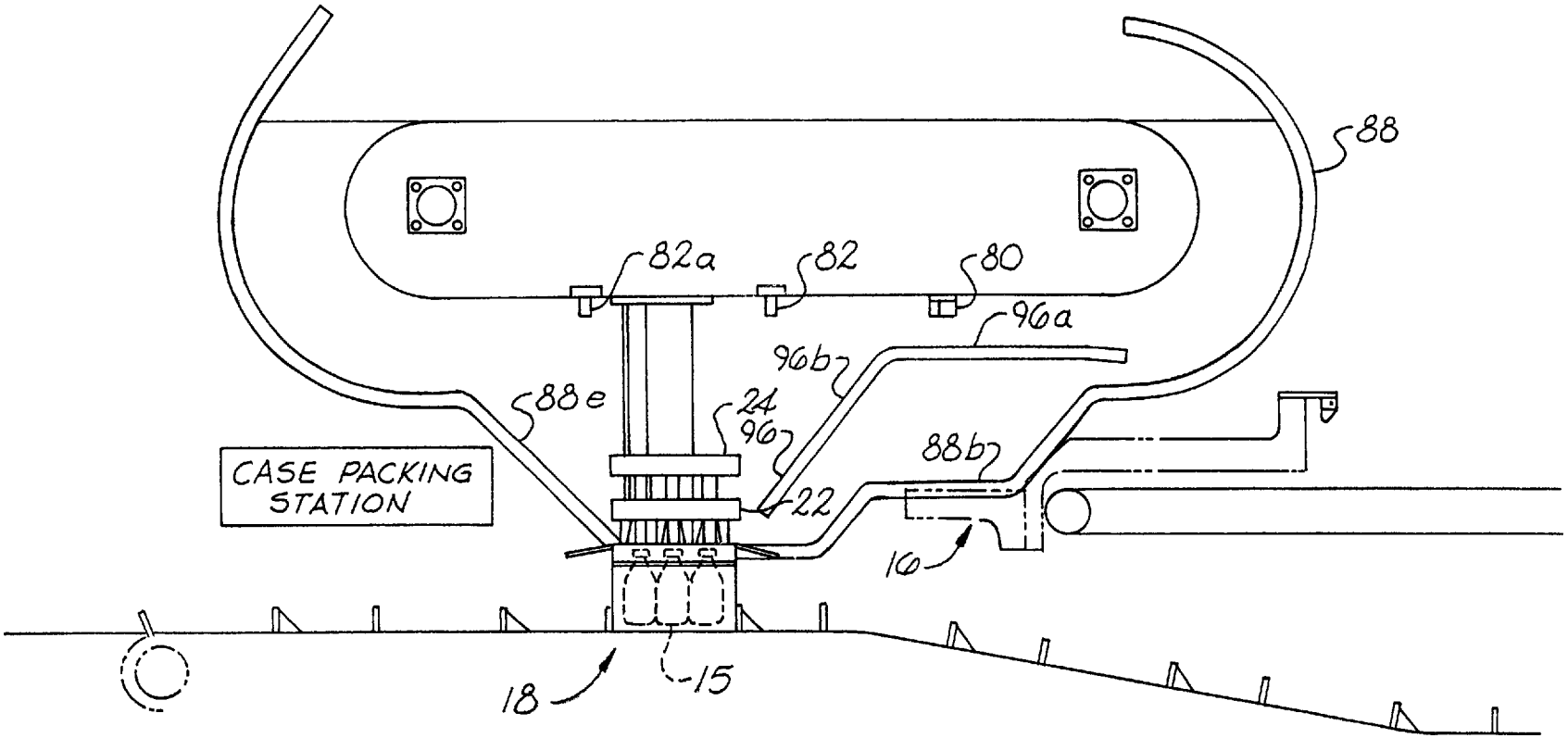
FIG. 2G is a schematic elevation illustrating a continuous motion case packing apparatus and method according to the invention illustrating the relative positions of an article transfer arm having gripper and grid heads, a slug of articles, and indexed case at a case packing station.
Figure 4C:
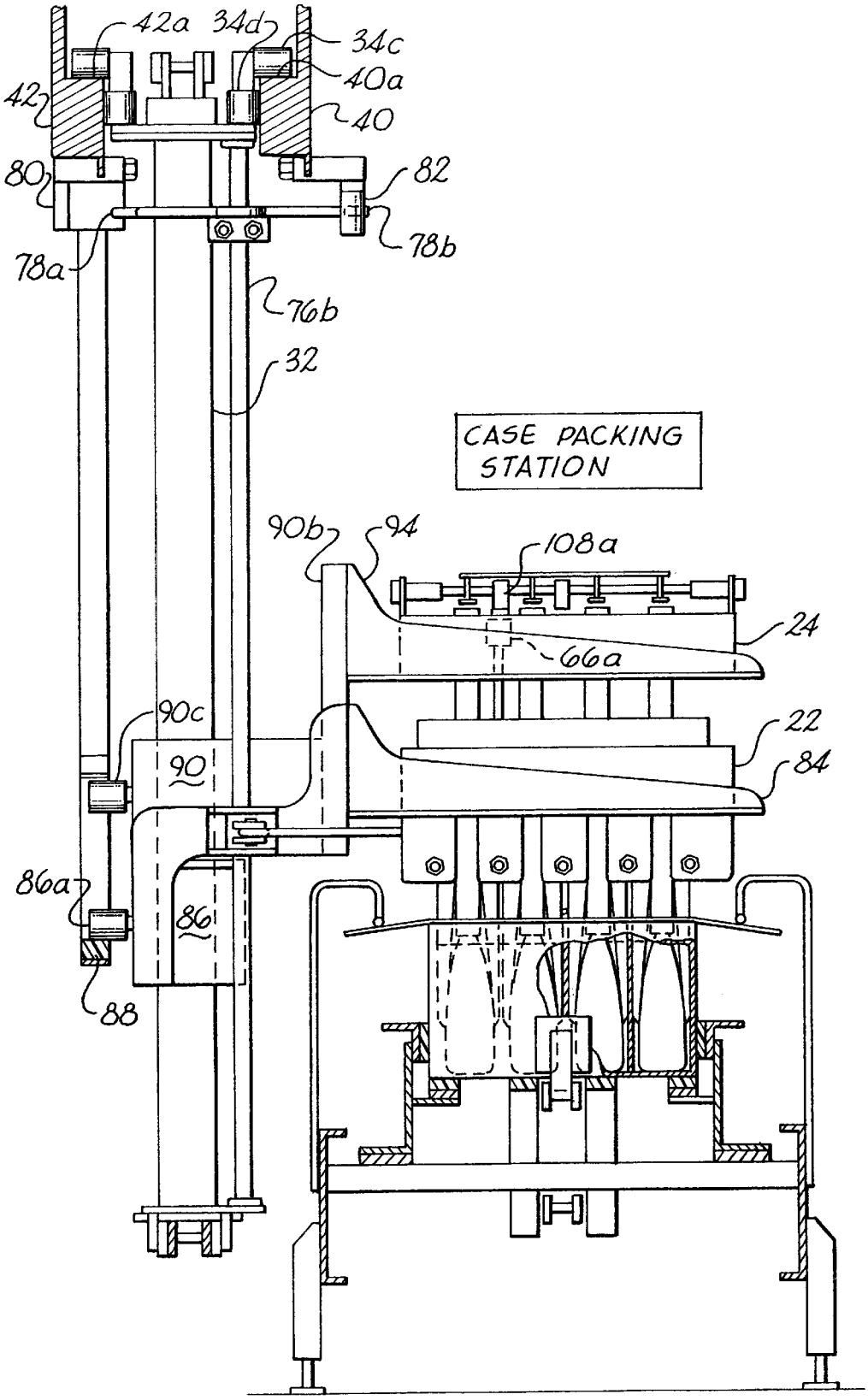
FIG. 4C is a sectional view taken along line 4C—4C of FIG. 3A of a case packing station according to the invention.

The operation of the apparatus for continuously packing articles into cases and method will now be described referring mainly to FIGS. 2C–2I and 4A–4C. First, referring to FIG. 2C, it can be seen that first cam track 88 and bearing block 86; and second cam track 96 and bearing block 90 provide a vertical motion mechanism by which grid head 22 and gripper head 24, respectively, are caused to slide over transfer arms 20 in reciprocating linear movements to be described in reference to FIGS. 2C–2G. These movements will first be described by referring to FIG. 2C, and locations 1 through 9 on the cam tracks and across the linear path of transfer arm 20 as it is carried by carriage C. At location 1, grid head 22 and gripper head 24 are positioned directly above and in alignment with a slug 15, as can best be seen in FIG. 2D. Both the grid chutes and the gripper jaws are open. The gripper jaws are open because gripper actuator arm 108*a* is still engaged by abutment 66*a,* as can best be seen in FIG. 4A. However, as soon as grid head 22 begins its descent over cam track portion 88*a,* abutment 66*a* moves downwardly to release gripper actuator arm 108*a* causing the gripper jaws to close around the necks of articles 13. From locations 2–4, the grid set descends to its lower most position at slug pick-up station 16 (FIG. 2E). At slug pick-up station 16, the gripper jaws grip the articles. The articles 13 have entered the open ends of the grid chutes 54 and the grid fingers defining the chutes have descended a sufficient distance past the bottoms of cantilevered blades 133 to enclose articles 13. Between locations 4 and 5, grid actuator arm 78*a* engages abutment 80 moving all of the grid fingers toward the center of the chutes to close off the chutes and positively retain the articles in the chutes (FIG. 4B). Thus, it can be seen that the articles are picked-up positively at the pick-up station by both the grid head and gripper head. This redundancy provides a highly reliable and fail safe pick-up of the articles which is particularly advantageous for glass containers. At location 5, FIG. 2F, both the grid head and the gripper head begin their descent to case packing station 18 over cam track portions 88*c* and 96*b,* respectively. At location 6, FIG. 2G, grid set 22 and gripper head 24 are at the case packing position. The closed grid fingers of grid head 22 have penetrated into the case at their lowest point (FIG. 4C). In packing partitioned cases, the closed grid fingers easily enter the individual cells of the partitioned case due to their converging configuration. Obviously, the gripper tubes, grid chutes, slugs, and cells defined by the partitions in the cases are arranged in a corresponding matrix. After the grid fingers have reached their lowest point of travel into the case as defined by cam track portion 88*d,* second actuator arm 78*b* strikes second abutment 82 to open the grid chutes. This causes the grid fingers to move away from the center of the chute into the corners of the case cells, or against the chute forming surfaces 70, 73 against which the corner fingers are urged in the chute open position (FIG. 10A) when cases without partitions are being packed. For purposes of clarity, the partitions have been omitted from FIG. 4C. As the gripper head reaches its lowest point of descent somewhere near the end of cam track portion 96*b,* gripper actuator arm 108*a* is again engaged by abutment 66*a* causing the gripper jaws to open. At this point, bearing block 90 which carries gripper head 24 rests on top of bearing block 86 which carries grid head 24. The nested heads are now in a position to be lifted out of the case for their return trip back to slug pick-up station 16. This occurs between locations 8 and 9 over cam track portion 88*e,* FIG. 2H, whereupon grid head 22 travels upwardly to begin its return trip. Referring to FIG. 2I, it can be seen that carriage C moves the transfer arm and pick-up heads in a closed, vertical plane curve 160 which includes a linear path 160, which also includes linear transfer section 126, and a curvilinear return path 162. The curvilinear return path may also be considered as including a portion of path 160 in excess of the linear transfer section.

Figure 25:
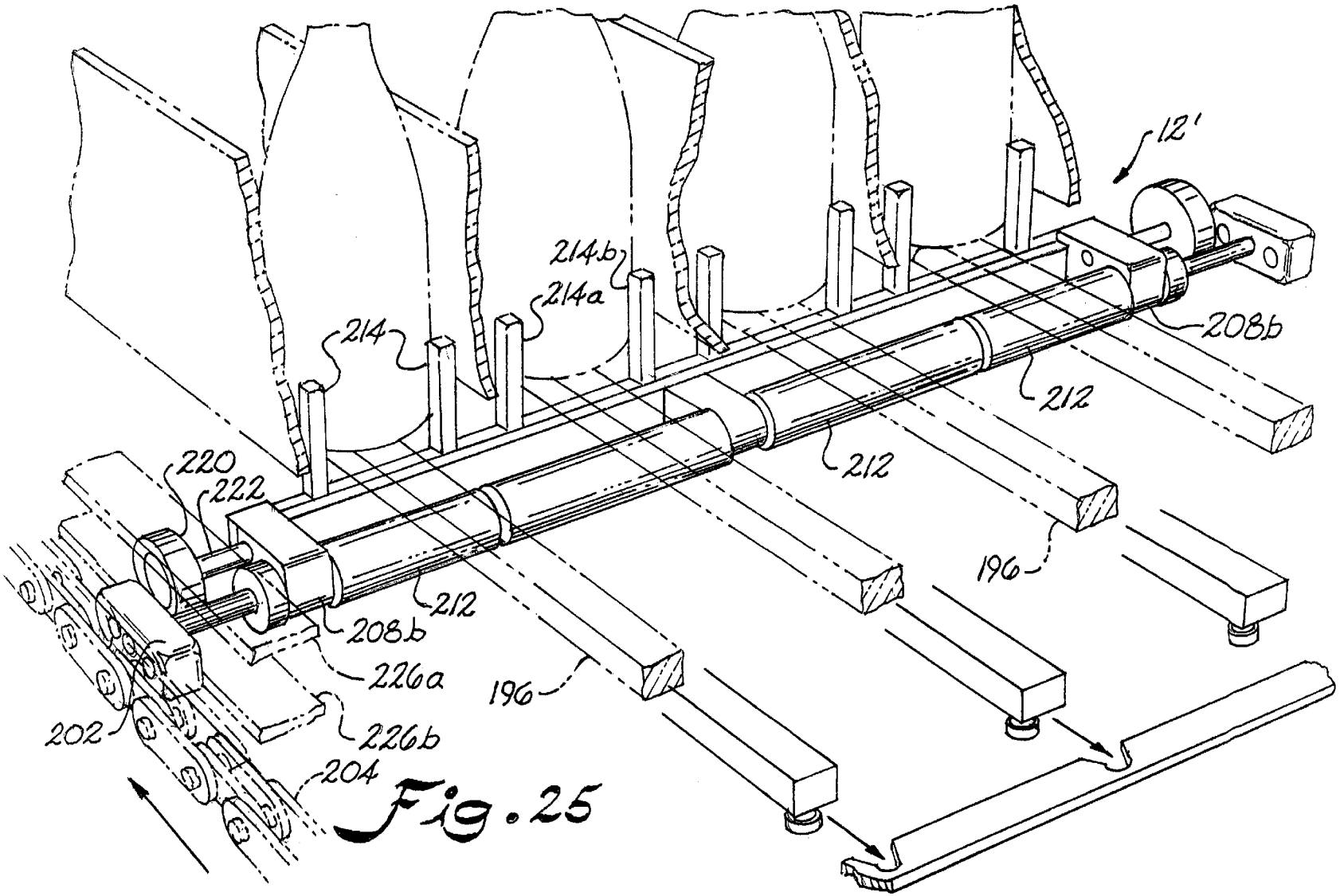
FIG. 25 is a perspective view illustrating a metering section and revolving pin bar assemblies for segregating articles into a group or slug of articles in accordance with an alternate embodiment of the invention.
Figure 28A:
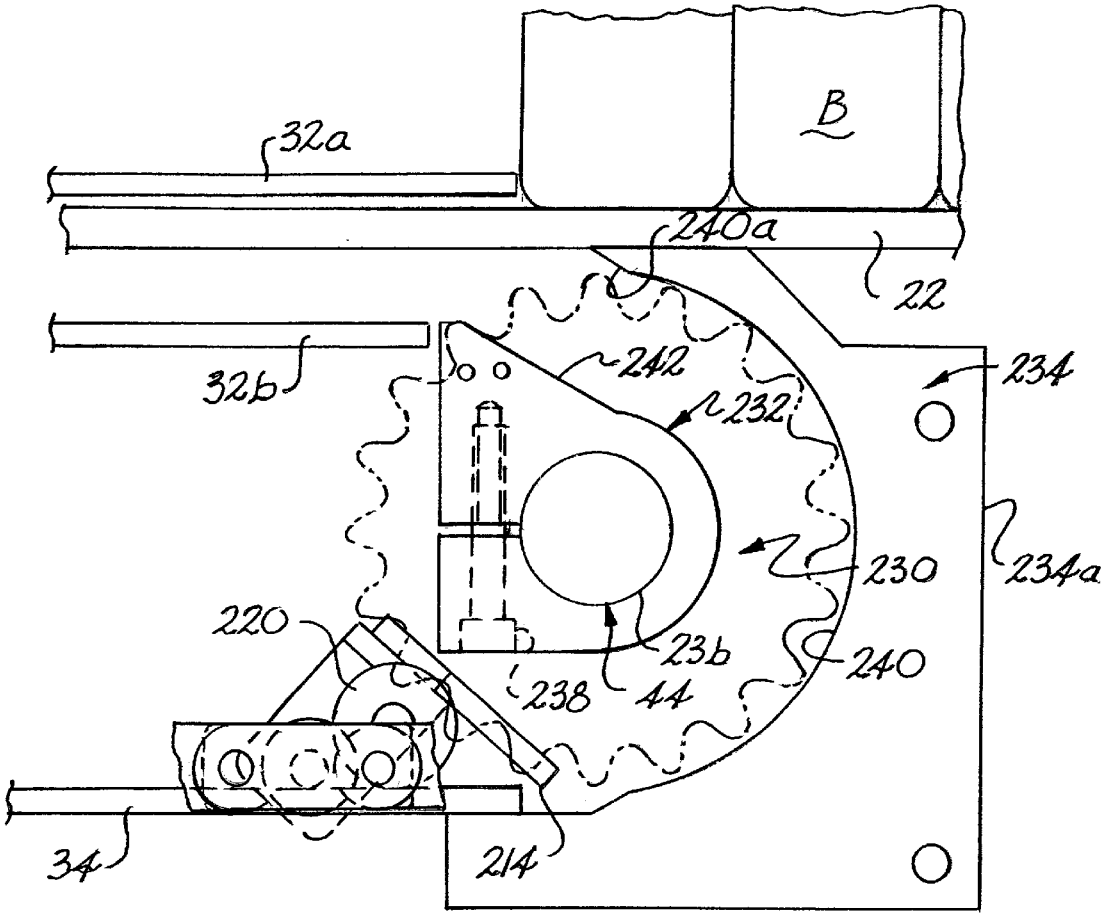
FIG. 28A is a side elevation illustrating a linear path and a radial cam path for a cam of a pivoting pin bar assembly according to the present invention.
Figure 28B:
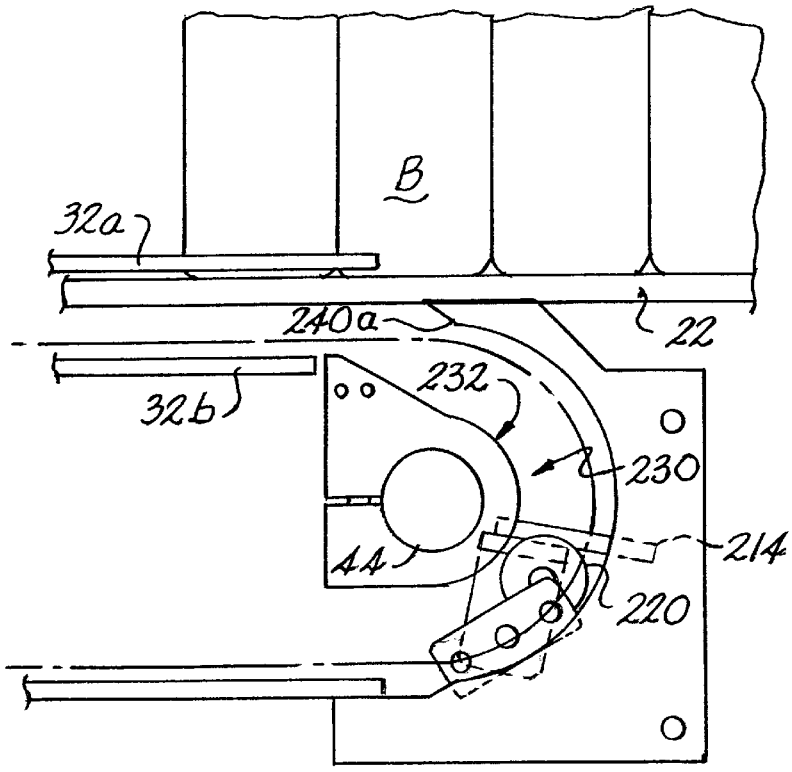
FIG. 28B is an enlarged elevation of a pin bar assembly according to the invention entering the radial cam path at the entrance of a metering section according to the invention.
Figure 28C:
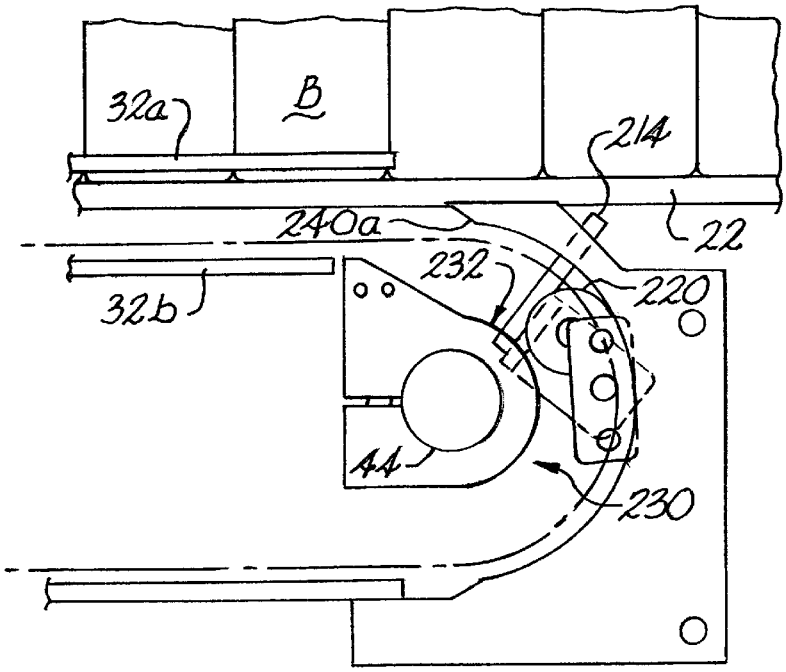
FIG. 28C is a partial end view of a radial cam path at the entrance of a metering section wherein a cam yoke which positions the pin bar is engaging a curved cam surface.
Figure 28D:
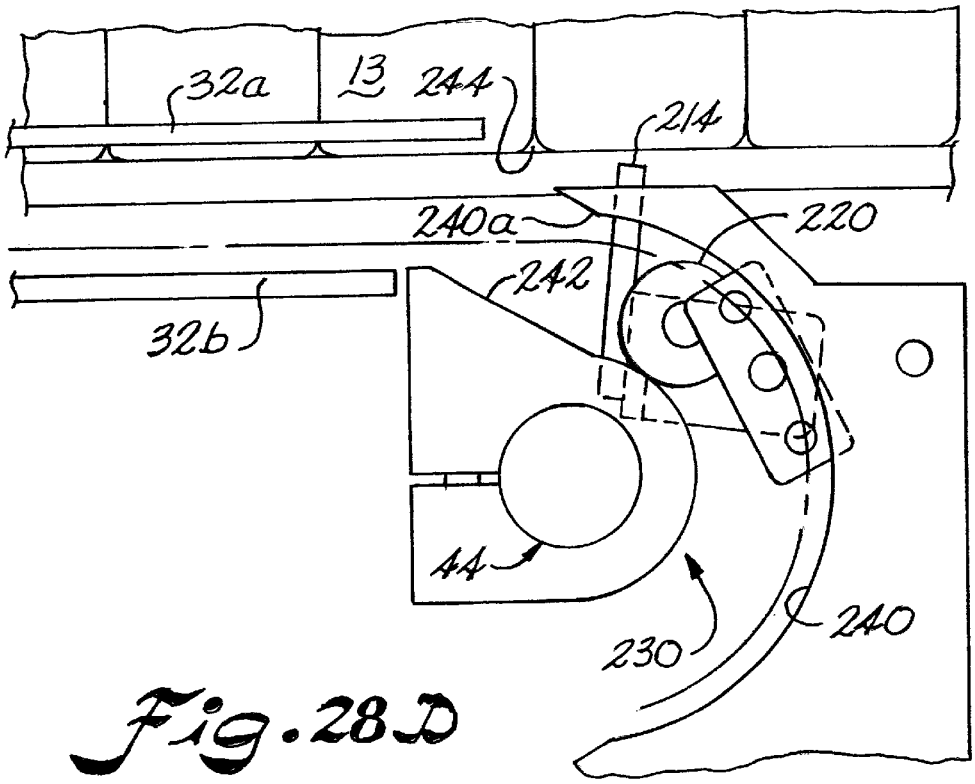
FIG. 28D is an enlarged elevation of an entrance of a metering section wherein a pin bar for segregating the articles has moved into an operational position.
Figure 28E:
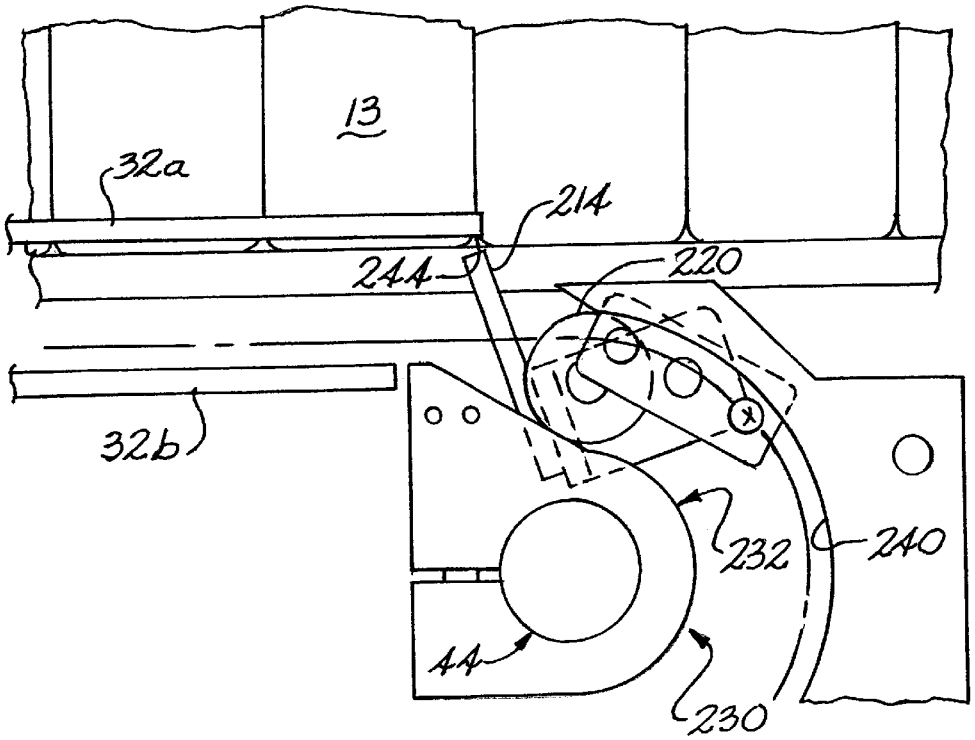
FIG. 28E is an end view at the entrance of a metering section wherein a cam yoke of a pin bar assembly has engaged a second cam surface to pivot the pin bar forward so they may be received in a crevice between articles for segregating the articles into groups or slugs.
Figure 28F:
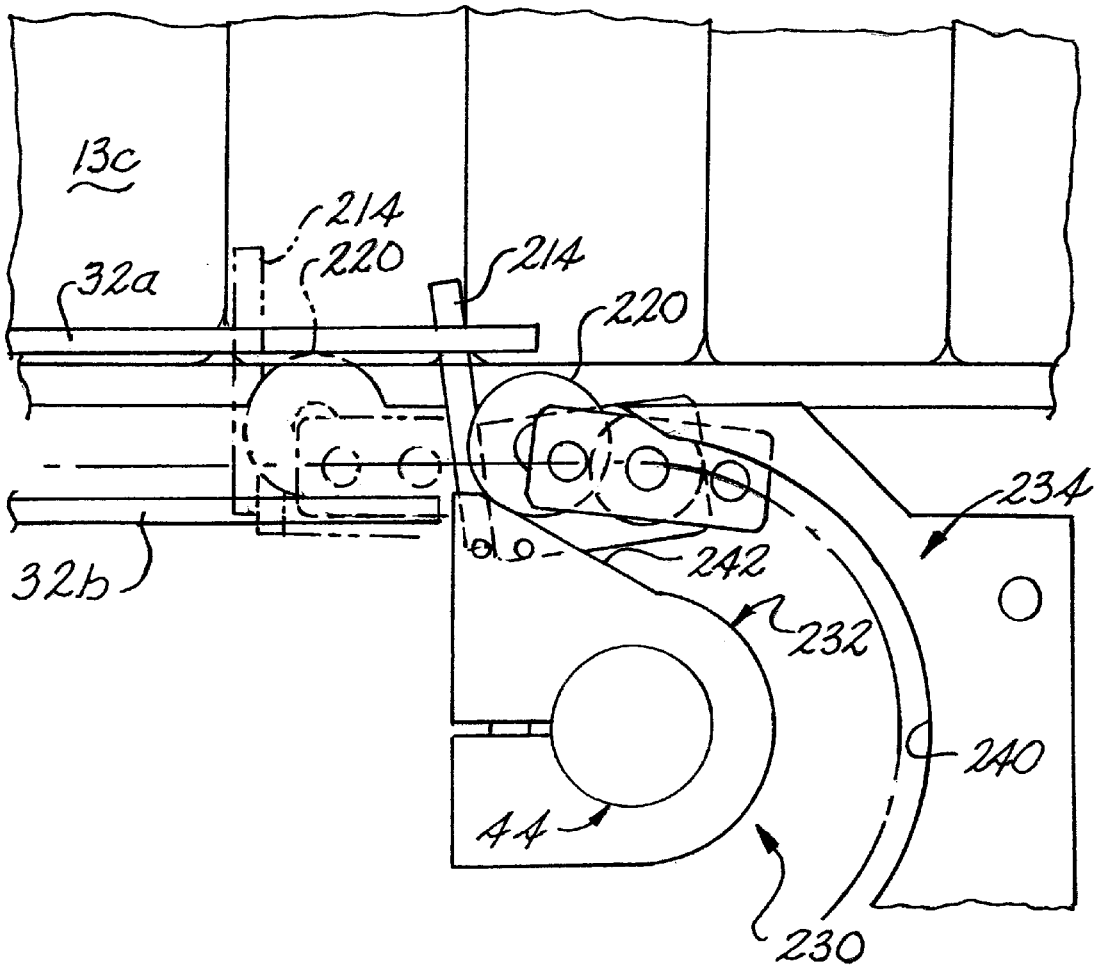
FIG. 28F is an elevation of an entrance of a metering section wherein pins of a pin bar assembly have been moved into crevices between articles to segregate articles by means of a cam yoke which is shown riding on linear cam bars.
Figure 30G:
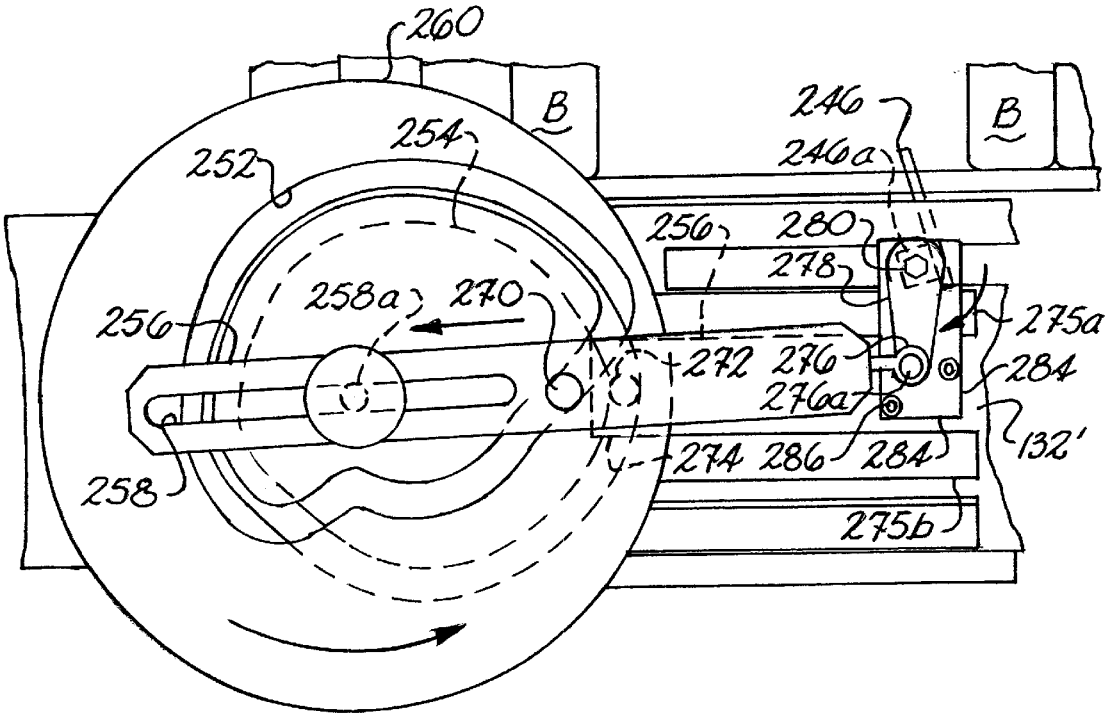
FIG. 30G is an elevation of the metering section wherein the cam wheel has turned and the metering member has begun to pivot clockwise to engage the articles needed to begin a new metering operation.
Figure 28G:
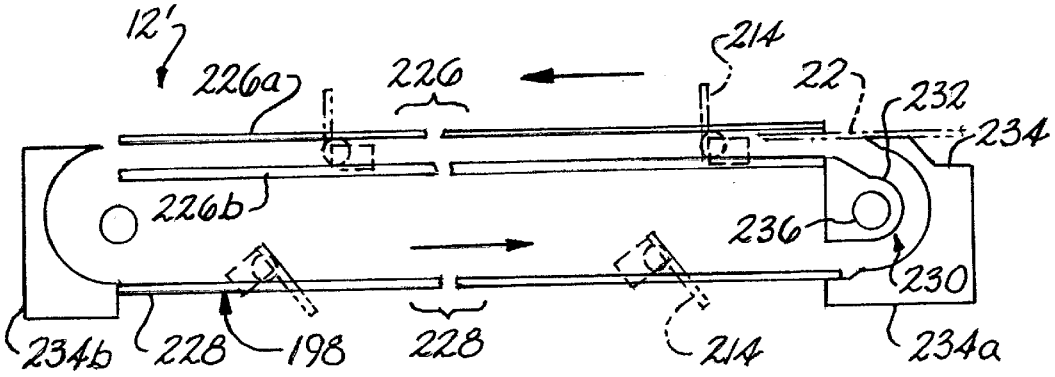
FIG. 28G is a schematic view illustrating a revolving pin bar mechanism of a metering section which includes a plurality of individual pin bar assemblies and the linear and radial cam paths for the pin bar assemblies.

Referring now to FIGS. 25 through 28G, another embodiment of a slug metering section, referred to generally as 12' will now be described. Articles 13 move from conveyor 114 on to a plurality of bottom skid plates 196, which are centered in the lanes and are also made to be replaceable and adjustable to accommodate different width lanes and different length metering sections. Slug metering section 12' includes a revolving pin bar mechanism 198 which provides a revolving article separator for separating the continuous stream of articles into discrete slugs. (FIG. 28G). The revolving pin bar mechanism includes a plurality of pin bar assemblies, designated generally as 206, spaced at an interval "L" apart (FIGS. 25 and 28G). The pin bar assemblies revolve and insert between articles to divide the articles, and engage the last article 13*c* in a slug for conveying the slug of articles forward through the metering section (FIG. 28F). Each pin bar assembly 206 includes a flight bar 200 having a pin bar carrier 208 rotatably carried thereon. Flight bars 200 are carried on an endless chain 204 driven by a drive sprocket 123*a,* 123*c* and various other idler sprockets as described in the previous embodiment (FIGS. 12 and 15). Other means for pivotally mounting the pin bar assemblies to a continuously revolving mechanism may also be utilized.

Figures 26A, 26B:
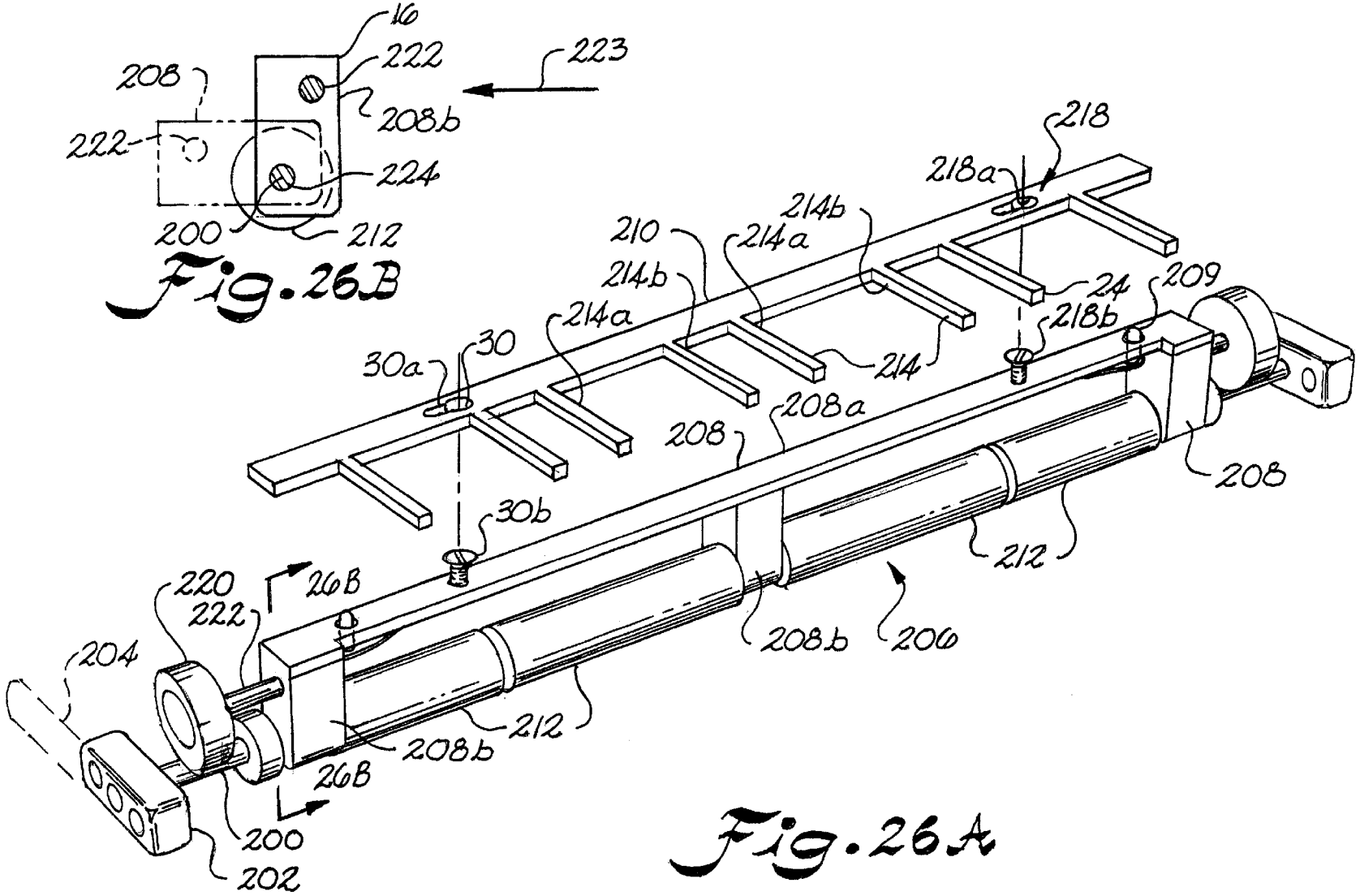
FIG. 26A is a perspective view with parts separated showing an individual pin bar assembly of the revolving pin bar mechanism of FIG. 25.
FIG. 26B is a partial elevation illustrating a pin bar carrier having a pivot about which the pin bar assembly rotates and a pivot for a cam yoke which positions the pin bar in pivotal movements.
Figure 27:
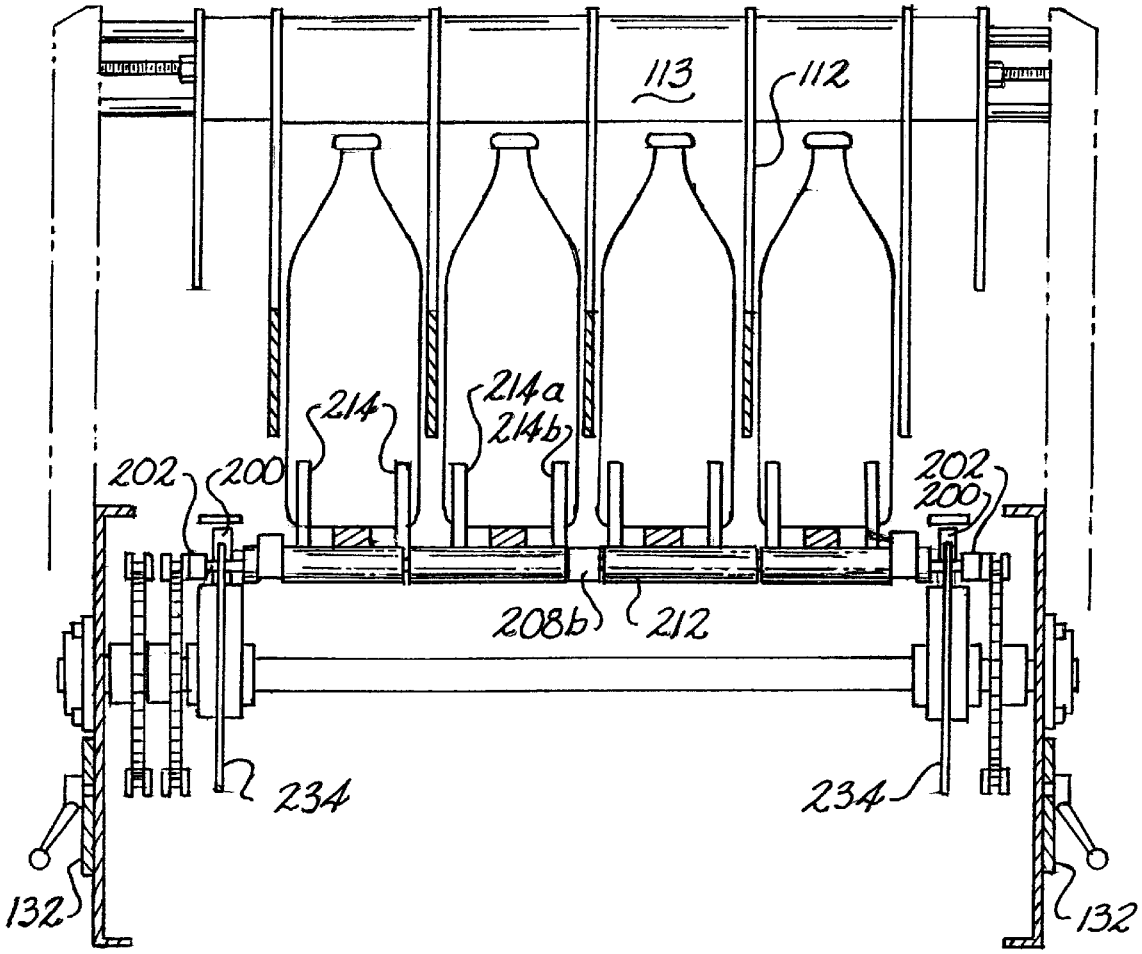
FIG. 27 is an elevation of a metering section according to the invention with paired pins of the pin bar assembly engaging articles in a last row in a group of articles to segregate the articles from oncoming articles.

Mounting blocks 202 mount the flight bars 200 to drive chain 204. Pin bar assembly 206 includes pin bar 210 carried by pin bar carrier 208. Pin bar carrier 208 includes an elongated carrier bar 208*a* and a plurality of carrier arms 208*b* between which are carried a plurality of skid plate support rollers 212 which rotate on flight bars 200. Skid plate support rollers 212 roll underneath and support skid plates 196 which extend longitudinally in each lane and support the articles (FIG. 25). Pin bar 210 includes pairs of pins 214 wherein each pair includes spaced pins 214*a* and 214*b*. The spacing between 214*a* and 214*b* is determined by the diameter of the bottle or width of the package being processed. Pin bar 210 is preferably a one-piece manufacture. Different pin bars may be manufactured having different pin spacings to accommodate different article dimensions. The pin bars may be interchanged easily by means of a detachable mount in the form of a keyhole connector 218 which includes a keyhole 218*a* (first attachment element) formed in pin bar 210 and a key bolt 218*b* (second attachment element) carried by carrier bar 208*a* (FIG. 26A). Means for locking the pin bar in place including a ball indent arrangement 209.

There is a cam yoke 220 fixed to a shaft 222 which in return is fixed to the end carrier arm 208*b* of pin bar carrier 208. As can be seen by referring to FIG. 26B, pin bar carrier 208 pivots about flight bar 200 in operation at a pivot 224. Shaft 222 of cam yoke 220 is offset forward and upward with respect to flight bar pivot 224 in the direction of travel 223, as can best be seen in the dotted line position of FIG. 26B.

As can best be seen in FIGS. 25 and 28G, cam yoke 208 is contained within a cam bar mechanism 226 which includes an upper cam bar 226*a* and a lower cam bar 226*b* during its linear travel underneath skid plates 196. Lower cam bar 226*b* prevents the pin bar from falling under the force of gravity and upper cam bar 226*a* prevents the pin bar from rotating backwards as it bears against the bottles. Cam yoke 220 rests against a bottom cam bar 228 on its return path. In between the linear cam paths defined along cam bars 226 and 228, cam yoke 220 travels in a radial cam path, designated generally as 230, as can best be seen in FIG. 28A. Radial cam path 230 is defined by a cam block, designed generally as 232, and an outer cam plate 234. There are two cam plates 234, one at the infeed end as shown at 234*a* and the second at the outfeed end which is shown at 234*b* (FIG. 28G). Cam block 232 is mounted to an idler shaft 236 carried by the frame. A locking bolt 238 tightens cam block 232 on shaft 236. Cam plate 234 includes a cam surface 240 against which cam yoke 220 bears initially as it enters radial cam path 230. At its upper portion, namely 240*a,* cam surface 240 insures that cam yoke 220 engages a cam surface 242 of cam block 232. Cam surface 242 causes pin bar 210 to be rotated by cam yoke 220 so that pins 214 engage the bottles at the proper time and position. In particular, at high speeds, cam surface 240 assures that cam yoke 220 is urged against cam surface 242 to provide reliable operation. It is important at this phase of operation, that cam yoke 26 pivots pins 214 in the proper position for reliable upright insertion between bottles (FIG. 28F).

Figure 29:
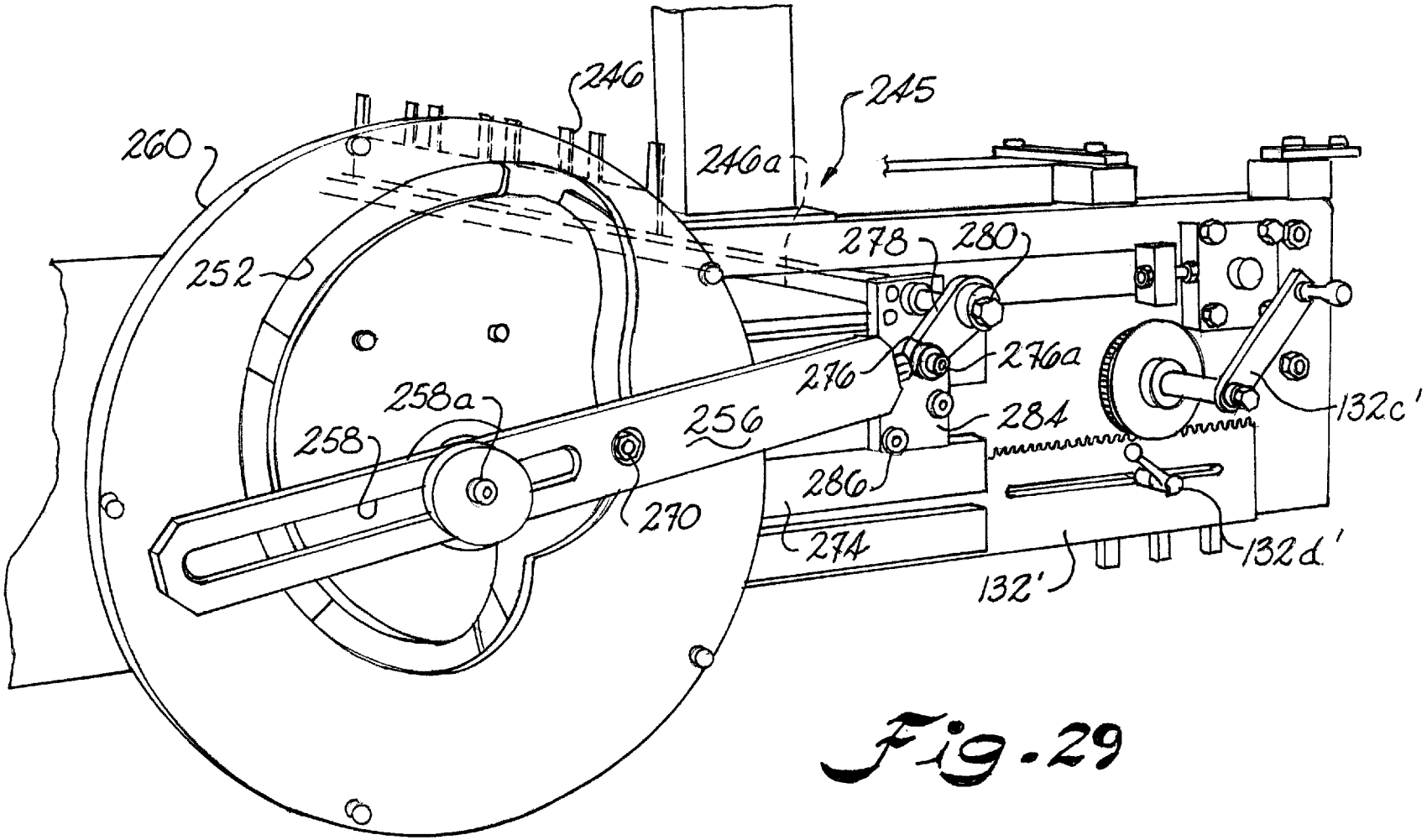
FIG. 29 is a prospective view of a metering section according to the invention wherein an alternate embodiment of a metering member is shown having upstanding posts.

Referring now to FIGS. 28D and 28E, it can be seen that as cam yoke 220 engages cam surface 242 pins 214 engage between bottles 13 to separate them into slugs along with a metering bar 246 (FIG. 29). In FIG. 28E, pins 214 are aligned directly with an entrance 244 which defines a crevice between adjacent bottles. As can best be seen in FIG. 28F, pins 214 is raised upwardly in the crevice between bottles by cam surface 242. Cam surface 242*a* imparts a slight forward rock to the pin bar and pins 214. Thereafter, as cam yoke 220 enters between cam bars 226*a* and 226*b* the pin bar is oriented substantially vertical so that pins 214 engage the back side of bottles 13 in a spaced apart manner, as can best be seen in FIGS. 25 and 27. In this condition, pin carrier assembly 206 is moving at a higher speed than conveyor 114 which is bringing bottles 13 into the metering section so that the bottles between pins 214 and a metering bar assembly 245 are separated and conveyed away as a slug.

As can best be seen in FIGS. 29 and 30A–30G, metering bar assembly, designated generally as 245, operates in synchronization with pin carrier assembly 206 much like metering block 124 and flight bar 122*a* of the embodiment of FIGS. 13A–13D and 14A–14D. Metering bar assembly 245 is disposed across each lane and includes a metering bar 246*a* having spaced pairs of posts 246 which move (pivot) in and out of the conveyance path of the articles in a cyclic manner to meter the number of articles in the slug along with pin bar assembly 206. A metering distance, defined between metering bar assembly 245 and pin bar assembly 206, determines the number of articles in the row and the size of the slug. Metering bar 246*a* is driven by a drive mechanism in cyclic movements in and out of the conveyance path independent of the revolving pin bar assembly 206 in any suitable manner such as by a drive mechanism disclosed in the embodiment of FIGS. 13 and 14. Since such a drive mechanism has already been described in detail, only so much of the drive mechanism as is necessary to understand the alternate embodiment will be referred to. The metering bar is reciprocated in synchronism with the drive of flight bar chain 204, and entire packer. In an advantageous embodiment of the invention, the drive mechanism for metering bar 246*a* is mounted on a movable carrier plate 132' like the embodiment in FIG. 13. The carrier plate may be shifted left and right using gear handle 132*c'* to vary the distance between metering bar and the pin bar assembly. In this manner, the size of the slug may be advantageously varied, or the metering section may be adjusted to handle different sized articles regardless of the slug size.

Figure 30A:
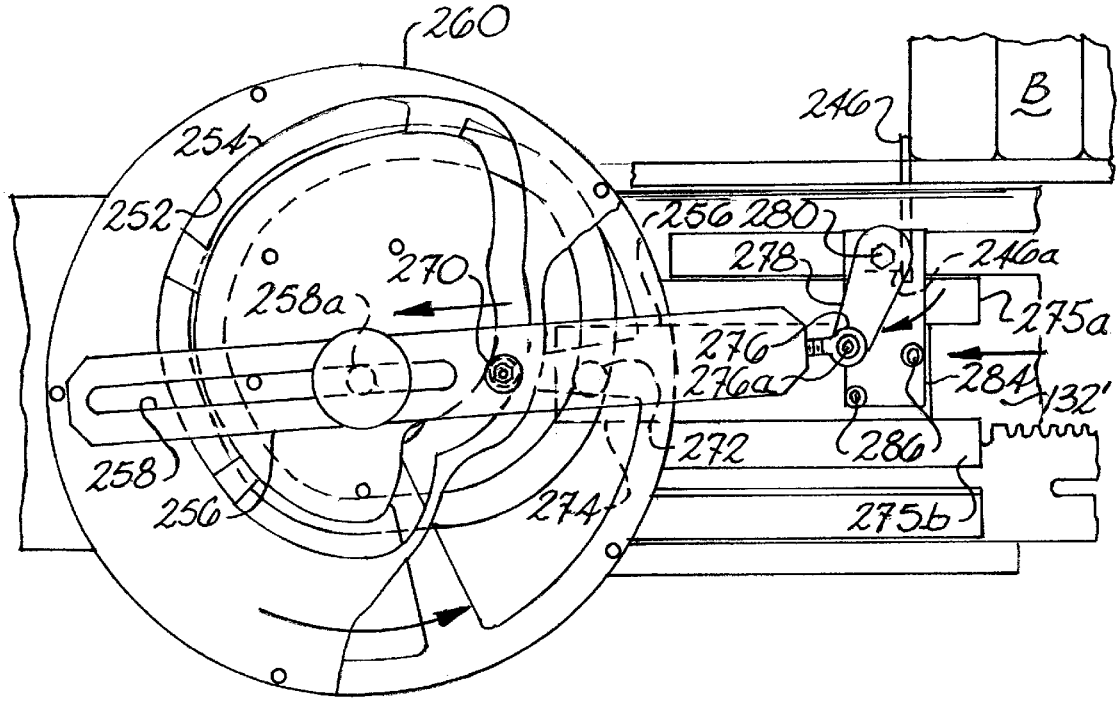
FIG. 30A is an elevation of a timing cam wheel for timing and imparting positional movements of a metering member in a metering section according to the invention with the metering member in an engaging position with respect to a front row of articles in a metered group of articles.
Figure 30B:
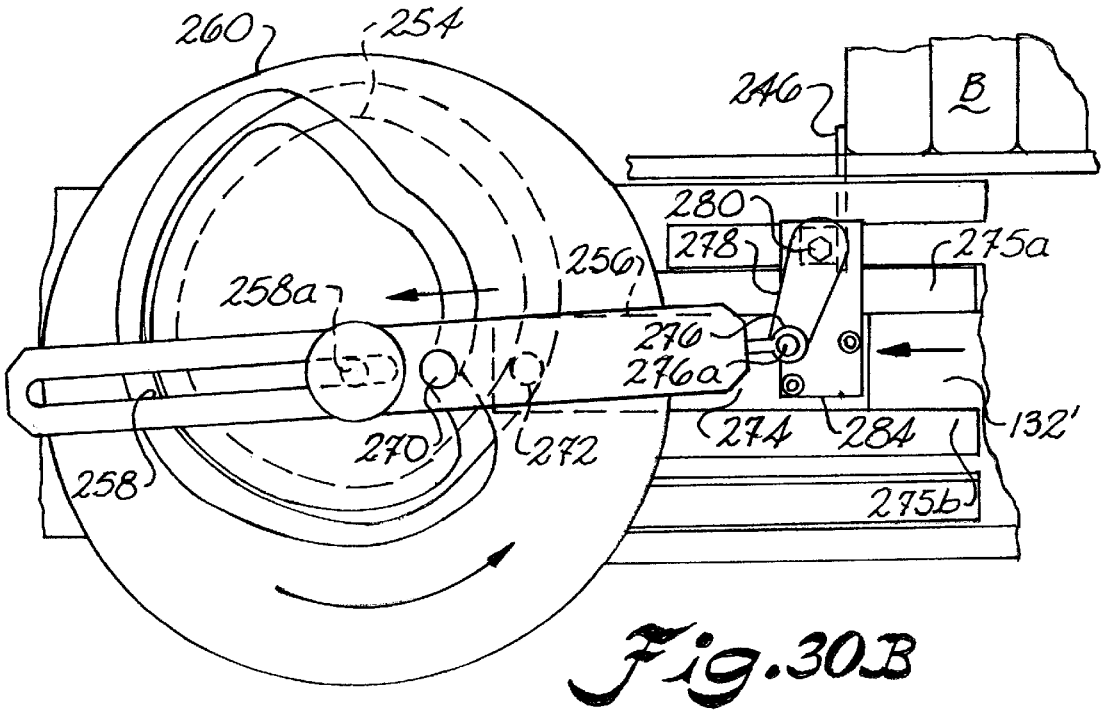
FIG. 30B is an elevation of the metering section with the timing cam in a position wherein the metering member has reached its left most position.

Referring to FIGS. 2 and 30A, 30B, it can be seen that timing cam plate 260 is carried on cam plate carrier 132' and includes an outer cam slot 252 and an inner cam slot 254 (FIG. 30A). An actuator linkage includes a link 256 having a longitudinal slot 258 which slides about a pivot 258*a* which secures actuator 256 to the adjustable cam carrier. Affixed to actuator link 256 is a cam follower or pin 270 which rides in cam slot 252. There is a second cam follower or pin 272 which rides in second cam slot 254. Cam pin 272 is affixed to a reciprocating linkage in the form of a bar 274 which reciprocates in linear movement. Reciprocating bar 274 slides between guide blocks 275*a,* 275*b,* which are affixed to carrier 132', as the bar reciprocates. At the end of actuator link 256 is carried a rod eye 276 having a pivot 276*a* secured to a crank arm 278 that is affixed to metering bar 246. Crank arm 278 is affixed to a bar 246*a* by means of a bolt 280. A vertical standard 284 is affixed by means of bolts 286 to reciprocating bar 274. Standard 284 provides a pivot support for crank arm 278 and metering bar 246. The entire assembly thus described moves with timing cam carrier 132', as described above, to adjust the distance "L".

Figure 30C:
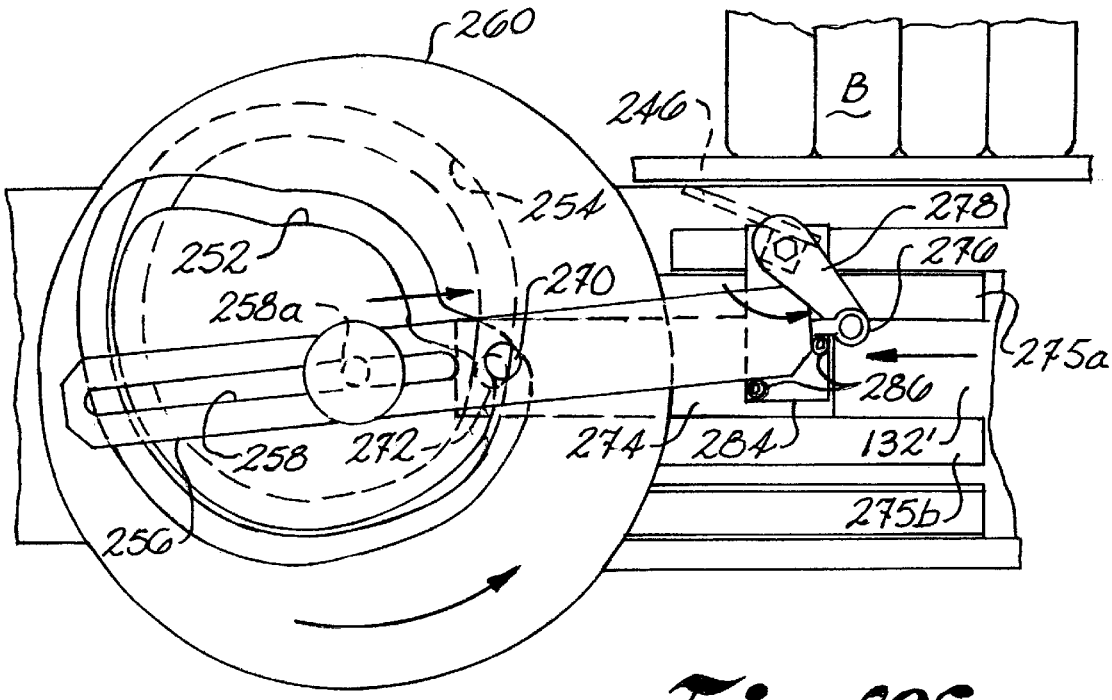
FIG. 30C is an elevation of a metering section of the invention wherein the timing cam has moved so that the metering member has pivoted out of the path of conveyance of the articles.
Figure 30D:
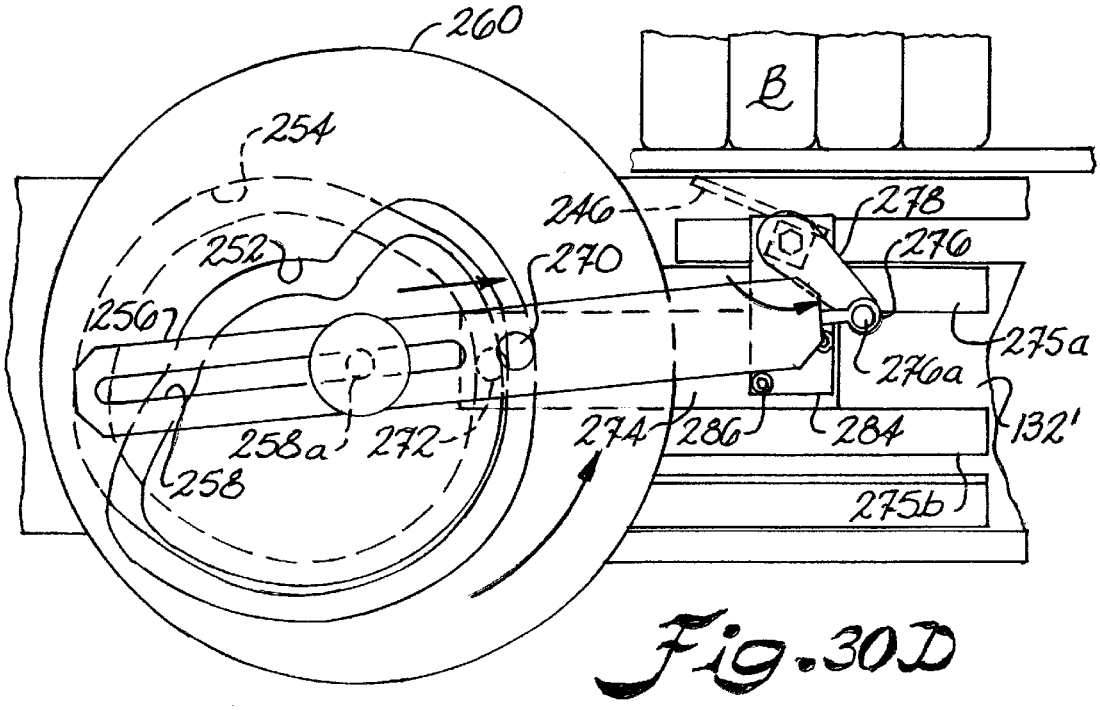
FIG. 30D is an elevation of a metering section wherein the timing cam has moved to return the metering member to the right to begin a new metering cycle.
Figure 30E:
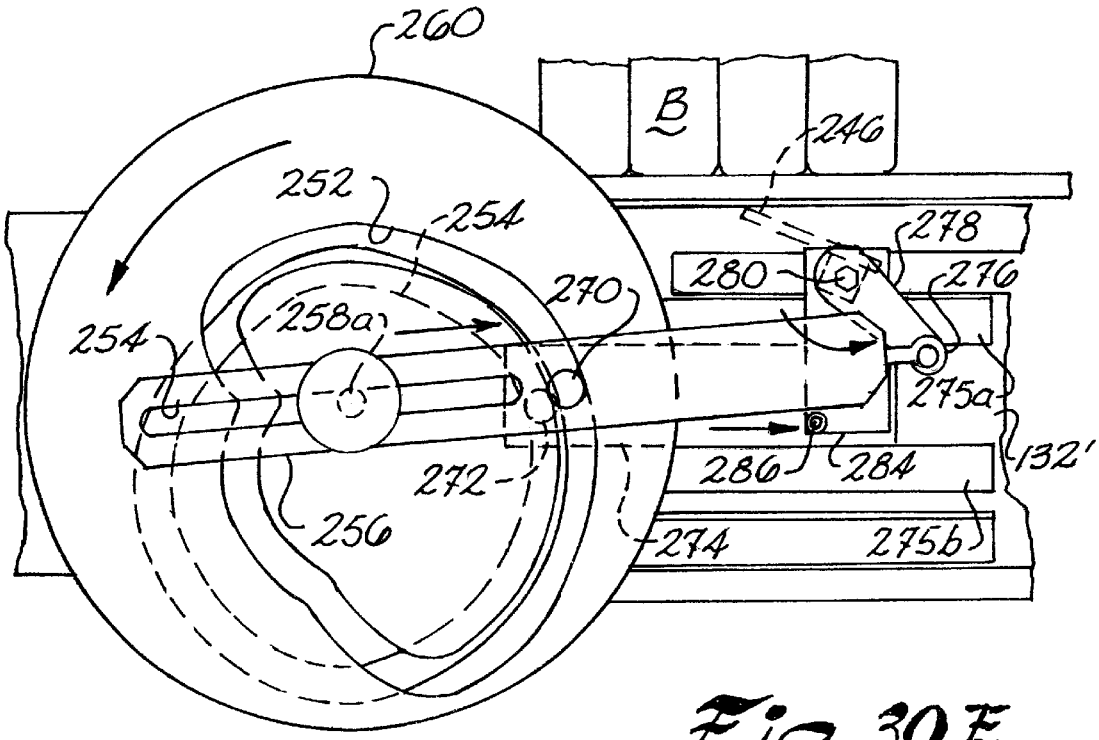
FIG. 30E is an elevation illustrating the metering section wherein the timing cam wheel has moved to position the metering member further to the right in readiness for the upward movement of the metering member.
Figure 30F:
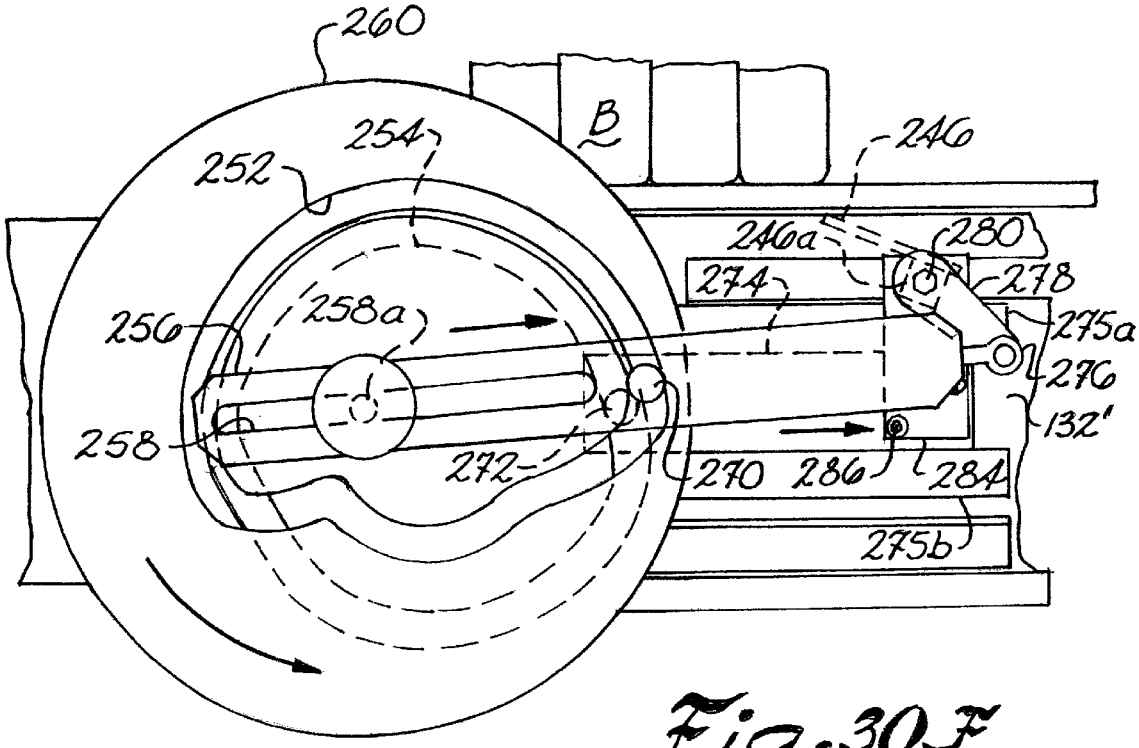
FIG. 30F is an elevation illustrating the metering section with the timing wheel moved so that the metering member has traveled further to the right.
Figure 31:
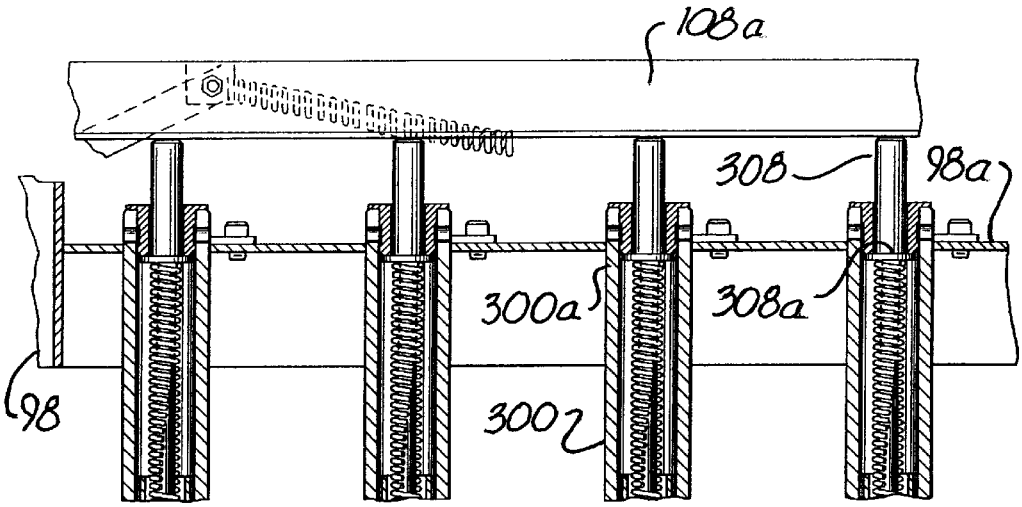
FIG. 31 is an elevation showing actuation of improved gripper tubes according to the invention.

The cyclic movement of metering bar 246 will now be described referring to FIGS. 30A–30G. First, it will be noted that reciprocating bar 274 reciprocates in linear movement between guide blocks 275*a* and 275*b* under control of cam pin 272 as it rides in cam slot 254. Simultaneously, actuator link 256 undergoes angular and linear motion as cam pin 270 rides in cam slot 252. It is noted that cam slot 252 is formed on the front of timing cam 260 while cam slot 254 is formed in the back side of the timing cam. Thus, metering bar posts 246 will pivot up and down and reciprocate back and forth under the combined actions of actuator link 256 and reciprocating bar 274. In FIG. 30A, metering posts 246 are in a first, up position in which they engage the front articles in a slug of articles. In FIG. 30B, reciprocating bar 274 has moved to it forward most left position and at that time, metering bar (posts) 246 is pivoted to a second, down position in FIG. 30C. In FIG. 30C the reciprocating bar has reached its left limit position and the reciprocating bar begins to travel to the right as shown in FIG. 30D. At this time metering posts 246 are still in the down position. The slug of articles is conveyed to the left in FIG. 30E while the metering bar, in down position, continues to travel to the right so that posts 246 engage the front articles of another slug of articles. FIG. 30F, reciprocating bar 274, reaches its right most position and the metering bar is about to the pivoted to the first, up position, as shown in FIG. 38, as a reciprocating bar against its travel to the left. As noted above, the metering bar has moved in synchronization with the pin bar assembly 260 so that the pin bar parts engage the front of a slug of articles as the pins 214 of the pin bar begin to insert behind the back row of the articles in a slug for separation of the slug from the stream of articles upstream. The operation and synchronization of the metering bar and pin bar assembly are to be carried out in the same manner as the metering block and flight bars described in the first embodiment of the invention.

As previously described, the continuous motion apparatus of the present invention, as shown in FIGS. 1–11, can be used for unpacking bottles or other articles from cases as well as packing bottles and articles into cases. When used as an unpacking or depacking continuous motion apparatus the machine is reversed in its operation. When the apparatus is run in the reverse direction, minor adjustments need to be made to the apparatus as will be well within the purview of one skilled in the art having been taught the advantageous and features of the present invention. For example, referring to FIG. 2A, in the depacking mode, revolving carriage C and transfer arms 20 revolve in a counterclockwise direction. Article pick-up heads 2, 24 are lowered into a case having empty bottles, grip the necks of the bottles, lift the bottles out of the case, and place the empty bottles on a conveyor at a station 16 which is a deposit station rather than a pick-up station. For this purpose, an index conveyor, such as illustrated in FIG. 2A, will be used to convey the cases and empty bottles beneath the pick-up heads in synchronization. The empty bottles will be deposited and released upon a conventional outfeed conveyor at the release station. The empty bottlers will be conveyed away for further processing in a conventional manner. In addition, cam tracks 88, 96 will be replaced with modified cam tracks to provide proper positioning and timing of the pick-up heads for depacking, as is well within the purview of the average artisan. In essence, the entire apparatus is operated in a reverse direction with minor adjustments. In this case, the means for presenting the articles in the form of a slug or group of articles at the pick-up station will be the case-contained group of empty bottles or articles.

In the unpacking of bottles, the problem often occurs that a bottle will be turned upside down in a case. In the case of conventional article grippers, none of the grippers would be allowed to grip bottles in the case because the upside down bottle will limit the downward travel of the gripper head. Thus, the entire case of empty bottles will proceed along and crash. This problem is overcome in accordance with the present invention as described below.

Referring now to FIGS. 32A through 36C, another embodiment of an article gripper or gripper tube 300 is illustrated which has particular utility when the machine is operated in a depacking mode, but may also be used for packing.

Figure 33:
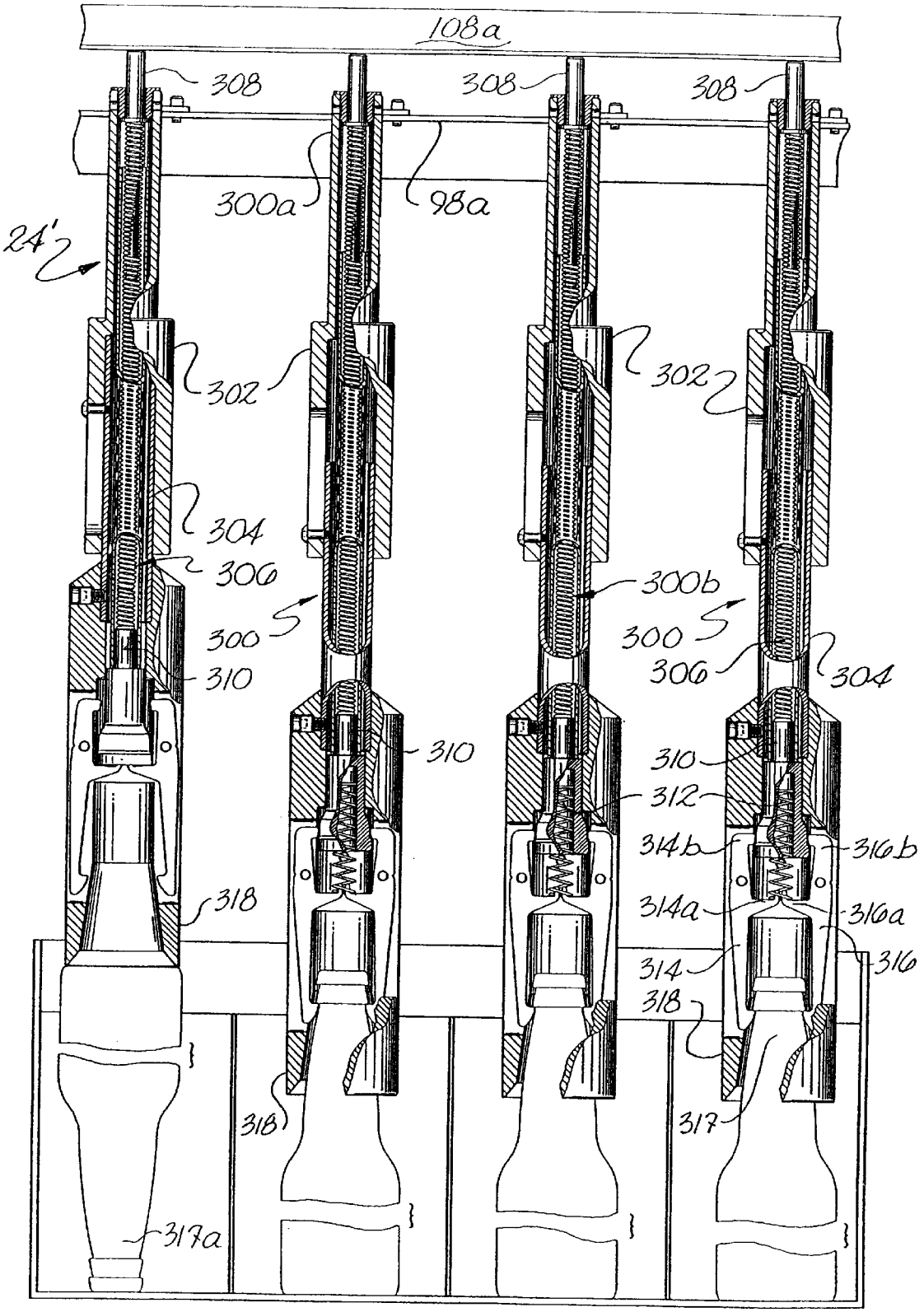
FIG. 33 is an elevation of a front row of gripper tubes of a pick-up head according to the invention illustrating the two axial positions of the gripper tubes, a first axial position in which the gripper tubes have a standard length for gripping articles in an upright configuration and a second axial position in which the effective length of the gripper tube is shortened upon engagement with an inverted article.

In this case, gripper head 24 includes frame 98 which holds an array of gripper elements or tubes 300 affixed thereto in a manner that can best be seen in FIG. 33. Basically, gripper tubes 300 include attachment ends 300*a* affixed to frame plates 98*a* as shown. A gripper tube actuator includes a reciprocating mechanism, designated generally as 300*b*, carried within gripper tubes 300. Whereas the reciprocating mechanism is comprised of a non-compressible rod 99*b* or 109*a* in the previously disclosed embodiments of FIGS. 11–11E, reciprocating mechanism 300*b* is illustrated now as a compressed spring mechanism which acts as a solid, non-compressible member until a sufficient load is placed on it. After being sufficiently loaded, the spring mechanism of the gripper tube compresses. This is an expedient where grid set 24 is used in the present apparatus when operating in a depacking mode, and an inverted bottle is encountered so that the remaining gripper tubes are allowed to operate normally (FIG. 33).

Figure 32A:
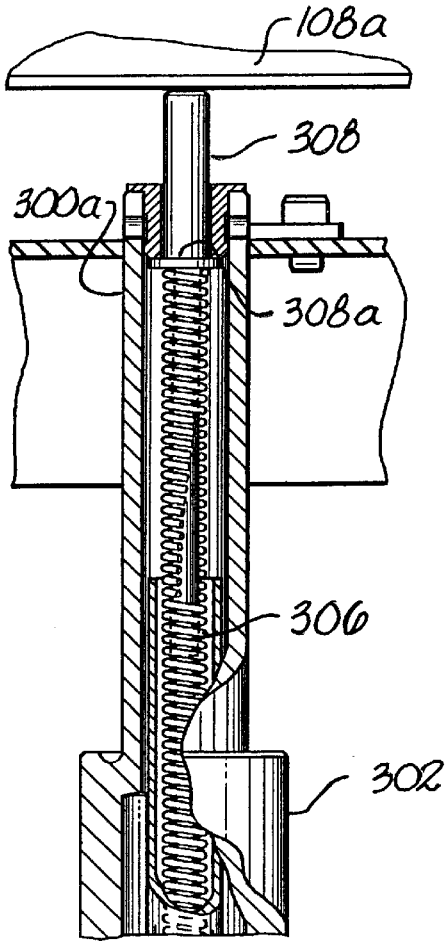
FIG. 32A is an enlarged elevation illustrating a pick-up head actuator in a non-actuator position.
Figure 32B:
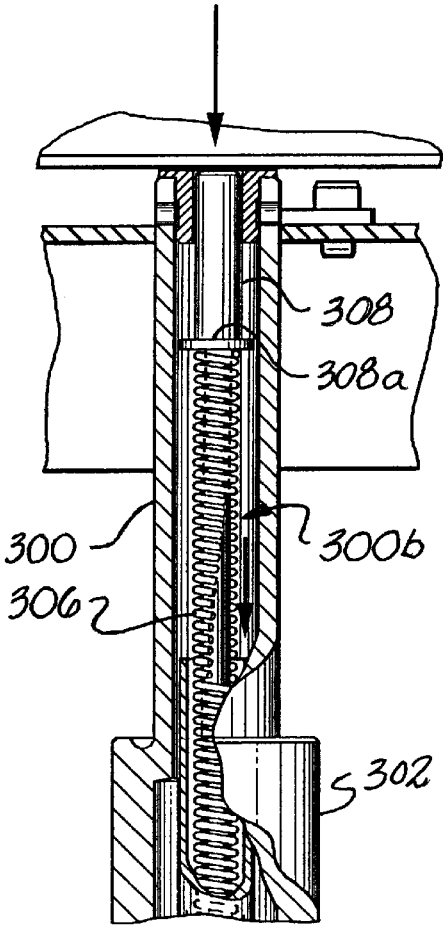
FIG. 32B is an enlarged elevation illustrating the pick-up head actuator in a actuating position for releasing articles.
Figure 32C:
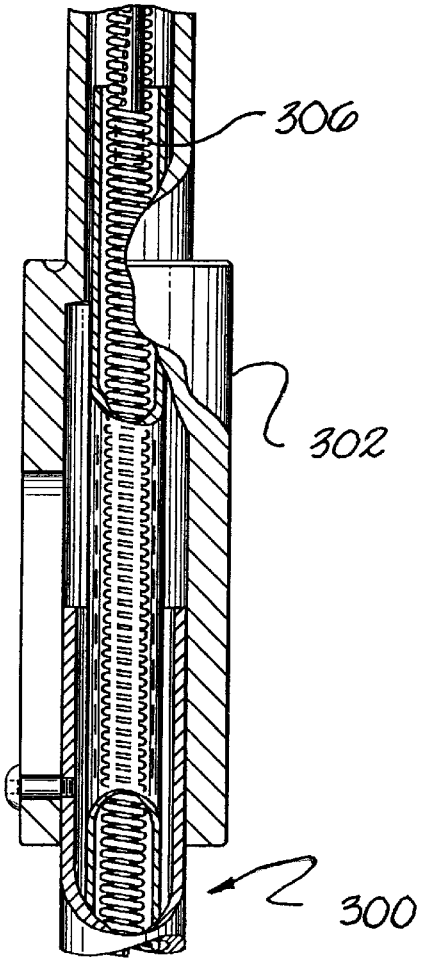
FIG. 32C is a partial elevation with parts cut away illustrating a retracting mechanism according to the invention which acts as a solid member to grip an upright article but allows the gripper end of the gripper tube to yield upon engagement with an inverted article.
Figure 32D:
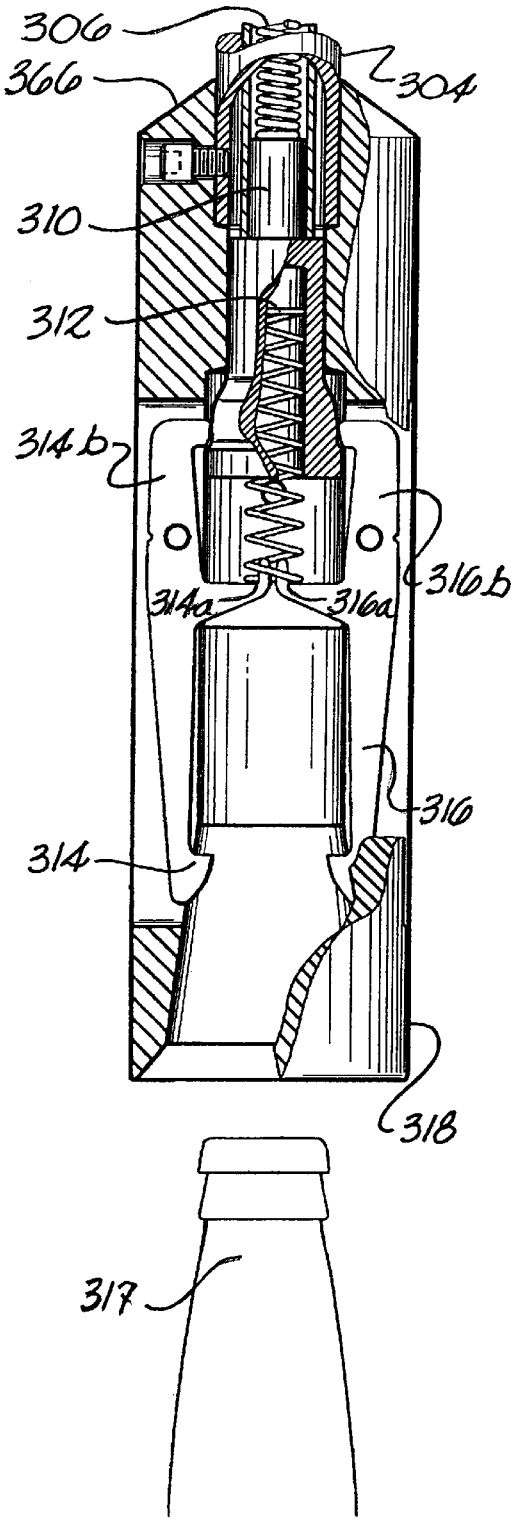
FIG. 32D is an illustration of the gripper end of a gripper tube according to the invention with parts cut away prior to gripping an article.

Article gripper 300 includes a tube slip collar 302 which is slidably received over an inner tube 304. As can best be seen in FIG. 32A, B, reciprocating mechanism 300*b* includes a spring 306 having a first end which abuts a flange 308*a* of an actuator button 308. Actuator button 308 is actuated by an actuator bar 108*a* of FIGS. 11–11E. However, in this embodiment, it is preferred that actuator bar 108*a* be actuated by a loading cam for gripping and an unloading cam for releasing in the form of abutments such as 80 and 82 properly place along the cam track of the pick up head. When bar 108*a* depresses button 308, the gripper jaws of the gripper end of the gripper tubes are spread open (FIG. 32D). When the button 308 is released, the gripper jaws are spring biased to a closed position (FIG. 32D) The remote end of spring 306 engages a gripper or jaw actuator 310 (FIGS. 32D, E, F). There is a gripper or jaw actuator mechanism which includes an actuator spring 312 having an upper end received in a hollow interior 310*b* of the jaw actuator. A lower open end coil of spring 312 receives jaw hooks 314*a*, 316*a* of gripper jaws 314, 316 which are normally closed.

Figure 32E:
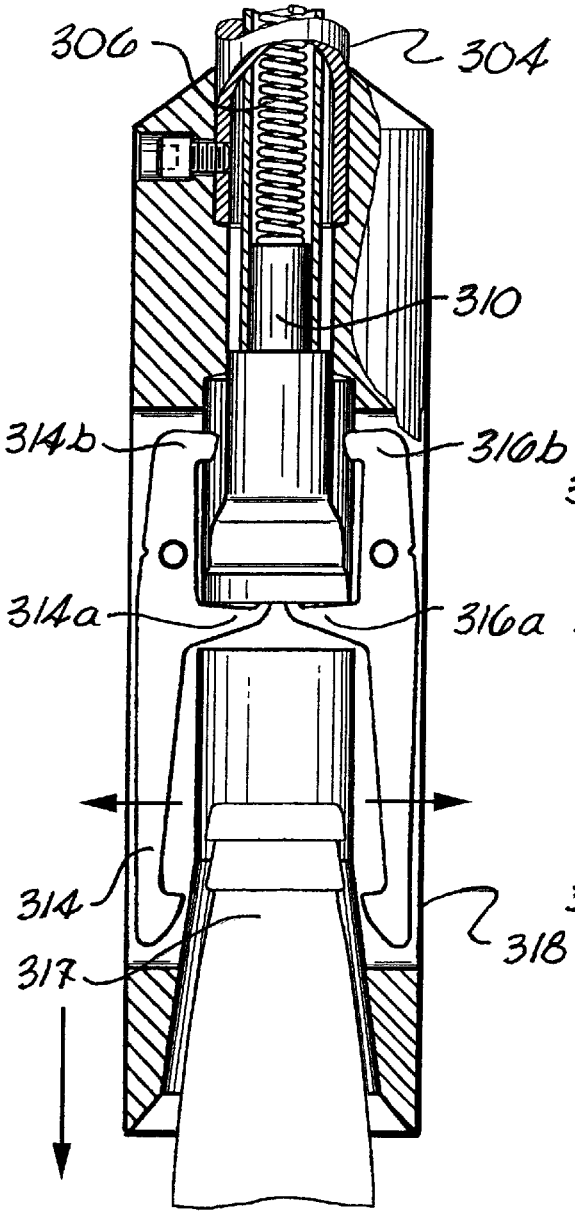
FIG. 32E is a partial elevation of the gripper end of a gripper tube according to the invention with parts cut away showing the gripper jaws in an actuated, open position prior to pick up.
Figure 32F:
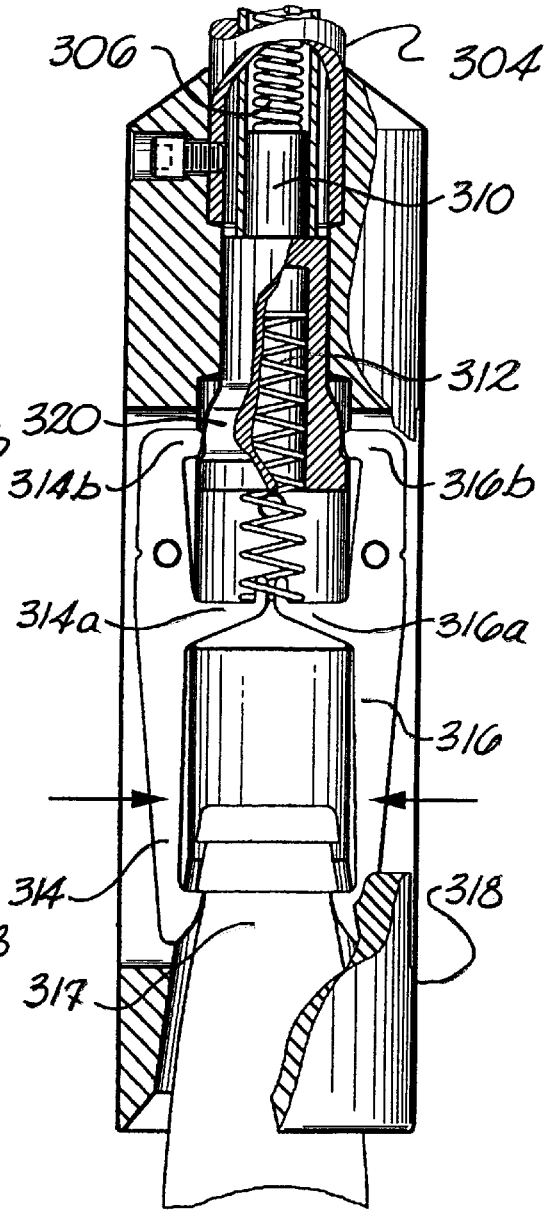
FIG. 32F is an elevation with parts cut away illustrating the gripper end of a gripper tube according to the invention with the gripper jaws in a spring-biased closed, grip position.

In operation, when actuator bar 108*a* is activated, actuator button 308 is depressed causing spring 306 to exert downwardly on jaw actuator 310. In return, spring 312 pushes down on jaw hooks 314*a*, 314*b* causing jaws 314, 316 to open (FIG. 32E). After profiled body 318 is received over neck 317 of the bottle, actuator bar 108*a* is retracted causing jaws 314, 316 to close under the spring release force of 312, and the engagement of upper ends 314*b*, 316*b* of the jaws with a locking taper 320 which holds the jaws closed around the neck of the bottle (FIG. 32F). As long as all of the bottles 317 are upright the continuous motion apparatus will operate in the depacking mode without any problem. In the event that one or more bottles is inverted in the case, as depicted at the left bottle in FIG. 33, the gripper head of the present embodiment will operate as follows.

Referring to the left most article gripper 300 and inverted article 13 in FIG. 3, it will be noted that the remaining article grippers have successfully gripped the neck of bottles 317 as described above. When operated in the depacking mode and inverted bottle 317*a* is encountered, the gripper head 24' and article tubes 300 will operate as follows. The left most article gripper 300 has assumed the following position. Profile body 318 has encountered and struck the bottom of inverted bottle 317*a*. This has caused spring 306 to be sufficiently loaded to compress and inner tube 304 slides within slip collar 302. The end of inner tube 304 has abutted the end of slip collar 302, as seen in FIG. 33. When inner tube 304 reaches the limit of its upward movement as shown, compression of spring 306 has taken place. This allows the gripper head 24' to continue to descend so that the remaining article grippers 300 can grip the upright bottle as shown. For this purpose, it will be noted that the spring rate of spring 306 is greater than the spring rate of spring 312; about 7 pounds per inch and about 4.8 pounds per inch, respectively. This allows spring 312 to normally compress without any compression of spring 306 for gripper jaw actuation in normal operation. However when an inverted bottle is encountered by an article gripper, spring 306 is compressed allowing the remaining article grippers to operate normally as described above. For example, spring 306 may have a spring rate of 7, and spring 312 may have a spring rate of 4.

Thus, it can be seen that the gripper tube compresses to a shortened axial length when encountering an abnormal condition such as when striking an inverted article, an out of position article, or any other miscellaneous obstruction like broken glass.

Figure 34A:
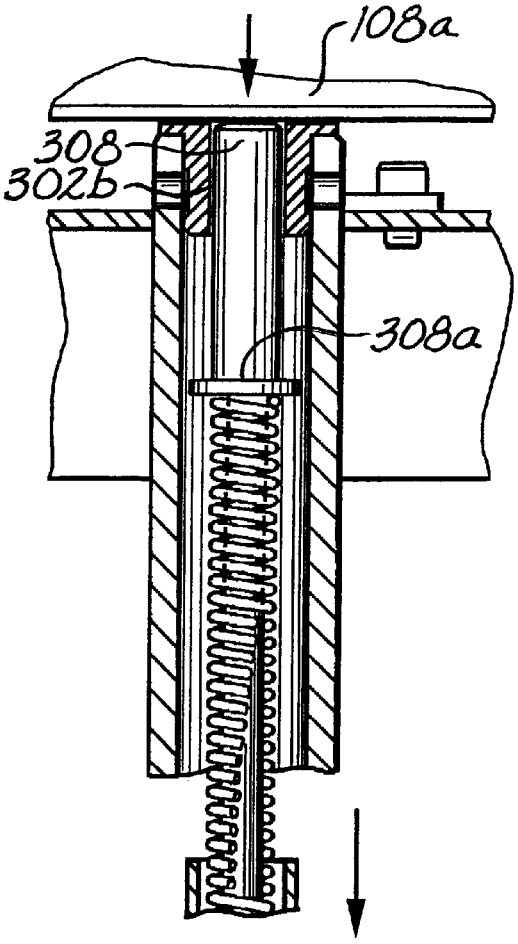
FIG. 34A is a prospective view of the button actuator of a gripper tube according to the invention with the pick-up head actuator in an actuating position to open the gripper jaws when the pick-up head is actuated by an unloading cam.
Figure 34B:
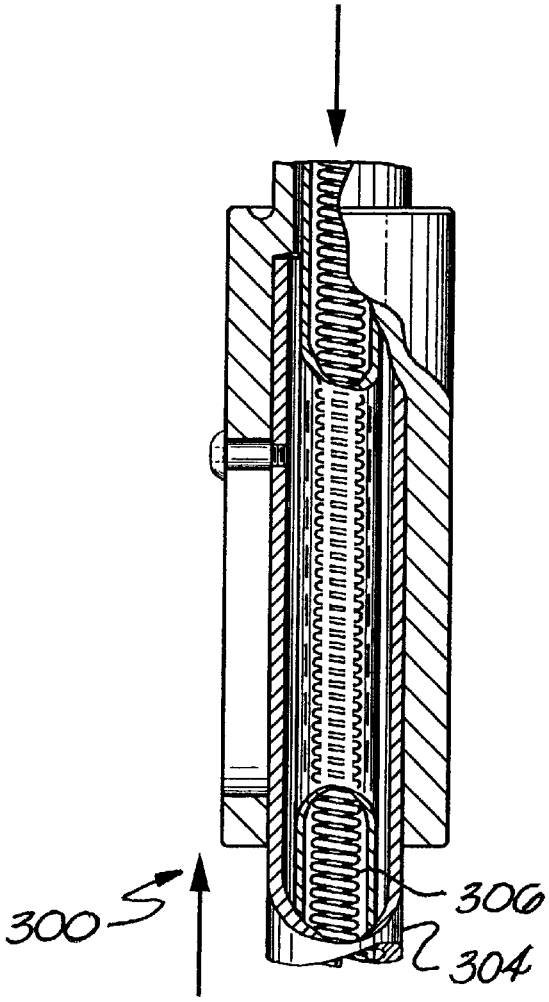
FIG. 34B is a partial elevation with parts cut away showing the retracting mechanism wherein a spring of the retracting mechanism is compressed.
Figure 34C:
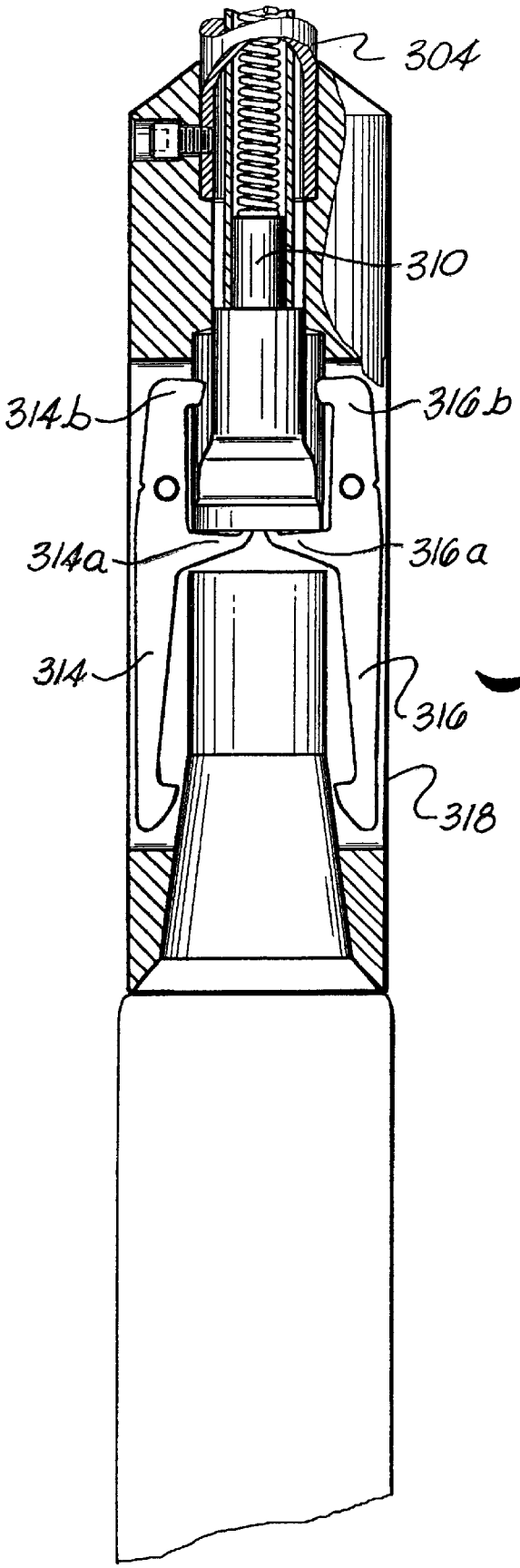
FIG. 34C is a partial elevation with parts cut away of a gripper according to the invention showing the gripper jaws spread open when the actuator button is depressed as in FIG. 34A prior to gripping.
Figure 35:
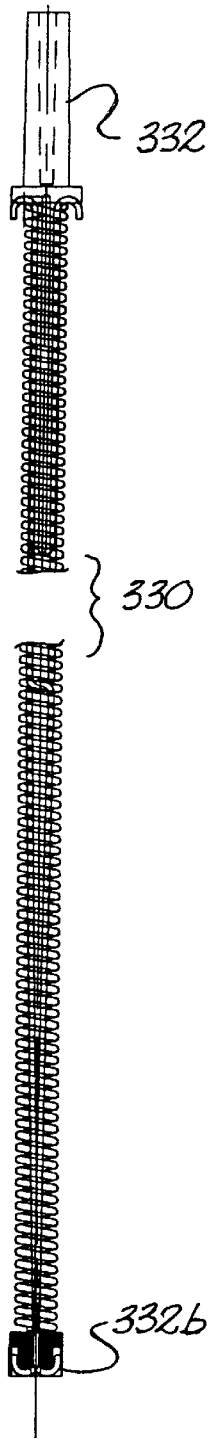
FIG. 35 is an elevation of a one piece spring assembly for a retracting mechanism according to the invention.
Figure 36A:
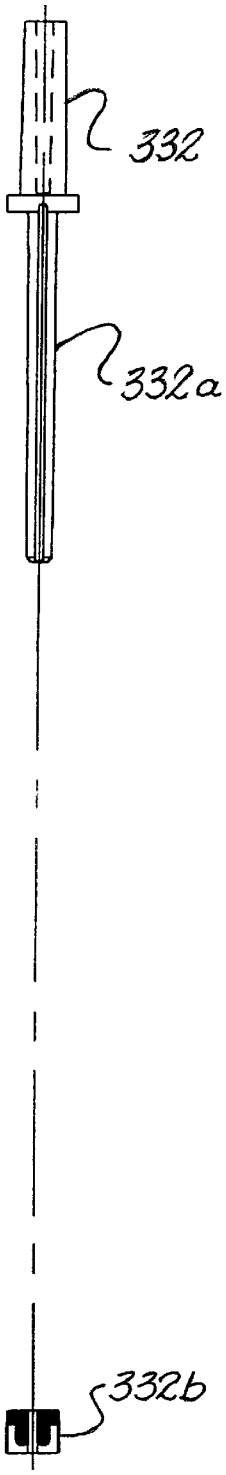
FIG. 36A is an elevation with parts removed of an actuator button and an end cap for a spring assembly according to the invention.
Figure 36B:
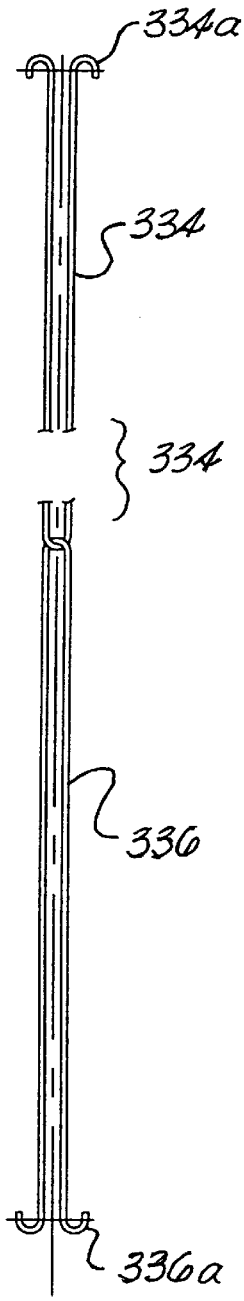
FIG. 36B is an elevation of a wire travel movement limiter
Figure 36C:
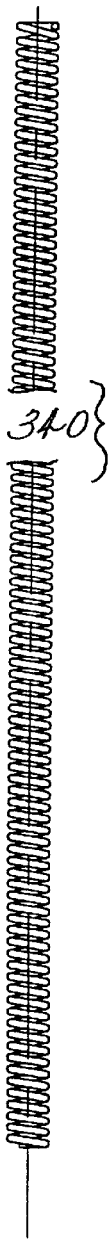
FIG. 36C is a side elevation of a compression spring for a gripper actuator according to the invention.

FIGS. 35–36C show an alternate arrangement for a reciprocating mechanism 330 of a gripper head actuator which is particularly advantageous as a one-piece construction which is pre-compressed and ready for installation. Reciprocating mechanism 330 may be used in lieu of reciprocating mechanism 300*b*. In the case of reciprocating mechanism 330, the mechanism is completely self-contained and preloaded, whereas in the embodiment of mechanism 300*b*, washers or spacers may be needed between flange 308*a* and the end of spring 306 to preload the spring at a desired compression (FIG. 34A). The unitary construction of mechanism 330 includes an integral actuator button 332 having a thin insert rod 332*a*. An actuator button on cap 332*b* is embedded or carried on the opposing end of the mechanism. There are a pair of spring loops 334 and 336 having their bends interlooped (FIG. 36B). Opposing ends of the loop springs include hooks at 334*a* and 336*a*, respectively. A compression spring 340 is received over the looped spring construction. Hooks 334*a* are fixed in actuator button 332, and hooks 336*a* are affixed to end cap 332*b*. Thus the reciprocating mechanism is one piece and preloaded. Again reciprocating mechanism 330 acts as a solid member until an upside down bottle is encountered whereupon loop springs 334, 336 are allowed to move relative to each other allowing spring 340 to press. In this manner the remaining article grippers are allowed to descend and grip the right bottles.

Thus, it can be seen that a advantageous construction can be had for a continuous case packing and depacking apparatus can be had according to the invention wherein, in a packing mode, articles may be positively held by article pick-up heads for reliable transfer from a pick-up position over a linear section in which no horizontal acceleration occurs, and a vertical descent for case packing is smooth and gentle. Alternately, the apparatus may be operated in a depacking mode wherein the problem of inverted bottles is overcome in a reliable manner. A slug feeder B and adjustable metering mechanism are provided which facilitate a quick and easy changeover to the packaging of different sizes of articles and slugs without the time consuming replacing of parts and down time.

While a preferred embodiment of the invention has been described using specific terms, such description is for illustrative purposes only, and it is to be understood that changes and variations may be made without departing from the spirit or scope of the following claims.

What is claimed is:

1. Apparatus for continuously transferring articles from a pick-up station to a release station which includes a first conveyor for conveying the articles to the pick-up station and a second conveyor for conveying said articles away from said release station, said apparatus comprising:

a plurality of article transfer arms;

a plurality of article pick-up heads carried by said transfer arms for picking up said articles at said pick-up station and for releasing said articles at said release station;

a plurality of article gripper tubes included in said pick-up heads having grippers which retain said articles in a gripped position and release said articles in a release position;

said gripper tubes having a first part and a second part, and said first and second parts being axially movable relative to each other;

said first and second parts of said gripper tubes having a first relative axial position in which said gripper tubes have standard lengths for gripping articles in an upright configuration;

said first and second parts having a second relative axial position in which said gripper tubes have an effectively shortened length when engaging an article in an upside down configuration so that the remaining article grippers in a pick-up head may grip articles which are in said upright configuration;

a revolving carriage continuously moving said transfer arms along a path between said pick-up and release stations to continuously move said pick-up heads and articles from said pick-up station to said release station;

a pick-up head actuator for actuating said gripper tubes to assume said gripped position at said pick-up station and to assume said release position for releasing said articles at said release station;

said first part of said gripper tubes including a slip collar, and said second part including an inner tube slidably received in said slip collar; and a reciprocating mechanism carried interiorly within said slip collar biasing and maintaining said inner tube in said first axial configuration.

2. The apparatus of claim 1 wherein said reciprocating mechanism is carried between said tube parts which is biased in such a manner that said second axial configuration is not reached unless a prescribed biasing force is overcome.

3. The apparatus of claim 2 wherein said first axial configuration is maintained by said reciprocating mechanism prior to said prescribed biasing force being overcome.

4. The apparatus of claim 3 including:

said reciprocating mechanism includes a first spring having a first spring rate;

article grippers carried by remote ends of said gripper tubes; and a gripper actuator having a second spring connected between said reciprocating mechanism and said grippers.

5. The apparatus of claim 4 wherein said first spring rate is greater than said second spring rate so that said first spring mechanism acts as a solid elongated member until a sufficient load is placed on it which occurs as said gripper tube encounters striking an article in an upside down configuration, an article out of position, or miscellaneous obstructions.

6. The apparatus of claim 4 wherein said reciprocating mechanism comprises:

a plunger carried on a first end of said reciprocating mechanism;

said first spring terminating in an actuator end which seats against said gripper actuator for opening and closing said grippers.

7. The apparatus of claim 6 wherein said grippers include a plurality of jaws which grip the upper ends of said articles in said upright configuration.

8. The apparatus of claim 6 including:

a first spring assembly having a spring travel limiter;

said first spring comprising a compression spring received around said travel limiter;

a spring actuator cap carried by a first end of a travel limiter for engaging said compressed spring, and a gripper actuator spring seat carried by a second end of said travel limits for engaging an opposite end of said spring so that said first spring is compressed to a length to provide a preset spring rate and a standard installation length.

9. The apparatus of claim 8 wherein said spring rate of said first spring is about 7 pounds per inch.

10. The apparatus of claim 9 wherein the spring rate of said second spring is about 4.8 pounds per inch.

11. The apparatus of claim 1 wherein said gripper tubes include:

an outer slip collar;

an inner tube slidably received within said slip collar;

an actuator button extending from a free end of said slip collar;

said reciprocating mechanism including a first spring carried within said inner tube having a first end engaging said actuator button, said first spring having a second end seated on a gripper actuator which operates pivoting gripper jaws between open and closed configurations.

12. The apparatus of claim 11 comprising:

a second spring having a first end acted upon by said gripper actuator, and a second end engaging said gripper jaws for actuating said gripper jaws between said open and closed configuration.

13. The apparatus of claim 12 wherein said spring rate of said first spring allows said first spring to act generally as a solid elongated element to depress said actuator button and compress said second spring in normal operation to grip and release upright articles.

14. The apparatus of claim 12 wherein said first spring has a spring rate greater than the spring rate of said second spring so that said slip collar and inner tube slide relative to each other when said gripper tube encounters striking an article in an upside down configuration, an article out of position, or miscellaneous obstructions whereby the remaining article gripper tubes are allowed to grip the articles in an upright configuration.

15. The apparatus of claim 1 comprising:

a plurality of reciprocating grid heads carried by said transfer arms in alignment with said grid heads;

said grid heads having an array of grid chutes arranged in a matrix corresponding to an array of said articles in said slug;

said grid cutes having an open position in which said articles may be received within said chutes, and said chutes having a closed position in which said articles are retained within said chutes for transfer to said release station;

a vertical motion mechanism for lowering said grid head over said slug of articles at said slug pick-up station with said chutes in said open position; and a grid actuator having first position in which said grid chutes are closed at said pick-up station so that said articles are retained within said grid chutes for transfer, and said actuator having a second position in which said grid chutes are open at said release station for releasing said slug of articles into said case.

16. The apparatus of claim 1 including a profiled body carried by said second tube part in which said article grippers are carried and generally surrounded.

17. Apparatus for continuously transferring articles from a pick-up station to a release station comprising:

a plurality of transfer arms disposed about a common plane;

a plurality of article pick-up heads carried by said transfer arms, said pick-up heads having an array of article grippers carried by a pick-up head frame for gripping said articles for transfer;

a carriage carried by a frame for moving said transfer arms between said pick-up station and said release station along said common plane;

a motion mechanism operatively associated with said pick-up heads for positioning said pick-up heads over said articles for pick up at said pick-up station, and for positioning said articles for release at said release station; and a plurality of gripper tubes carrying said article grippers individually on said pick-up head frame having movable tube parts adapted for relative vertical movement along a vertical gripper axis so that an article gripper tube is displaced along said vertical axis in the event the gripper tube engages an article in an inverted configuration and the remainder of said article grippers pick up the articles in an upright configuration; and a yieldable gripper tube actuator carried interiorly within said gripper tube for actuating said article grippers and said gripper tube actuator being yieldable along said vertical gripper axis when said gripper tube engages said inverted article, wherein said yieldable actuator has a compressed configuration when engaging said inverted article and a operating configuration extended from said compressed position when gripping said articles.

18. The apparatus of claim 17 wherein said article grippers include pivoting gripper jaws constructed and arranged to engage said articles, said gripper jaws including a gripper actuator which is biased in a jaw closing direction, and said gripper jaw actuator includes a tapering surface which continuously urges said gripper jaws progressively towards said article for progressively gripping said articles with differently dimensioned biasing areas in said jaw closing direction.

19. The apparatus of claim 17 comprising:

a case indexing conveyor for conveying indexed cases to said pick-up station containing the articles in synchronization with said moving carriage;

said case indexing conveyor extending in longitudinal alignment with said article feeder and indexing said cases at prescribed intervals in synchronization with said article feeder and said transfer arms; and a synchronized drive for said case indexing conveyor and said carriage for feeding and conveying said articles and said cases in unison.

20. The apparatus of claim 17 wherein said carriage moves said transfer arms along a vertical plane having a linear transfer section between said pick-up and case packing stations to transfer said slug of articles.

21. The application of claim 17 including slug feeder having a slug feed conveyor, a slug metering section, and spaced side rails defining at least one lane for receiving a row of articles which extends through said slug conveyor and slug metering sections; and said slug metering section includes a revolving flight bar mechanism having a plurality of article engaging members which engage a last of said articles in a slug to separate said articles into slugs.

22. The apparatus of claim 21 including a metering member disposed in each lane, and wherein a distance generally defined between said metering member and said revolving article engaging member determines the number of articles in a row of said slug of articles.

23. The apparatus of claim 22 wherein said metering member and is carried by an adjustable carrier by which said distance between said metering block and said flight bar may be adjusted so that said number of articles in said row may be adjusted.

24. The apparatus of claim 17 wherein said article grippers include:

gripper tubes having a grip position in which said articles are retained by said pick-up head at said pick-up station for transfer, and a gripper actuator having a release position in which said articles are released from said pick-up head at said release station;

said gripper tubes having a first effective axial length for picking up articles at said pick-up station when said articles are in said upright configuration, and said gripper tubes having a second effective axial length which is shortened relative to said first axial length for engaging an article at said pick-up station in said inverted configuration.

25. The apparatus of claim 24 wherein said gripper tubes include a first part and a second part being axially movable relative to each other; and a gripper carried near an end of said second part.

26. Apparatus for continuously transferring articles from a pick-up station to a release station which includes a first conveyor for conveying the articles to the pick-up station and a second conveyor for conveying said articles away from said release station, said apparatus comprising:

a plurality of article transfer arms;

a plurality of article pick-up heads carried by said transfer arms for picking up said articles at said pick-up station and for releasing said articles at said release station;

a plurality of article gripper tubes included in said pick-up heads having grippers which retain said articles in a gripped position and release said articles in a release position;

said gripper tubes having a first tube part and a second tube part, and said first and second tube parts being axially movable relative to each other;

said first and second tube parts of said gripper tubes having a first relative axial position in which said gripper tubes have standard lengths for gripping articles in an upright configuration;

said first and second tube parts having a second relative axial position in which said gripper tubes have effectively shortened length when engaging an inverted article in an upside down configuration so that the remaining article grippers in a pick-up head may grip articles which are in said upright configuration;

a revolving carriage continuously moving said transfer arms along a path between said pick-up and release stations to continuously move said pick-up heads and articles from said pick-up station to said release station; and a gripper actuator for causing said article grippers to assume said gripped position at said pick-up station and to assume said release position for releasing said articles at said release station;

a gripper tube actuator carried interiorly within said gripper tube for actuating said gripper actuator; and a generally compressible, reciprocating mechanism included in said gripper tube actuator which engages said gripper actuator, said reciprocating mechanism having a compressed configuration when said first and second tube parts assume said second axial relative position so that said gripper tube yields when said gripper tube engages an inverted article.

27. The apparatus of claim 26 wherein:

said reciprocating mechanism includes a first spring having a first spring rate;

article grippers carried by remote ends of said gripper tubes; and said gripper actuator having a second spring having a second spring rate connected between said reciprocating mechanism and said grippers.

28. The apparatus of claim 27 wherein said first spring rate is greater than said second spring rate so that said reciprocating mechanism acts as a solid elongated member until a sufficient load is placed on it which occurs as said gripper tube encounters said inverted article or other abnormal article condition.

29. The apparatus of claim 27 wherein said reciprocating mechanism comprises:

a plunger carried on a first end of said reciprocating mechanism;

said first spring terminating in an actuator end which seats against said gripper actuator for opening and closing said grippers.

30. The apparatus of claim 29 wherein said grippers include a plurality of jaws which grip the upper ends of said articles in said upright configuration.

31. The apparatus of claim 29 including:

a first spring assembly having a spring travel limiter;

said first spring comprising a compression spring received around said travel limiter;

a spring actuator cap carried by a first end of a travel limiter for engaging said compressed spring, and a gripper actuator spring seat carried by a second end of said travel limits for engaging an opposite end of said spring so that said first spring is compressed to a length to provide a preset spring rate and a standard installation length.

32. The apparatus of claim 26 wherein said reciprocating mechanism has a generally uncompressed configuration wherein said reciprocating mechanism acts as a generally solid member to exert a downward force to actuate said gripper actuator when said first and second tube parts are in their first relative axial position and gripper tube assumes said standard length for gripping an article.

33. The apparatus of claim 26 including a profiled body carried by said second tube part in which said article grippers are carried and generally surrounded.

* * * * *